US009297295B2

(12) United States Patent
Scuderi et al.

(10) Patent No.: US 9,297,295 B2
(45) Date of Patent: Mar. 29, 2016

(54) SPLIT-CYCLE ENGINES WITH DIRECT INJECTION

(71) Applicant: Scuderi Group, Inc., West Springfield, MA (US)

(72) Inventors: Stephen P. Scuderi, Westfield, MA (US); Ford Allen Phillips, San Antonio, TX (US); David Branyon, San Antonio, TX (US); Thomas E. Briggs, Jr., Helotes, TX (US)

(73) Assignee: Scuderi Group, Inc., West Springfield, MA (US)

( * ) Notice: Subject to any disclaimer, the term of this patent is extended or adjusted under 35 U.S.C. 154(b) by 190 days.

(21) Appl. No.: 14/209,869

(22) Filed: Mar. 13, 2014

(65) Prior Publication Data

US 2014/0261325 A1 Sep. 18, 2014

Related U.S. Application Data

(60) Provisional application No. 61/789,360, filed on Mar. 15, 2013, provisional application No. 61/809,961, filed on Apr. 9, 2013, provisional application No. 61/811,176, filed on Apr. 12, 2013, provisional application No. 61/876,259, filed on Sep. 11, 2013, provisional application No. 61/884,870, filed on Sep. 30, 2013.

(51) Int. Cl.
*F02B 33/00* (2006.01)
*F02B 33/22* (2006.01)
(Continued)

(52) U.S. Cl.
CPC ..... *F02B 21/00* (2013.01); *F02B 33/22* (2013.01); *F02B 41/06* (2013.01)

(58) Field of Classification Search
CPC .... F02B 41/06; F02B 2075/025; F02B 33/00; F02B 3/06; F02B 75/18; F02B 75/24; F02B 33/22
USPC ..... 123/68, 70 R, 53.5
See application file for complete search history.

(56) References Cited

U.S. PATENT DOCUMENTS 1,062,999 A 5/1913 Webb
1,531,909 A 3/1925 Engemann
(Continued)

FOREIGN PATENT DOCUMENTS

DE 101 15 967 A1 10/2002
EP 1 101 917 B1 3/2004
(Continued)

OTHER PUBLICATIONS

U.S. Appl. No. 05/955,895, Two Stroke Internal Combustion Engine, filed Oct. 30, 1978. (16 pages).
(Continued)

*Primary Examiner* — Lindsay Low
*Assistant Examiner* — Syed O Hasan
(74) *Attorney, Agent, or Firm* — Nutter McClennen & Fish LLP; John J. Penny, Jr.; Michael P. Visconti, III

(57) ABSTRACT

In some embodiments, split-cycle engines are disclosed that are capable of operating in a normal firing mode in which a firing stroke is performed in the expansion cylinder only on every other rotation of the crankshaft. Fuel can be injected directly into the expansion cylinder during the non-firing rotation of the crankshaft over a period of time greater than what is possible with traditional split-cycle engines. A number of other advantages are associated with such engines. In some embodiments, two expansion cylinders can be provided such that a firing stroke is performed on every rotation of the crankshaft, even though each individual expansion cylinder only performs a firing stroke on every other rotation of the crankshaft. Air hybridized and/or Millerized variations of these engines, as well as various cylinder arrangements, are also disclosed herein.

20 Claims, 48 Drawing Sheets

(51) Int. Cl.

| | |
|---|---|
| ***F02B 75/24*** | (2006.01) |
| ***F02B 21/00*** | (2006.01) |
| *F02B 41/06* | (2006.01) |

(56) References Cited

U.S. PATENT DOCUMENTS

| | | | |
|---|---|---|---|
| 1,599,260 | A | 9/1926 | Willson |
| 1,936,653 | A | 11/1933 | Almen |
| 1,979,348 | A | 11/1934 | Russell |
| 2,058,705 | A | 10/1936 | Maniscalo |
| 2,109,809 | A | 3/1938 | Van Ranst |
| 2,111,734 | A | 3/1938 | Riley |
| 2,148,854 | A | 2/1939 | Bokemuller |
| 2,218,575 | A | 10/1940 | Griswold |
| 2,394,354 | A | 2/1946 | Barr |
| 2,772,667 | A | 12/1956 | Nallinger |
| 2,772,687 | A | 12/1956 | Wunsch et al. |
| 2,851,023 | A | 9/1958 | Durkan |
| 3,087,478 | A | 4/1963 | Fairchild |
| 3,209,737 | A | 10/1965 | Isao |
| 3,774,581 | A | 11/1973 | Lundy |
| 3,786,792 | A | 1/1974 | Pelizzoni et al. |
| 3,808,818 | A | 5/1974 | Cataldo |
| 3,880,126 | A | 4/1975 | Thurston et al. |
| 3,908,701 | A | 9/1975 | Dawawala |
| 3,935,765 | A | 2/1976 | Peltier et al. |
| 3,938,483 | A | 2/1976 | Firey |
| 3,949,964 | A | 4/1976 | Freeman |
| 4,133,172 | A | 1/1979 | Cataldo |
| 4,215,659 | A | 8/1980 | Lowther |
| 4,224,798 | A | 9/1980 | Brinkerhoff |
| 4,281,256 | A | 7/1981 | Ahrens et al. |
| 4,307,687 | A | 12/1981 | Holstein |
| 4,344,405 | A | 8/1982 | Zaharis |
| 4,418,657 | A | 12/1983 | Wishart |
| 4,565,167 | A | 1/1986 | Bryant |
| 4,606,314 | A | 8/1986 | Yamazaki |
| 4,696,158 | A | 9/1987 | DeFrancisco |
| 4,709,683 | A | 12/1987 | Schatz |
| 4,825,717 | A | 5/1989 | Mills |
| 4,860,716 | A | 8/1989 | Deutschmann |
| 4,934,652 | A | 6/1990 | Golden |
| 5,018,487 | A | 5/1991 | Shinkai |
| 5,035,959 | A | 7/1991 | Ito et al. |
| 5,080,054 | A | 1/1992 | Nakamura |
| 5,101,776 | A | 4/1992 | Ma |
| 5,113,813 | A | 5/1992 | Rosa |
| 5,193,495 | A | 3/1993 | Wood, III |
| 5,213,072 | A | 5/1993 | Dohring |
| 5,265,564 | A | 11/1993 | Dullaway |
| 5,402,756 | A | 4/1995 | Bohme et al. |
| 5,445,119 | A | 8/1995 | Regueiro |
| 5,528,900 | A | 6/1996 | Prasad |
| 5,555,861 | A | 9/1996 | Mayr et al. |
| 5,664,531 | A | 9/1997 | Kim |
| 5,690,066 | A | 11/1997 | Hampton et al. |
| 5,713,316 | A | 2/1998 | Sturman |
| 5,964,087 | A | 10/1999 | Tort-Oropeza |
| 5,975,036 | A | 11/1999 | Hayashi et al. |
| 5,988,124 | A | 11/1999 | Duesmann |
| 6,085,705 | A | 7/2000 | Vorih |
| 6,095,100 | A | 8/2000 | Hughes |
| 6,152,714 | A | 11/2000 | Mitsuya et al. |
| 6,192,841 | B1 | 2/2001 | Vorih et al. |
| 6,216,649 | B1 | 4/2001 | Laydera-Collins |
| 6,230,472 | B1 | 5/2001 | Stahlecker |
| 6,230,742 | B1 | 5/2001 | Bircann |
| 6,257,183 | B1 | 7/2001 | Vorih et al. |
| 6,267,098 | B1 | 7/2001 | Vanderpoel |
| 6,273,057 | B1 | 8/2001 | Schwoerer et al. |
| 6,302,370 | B1 | 10/2001 | Schwoerer et al. |
| 6,332,917 | B1 | 12/2001 | Schollkopf |
| 6,334,435 | B1 | 1/2002 | Negre et al. |
| 6,397,579 | B1 | 6/2002 | Negre |
| 6,412,457 | B1 | 7/2002 | Vorih et al. |
| 6,415,749 | B1 | 7/2002 | Sturman et al. |
| 6,474,277 | B1 | 11/2002 | Vanderpoel et al. |
| 6,510,824 | B2 | 1/2003 | Vorih et al. |
| 6,543,225 | B2 | 4/2003 | Scuderi |
| 6,550,433 | B2 | 4/2003 | Vorih et al. |
| 6,584,885 | B2 | 7/2003 | Lou |
| 6,609,371 | B2 | 8/2003 | Scuderi |
| 6,619,873 | B2 | 9/2003 | Parker |
| 6,647,954 | B2 | 11/2003 | Yang et al. |
| 6,655,327 | B1 | 12/2003 | Hedman |
| 6,694,933 | B1 | 2/2004 | Lester |
| 6,748,932 | B1 | 6/2004 | Sorter et al. |
| 6,789,514 | B2 | 9/2004 | Suh et al. |
| 6,874,453 | B2 | 4/2005 | Coney et al. |
| 6,883,775 | B2 | 4/2005 | Coney et al. |
| 6,886,511 | B1 | 5/2005 | Tong et al. |
| 6,952,923 | B2 | 10/2005 | Branyon et al. |
| 7,077,083 | B2 | 7/2006 | Dingle et al. |
| 7,140,332 | B2 | 11/2006 | Klein et al. |
| 7,156,062 | B2 | 1/2007 | Vanderpoel |
| 7,171,930 | B2 | 2/2007 | Keel |
| 7,201,156 | B1 | 4/2007 | Wait |
| 7,254,944 | B1 | 8/2007 | Goetzinger et al. |
| 7,314,027 | B2 | 1/2008 | Murata |
| 7,353,786 | B2 | 4/2008 | Scuderi et al. |
| 7,430,997 | B2 | 10/2008 | Muraji et al. |
| 7,481,190 | B2 | 1/2009 | Scuderi |
| 7,513,224 | B2 | 4/2009 | Heaton |
| 7,536,984 | B2 | 5/2009 | Lou |
| 7,588,001 | B2 | 9/2009 | Branyon et al. |
| 7,603,970 | B2 | 10/2009 | Scuderi et al. |
| 7,628,126 | B2 | 12/2009 | Scuderi |
| 7,637,234 | B2 | 12/2009 | Tussing et al. |
| 7,690,337 | B2 | 4/2010 | Pirault et al. |
| 7,810,459 | B2 | 10/2010 | Branyon et al. |
| 7,823,547 | B2 | 11/2010 | Forner, Sr. et al. |
| 7,908,860 | B2 | 3/2011 | Trombetta et al. |
| 7,954,462 | B2 | 6/2011 | Scuderi et al. |
| 7,960,337 | B2 | 6/2011 | Chaudhary |
| 7,963,259 | B2 | 6/2011 | Meldolesi et al. |
| 8,051,812 | B2 | 11/2011 | Lou |
| 8,079,338 | B2 | 12/2011 | Schwoerer et al. |
| 8,087,391 | B2 | 1/2012 | Tores et al. |
| 8,087,392 | B2 | 1/2012 | Swanbon et al. |
| 8,096,123 | B2 | 1/2012 | Liu et al. |
| 8,146,547 | B2 | 4/2012 | Lou |
| 8,156,904 | B2 | 4/2012 | Giannini et al. |
| 2002/0152976 | A1 | 10/2002 | Nguyen |
| 2002/0185091 | A1 | 12/2002 | Vorih et al. |
| 2003/0019444 | A1 | 1/2003 | Suh et al. |
| 2003/0192496 | A1 | 10/2003 | Walters |
| 2003/0221663 | A1 | 12/2003 | Vanderpoel et al. |
| 2004/0065308 | A1 | 4/2004 | Bryant |
| 2005/0022768 | A1 | 2/2005 | Tores et al. |
| 2005/0076868 | A1 | 4/2005 | Mott et al. |
| 2005/0132987 | A1 | 6/2005 | Chang |
| 2005/0268609 | A1 | 12/2005 | Branyon et al. |
| 2006/0011154 | A1 | 1/2006 | Scuderi et al. |
| 2006/0096560 | A1 | 5/2006 | Afjeh et al. |
| 2006/0124085 | A1 | 6/2006 | Luttgeharm |
| 2006/0180104 | A1 | 8/2006 | Springer |
| 2006/0207257 | A1 | 9/2006 | Turner et al. |
| 2006/0243229 | A1 | 11/2006 | Zajac |
| 2006/0273271 | A1 | 12/2006 | Yang et al. |
| 2007/0101958 | A1 | 5/2007 | Seitz |
| 2007/0157894 | A1 | 7/2007 | Scuderi et al. |
| 2007/0204818 | A1 | 9/2007 | Dingle |
| 2007/0221145 | A1 | 9/2007 | Forner et al. |
| 2007/0272180 | A1 | 11/2007 | Lou |
| 2008/0054205 | A1 | 3/2008 | Lou |
| 2008/0078345 | A1 | 4/2008 | Knauf et al. |
| 2008/0105225 | A1 | 5/2008 | Scuderi et al. |
| 2008/0196683 | A1 | 8/2008 | Hayman et al. |
| 2008/0202159 | A1 | 8/2008 | Fountain |
| 2008/0202454 | A1 | 8/2008 | Pirault |
| 2008/0202456 | A1 | 8/2008 | Diggs |
| 2008/0251041 | A1 | 10/2008 | Lou |
| 2009/0038596 | A1 | 2/2009 | Pirault et al. |
| 2009/0038598 | A1 | 2/2009 | Phillips |

(56) References Cited

U.S. PATENT DOCUMENTS

| | | | |
|---|---|---|---|
| 2009/0038599 | A1 | 2/2009 | Tussing et al. |
| 2009/0044778 | A1 | 2/2009 | Scuderi et al. |
| 2009/0056331 | A1 | 3/2009 | Zhao et al. |
| 2009/0056670 | A1 | 3/2009 | Zhao et al. |
| 2009/0107433 | A1 | 4/2009 | Tanaka |
| 2009/0133648 | A1 | 5/2009 | Lou |
| 2009/0205598 | A1 | 8/2009 | Takahashi et al. |
| 2009/0266347 | A1 | 10/2009 | Scuderi et al. |
| 2009/0276992 | A1 | 11/2009 | Maeda et al. |
| 2010/0095918 | A1 | 4/2010 | Cecur |
| 2010/0116231 | A1 | 5/2010 | Toda et al. |
| 2010/0126442 | A1 | 5/2010 | Lou |
| 2010/0132644 | A1 | 6/2010 | Methley et al. |
| 2010/0161202 | A1 | 6/2010 | Ide et al. |
| 2010/0180847 | A1 | 7/2010 | Meldolesi et al. |
| 2010/0180848 | A1 | 7/2010 | Meldolesi et al. |
| 2010/0180875 | A1 | 7/2010 | Meldolesi et al. |
| 2010/0186693 | A1 | 7/2010 | Ezaki |
| 2010/0192890 | A1 | 8/2010 | Brooks et al. |
| 2010/0236534 | A1 | 9/2010 | Scuderi et al. |
| 2010/0263646 | A1 | 10/2010 | Giannini et al. |
| 2010/0274466 | A1 | 10/2010 | Takamiya |
| 2010/0282225 | A1 | 11/2010 | Gilbert et al. |
| 2010/0300385 | A1 | 12/2010 | Durrett et al. |
| 2011/0036316 | A1 | 2/2011 | de Ojeda et al. |
| 2011/0108012 | A1 | 5/2011 | Bryant et al. |
| 2011/0220081 | A1 | 9/2011 | Meldolesi et al. |
| 2011/0220082 | A1 | 9/2011 | Meldolesi et al. |
| 2011/0220083 | A1 | 9/2011 | Meldolesi et al. |
| 2011/0253112 | A1 | 10/2011 | Guggenberger et al. |
| 2011/0303202 | A1 | 12/2011 | Moser et al. |
| 2011/0308505 | A1 | 12/2011 | Meldolesi |
| 2012/0073551 | A1 | 3/2012 | Branyon et al. |
| 2012/0073552 | A1 | 3/2012 | Phillips |
| 2012/0073553 | A1 | 3/2012 | Phillips |
| 2012/0080017 | A1 | 4/2012 | Phillips et al. |
| 2012/0103311 | A1 | 5/2012 | Anders et al. |
| 2012/0192817 | A1 | 8/2012 | Meldolesi et al. |
| 2012/0192818 | A1 | 8/2012 | Meldolesi et al. |
| 2012/0192840 | A1 | 8/2012 | Meldolesi et al. |
| 2012/0192841 | A1 | 8/2012 | Meldolesi et al. |
| 2012/0255296 | A1 | 10/2012 | Phillips et al. |
| 2012/0298086 | A1 | 11/2012 | Scuderi |
| 2013/0152889 | A1 | 6/2013 | Meldolesi et al. |

FOREIGN PATENT DOCUMENTS

| | | | |
|---|---|---|---|
| GB | 2 250 801 | A | 6/1992 |
| GB | 2 340 881 | A | 3/2000 |
| JP | 40-010860 | | 4/1965 |
| JP | 10-274105 | A | 10/1998 |
| JP | 2004-293695 | A | 10/2004 |
| WO | 2006/094213 | A1 | 9/2006 |

OTHER PUBLICATIONS

U.S. Appl. No. 05/955,896, Internal Combustion Engine, filed Oct. 30, 1978. (13 pages).

International Search Report and Written Opinion for Application No. PCT/US14/26552, mailed Aug. 11, 2014 (26 pages).

SPLIT-CYCLE ENGINES WITH DIRECT INJECTION

CROSS-REFERENCE TO RELATED APPLICATIONS

This application claims the benefit of priority of U.S. Provisional Patent Application No. 61/789,360, filed on Mar. 15, 2013; U.S. Provisional Patent Application No. 61/809,961, filed on Apr. 9, 2013; U.S. Provisional Patent Application No. 61/811,176, filed on Apr. 12, 2013; U.S. Provisional Patent Application No. 61/876,259, filed on Sep. 11, 2013; and U.S. Provisional Patent Application No. 61/884,870, filed on Sep. 30, 2013, the entire contents of each of which are hereby incorporated by reference.

FIELD

Internal combustion engines are disclosed herein. In particular, split-cycle internal combustion engines are disclosed herein.

BACKGROUND

Engine Technology

For purposes of clarity, the term "conventional engine" as used in the present application refers to an internal combustion engine wherein all four strokes of the well-known Otto cycle (the intake, compression, expansion and exhaust strokes) are contained in each piston/cylinder combination of the engine. Each stroke requires one half revolution of the crankshaft (180 degrees crank angle ("CA")), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine generally comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

A split-cycle air hybrid engine combines a split-cycle engine with an air reservoir (also commonly referred to as an air tank) and various controls. This combination enables the engine to store energy in the form of compressed air in the air reservoir. The compressed air in the air reservoir is later used in the expansion cylinder to power the crankshaft. In general, a split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

FIG. 1 illustrates one exemplary embodiment of a prior art split-cycle air hybrid engine. The split-cycle engine 100 replaces two adjacent cylinders of a conventional engine with a combination of one compression cylinder 102 and one expansion cylinder 104. The compression cylinder 102 and the expansion cylinder 104 are formed in an engine block in which a crankshaft 106 is rotatably mounted. Upper ends of the cylinders 102, 104 are closed by a cylinder head 130. The crankshaft 106 includes axially displaced and angularly offset first and second crank throws 126, 128, having a phase angle therebetween. The first crank throw 126 is pivotally joined by a first connecting rod 138 to a compression piston 110, and the second crank throw 128 is pivotally joined by a second connecting rod 140 to an expansion piston 120 to reciprocate the pistons 110, 120 in their respective cylinders 102, 104 in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The four strokes of the Otto cycle are thus "split" over the two cylinders 102 and 104 such that the compression cylinder 102 contains the intake and compression strokes and the expansion cylinder 104 contains the expansion and exhaust strokes. The Otto cycle is therefore completed in these two cylinders 102, 104 once per crankshaft 106 revolution (360 degrees CA).

During the intake stroke, intake air is drawn into the compression cylinder 102 through an inwardly-opening (opening inwardly into the cylinder and toward the piston) poppet intake valve 108. During the compression stroke, the compression piston 110 pressurizes the air charge and drives the air charge through a crossover passage 112, which acts as the intake passage for the expansion cylinder 104. The engine 100 can have one or more crossover passages 112.

The geometric compression ratio of the compression cylinder 102 of the split-cycle engine 100 (and for split-cycle engines in general) is herein referred to as the "compression ratio" of the split-cycle engine. The geometric compression ratio of the expansion cylinder 104 of the engine 100 (and for split-cycle engines in general) is herein referred to as the "expansion ratio" of the split-cycle engine. The geometric compression ratio of a cylinder is well known in the art as the ratio of the enclosed (or trapped) volume in the cylinder (including all recesses) when a piston reciprocating therein is at its BDC position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high geometric compression ratios (e.g., 20 to 1, 30 to 1, 40 to 1, or greater) within the compression cylinder 102, an outwardly-opening (opening outwardly away from the cylinder and piston) poppet crossover compression (XovrC) valve 114 at the inlet of the crossover passage 112 is used to control flow from the compression cylinder 102 into the crossover passage 112. Due to very high geometric compression ratios (e.g., 20 to 1, 30 to 1, 40 to 1, or greater) within the expansion cylinder 104, an outwardly-opening poppet crossover expansion (XovrE) valve 116 at the outlet of the crossover passage 112 controls flow from the crossover passage 112 into the expansion cylinder 104. The actuation rates and phasing of the XovrC and XovrE valves 114, 116 are timed to maintain pressure in the crossover passage 112 at a high minimum pressure (typically 20 bar or higher at full load) during all four strokes of the Otto cycle.

At least one fuel injector 118 injects fuel into the pressurized air at the exit end of the crossover passage 112 in coordination with the XovrE valve 116 opening. Alternatively, or in addition, fuel can be injected directly into the expansion cylinder 104. The fuel-air charge fully enters the expansion cylinder 104 shortly after the expansion piston 120 reaches its TDC position. As the piston 120 begins its descent from its TDC position, and while the XovrE valve 116 is still open, one or more spark plugs 122 are fired to initiate combustion (typically between 10 to 20 degrees CA after TDC of the expansion piston 120). Combustion can be initiated while the expansion piston is between 1 and 30 degrees CA past its TDC position. More preferably, combustion can be initiated while the expansion piston is between 5 and 25 degrees CA past its TDC position. Most preferably, combustion can be initiated while the expansion piston is between 10 and 20 degrees CA past its TDC position. Additionally, combustion can be initiated through other ignition devices and/or methods, such as with glow plugs, microwave ignition devices, or through compression ignition methods.

The XovrE valve 116 is then closed before the resulting combustion event enters the crossover passage 112. The combustion event drives the expansion piston 120 downward in a power stroke. Exhaust gases are pumped out of the expansion cylinder 104 through an inwardly-opening poppet exhaust valve 124 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 126, 128 for the compression cylinder 102 and expansion cylinder 104, respectively, have different radii and are phased apart from one another with TDC of the expansion piston 120 occurring prior to TDC of the compression piston 110. This independence enables the split-cycle engine to potentially achieve higher efficiency levels and greater torques than typical four-stroke engines.

The geometric independence of engine parameters in the split-cycle engine 100 is also one of the main reasons why pressure can be maintained in the crossover passage 112 as discussed earlier. Specifically, the expansion piston 120 reaches its TDC position prior to the compression piston 110 reaching its TDC position by a discrete phase angle (typically between 10 and 30 crank angle degrees). This phase angle, together with proper timing of the XovrC valve 114 and the XovrE valve 116, enables the split-cycle engine 100 to maintain pressure in the crossover passage 112 at a high minimum pressure (typically 20 bar absolute or higher during full load operation) during all four strokes of its pressure/volume cycle. That is, the split-cycle engine 100 is operable to time the XovrC valve 114 and the XovrE valve 116 such that the XovrC and XovrE valves 114, 116 are both open for a substantial period of time (or period of crankshaft rotation) during which the expansion piston 120 descends from its TDC position towards its BDC position and the compression piston 110 simultaneously ascends from its BDC position towards its TDC position. During the period of time (or crankshaft rotation) that the crossover valves 114, 116 are both open, a substantially equal mass of gas is transferred (1) from the compression cylinder 102 into the crossover passage 112 and (2) from the crossover passage 112 to the expansion cylinder 104. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 80% of the entire intake and exhaust strokes or greater), the XovrC valve 114 and XovrE valve 116 are both closed to maintain the mass of trapped gas in the crossover passage 112 at a substantially constant level. As a result, the pressure in the crossover passage 112 is maintained at a predetermined minimum pressure during all four strokes of the engine's pressure/volume cycle.

For purposes herein, the method of opening the XovrC 114 and XovrE 116 valves while the expansion piston 120 is descending from TDC and the compression piston 110 is ascending toward TDC in order to simultaneously transfer a substantially equal mass of gas into and out of the crossover passage 112 is referred to as the "push-pull" method of gas transfer. It is the push-pull method that enables the pressure in the crossover passage 112 of the engine 100 to be maintained at typically 20 bar or higher during all four strokes of the engine's cycle when the engine is operating at full load.

The crossover valves 114, 116 are actuated by a valve train that includes one or more cams (not shown). In general, a cam-driven mechanism includes a camshaft mechanically linked to the crankshaft. One or more cams are mounted to the camshaft, each having a contoured surface that controls the valve lift profile of the valve event (i.e., the event that occurs during a valve actuation). The XovrC valve 114 and the XovrE valve 116 each can have its own respective cam and/or its own respective camshaft. As the XovrC and XovrE cams rotate, actuating portions thereof impart motion to a rocker arm, which in turn imparts motion to the valve, thereby lifting (opening) the valve off of its valve seat. As the cam continues to rotate, the actuating portion passes the rocker arm and the valve is allowed to close. The valves of the engine 100 can also be actuated by a variable valve actuation system, for example as disclosed in U.S. Publication No. 2013/0152889, filed on Dec. 14, 2012, entitled "LOST-MOTION VARIABLE VALVE ACTUATION SYSTEM," the entire contents of which are hereby incorporated by reference herein.

The split-cycle air hybrid engine 100 also includes an air reservoir (tank) 142, which is operatively connected to the crossover passage 112 by an air reservoir tank valve 152. Embodiments with two or more crossover passages 112 may include a tank valve 152 for each crossover passage 112 which connect to a common air reservoir 142, may include a single valve which connects all crossover passages 112 to a common air reservoir 142, or each crossover passage 112 may operatively connect to separate air reservoirs 142.

The tank valve 152 is typically disposed in an air tank port 154, which extends from the crossover passage 112 to the air tank 142. The air tank port 154 is divided into a first air tank port section 156 and a second air tank port section 158. The first air tank port section 156 connects the air tank valve 152 to the crossover passage 112, and the second air tank port section 158 connects the air tank valve 152 to the air tank 142. The volume of the first air tank port section 156 includes the volume of all additional recesses which connect the tank valve 152 to the crossover passage 112 when the tank valve 152 is closed. Preferably, the volume of the first air tank port section 156 is small relative to the second air tank port section 158. More preferably, the first air tank port section 156 is substantially non-existent, that is, the tank valve 152 is most preferably disposed such that it is flush against the outer wall of the crossover passage 112.

The tank valve 152 may be any suitable valve device or system. For example, the tank valve 152 may be an active valve which is activated by various valve actuation devices (e.g., pneumatic, hydraulic, cam, electric, or the like). Additionally, the tank valve 152 may comprise a tank valve system with two or more valves actuated with two or more actuation devices.

The air tank 142 is utilized to store energy in the form of compressed air and to later use that compressed air to power the crankshaft 106. This mechanical means for storing potential energy provides numerous potential advantages over the current state of the art. For instance, the split-cycle air hybrid engine 100 can potentially provide many advantages in fuel efficiency gains and NOx emissions reduction at relatively low manufacturing and waste disposal costs in relation to other technologies on the market, such as diesel engines and electric-hybrid systems.

The engine 100 typically runs in a normal operating or firing (NF) mode (also commonly called the engine firing (EF) mode) and one or more of four basic air hybrid modes. In the NF mode, the engine 100 functions normally as previously described in detail herein, operating without the use of the air tank 142. In the NF mode, the air tank valve 152 remains closed to isolate the air tank 142 from the basic split-cycle engine. In the four air hybrid modes, the engine 100 operates with the use of the air tank 142.

The four basic air hybrid modes include:

1) Air Expander (AE) mode, which includes using compressed air energy from the air tank 142 without combustion;

2) Air Compressor (AC) mode, which includes storing compressed air energy into the air tank 142 without combustion;

3) Air Expander and Firing (AEF) mode, which includes using compressed air energy from the air tank 142 with combustion; and 4) Firing and Charging (FC) mode, which includes storing compressed air energy into the air tank 142 with combustion.

Further details on split-cycle engines can be found in U.S. Pat. No. 6,543,225 entitled Split Four Stroke Cycle Internal Combustion Engine and issued on Apr. 8, 2003; and U.S. Pat. No. 6,952,923 entitled Split-Cycle Four-Stroke Engine and issued on Oct. 11, 2005, each of which is hereby incorporated by reference herein in its entirety.

Further details on air hybrid engines are disclosed in U.S. Pat. No. 7,353,786 entitled Split-Cycle Air Hybrid Engine and issued on Apr. 8, 2008; U.S. patent application Ser. No. 61/365,343 entitled Split-Cycle Air Hybrid Engine and filed on Jul. 18, 2010; and U.S. patent application Ser. No. 61/313,831 entitled Split-Cycle Air Hybrid Engine and filed on Mar. 15, 2010, each of which is hereby incorporated by reference herein in its entirety.

Fuel Injection

In the split-cycle engines described above, the four strokes of a conventional, Otto cycle engine are divided over two paired cylinders. The compression cylinder performs the intake and compression strokes and the expansion cylinder performs the expansion and exhaust strokes. Each of these four strokes is completed in one revolution of the crankshaft, as opposed to the four strokes requiring two revolutions as in a conventional engine. The split-cycle engines described above thus provide the same average number of firing strokes per cylinder per revolution as a conventional engine (i.e., two firing strokes per two cylinders for every two revolutions of the crankshaft). Split-cycle engines of the type described above can provide a number of advantages, such as sonic velocity for increased combustion rate, extreme Millerization (downsizing of the compression cylinder relative to the expansion cylinder), air-hybridization, and waste heat recovery through the crossover passage.

Several advantages have been observed in conventional engines when using direct injection systems in which fuel is injected directly into the cylinder. For example, the risk of premature fuel combustion is reduced with direct injection systems, as the fuel is typically exposed to high pressure and high temperature conditions for a shorter amount of time. In split-cycle engines, however, fuel delivery directly into the expansion cylinder can be a challenge when operating in the normal firing mode.

For example, the timing parameters of the split-cycle engine are such that the fuel must be delivered in a window of about 30 degrees CA, allowing very little time for mixing and distribution. In conventional engines, on the other hand, the window for fuel injection is about 360 degrees CA. This problem is even more pronounced when operating at full load, as a large amount of fuel must be injected in a short period of time. Fuel injectors with larger openings can be used, but this weakens the structure of the injector and reduces its pressure capacity. Also, if the injector is sized for full-load operating conditions, it may not perform well at part-load and low-load operating conditions.

Additionally, the high volumetric compression ratio of the expansion cylinder reduces the clearance space at top dead center (TDC) in split-cycle engines. As a result, conventional direct injection fuel injectors may not be able to adequately target the fuel and could excessively wet the walls of the cylinder, resulting in poor vaporization of the fuel. Conventional engines, on the other hand, have much lower volumetric compression ratios and a larger clearance space between the piston crown and cylinder head fire deck at TDC, which eliminates many of these challenges.

Finally, the temperatures in the expansion cylinder of a split-cycle engine can be much higher than the cylinder temperature in a convention engine because the high temperature strokes (expansion and exhaust) are performed repeatedly in some operating modes without any intermediate cooling strokes (intake and compression in a conventional engine).

SUMMARY

In some embodiments, split-cycle engines are disclosed that are capable of operating in a normal firing mode in which a firing stroke is performed in the expansion cylinder only on every other rotation of the crankshaft. Fuel can be injected directly into the expansion cylinder during the non-firing rotation of the crank shaft over a period of time greater than what is possible with traditional split-cycle engines. A number of other advantages are associated with such engines. In some embodiments, two expansion cylinders can be provided such that a firing stroke is performed on every rotation of the crankshaft, even though each individual expansion cylinder only performs a firing stroke on every other rotation of the crankshaft. Air hybridized and/or Millerized variations of these engines, as well as various cylinder arrangements, are also disclosed herein.

In one aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through a primary intake stroke and a primary compression stroke during a first rotation of the crankshaft and through a standby intake stroke and a standby compression stroke during a second rotation of the crankshaft immediately following the first rotation of the crankshaft, an expansion piston slidably received within an expansion cylinder and operatively connected to the crankshaft such that the expansion piston reciprocates through a standby expansion stroke and a standby exhaust stroke during the first rotation of the crankshaft and through a primary expansion stroke and a primary exhaust stroke during the second rotation of the crankshaft, a crossover passage interconnecting the compression and expansion cylinders, and a fuel injector configured to inject fuel into the expansion cylinder during at least a portion of at least one of the standby expansion stroke and the standby exhaust stroke.

Related aspects of at least one embodiment of the invention provide an engine (e.g., as described above) in which the engine is configured to continuously alternate between the first rotation of the crankshaft and the second rotation of the crankshaft.

Related aspects of at least one embodiment of the invention provide an engine (e.g., as described above) that includes an intake valve configured to control fluid communication between an intake port and the compression cylinder and an exhaust valve configured to control fluid communication between the expansion cylinder and an exhaust port.

Related aspects of at least one embodiment of the invention provide an engine (e.g., as described above) that includes a crossover compression (XovrC) valve configured to control fluid communication between the compression cylinder and the crossover passage and a crossover expansion (XovrE) valve configured to control fluid communication between the crossover passage and the expansion cylinder.

Related aspects of at least one embodiment of the invention provide an engine (e.g., as described above) in which the intake valve is configured to remain closed during the standby intake stroke and the standby compression stroke to idle the compression cylinder during the second rotation of the crankshaft.

Related aspects of at least one embodiment of the invention provide an engine (e.g., as described above) in which the intake valve is configured to remain open during the standby intake stroke and the standby compression stroke to idle the compression cylinder during the second rotation of the crankshaft.

Related aspects of at least one embodiment of the invention provide an engine (e.g., as described above) in which the exhaust valve is configured to remain closed during the standby expansion stroke and the standby exhaust stroke to idle the expansion cylinder during the first rotation of the crankshaft.

Related aspects of at least one embodiment of the invention provide an engine (e.g., as described above) in which the exhaust valve is configured to be open during at least a portion of the standby expansion stroke and closed during at least a portion of the standby exhaust stroke such that air is drawn into the expansion cylinder during the portion of the standby expansion stroke and compressed during the portion of the standby exhaust stroke.

Related aspects of at least one embodiment of the invention provide an engine (e.g., as described above) in which the air is compressed during the standby exhaust stroke to a pressure that is at least about 2 atm to reduce the pressure differential between the crossover passage and the expansion cylinder at the start of the next primary expansion stroke.

Related aspects of at least one embodiment of the invention provide an engine (e.g., as described above) that includes an air tank operatively coupled to the crossover passage such that the engine is operable in at least one firing mode and at least one non-firing mode.

Related aspects of at least one embodiment of the invention provide an engine (e.g., as described above) in which the compression piston is configured to compress air into the air tank during the standby compression stroke.

Related aspects of at least one embodiment of the invention provide an engine (e.g., as described above) in which the fuel injector is configured to inject fuel into the expansion cylinder only when the engine is operating in the at least one firing mode, and wherein the expansion piston is configured to compress air into the air tank during the standby exhaust stroke when the engine is operating in the at least one non-firing mode.

Related aspects of at least one embodiment of the invention provide an engine (e.g., as described above) in which the exhaust valve is configured to remain open during the standby expansion stroke and during a first portion of the standby exhaust stroke, and is configured to remain closed during a second portion of the standby exhaust stroke, and in which the fuel injector is configured to inject fuel into the expansion cylinder only during the second portion of the standby exhaust stroke.

Related aspects of at least one embodiment of the invention provide an engine (e.g., as described above) in which the second portion of the standby exhaust stroke is about 50% of the standby exhaust stroke.

Related aspects of at least one embodiment of the invention provide an engine (e.g., as described above) in which the fuel comprises natural gas and wherein the fuel injector is configured to be fed by a natural gas supply having a pressure that is less than at least one of about 60 psi, about 20 psi, about 5 psi, about 1 psi, about 0.5 psi, and about 0.25 psi.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through a first intake stroke and a first compression stroke during a first rotation of the crankshaft and through a second intake stroke and a second compression stroke during a second rotation of the crankshaft immediately following the first rotation of the crankshaft, a first expansion piston slidably received within a first expansion cylinder and operatively connected to the crankshaft such that the first expansion piston reciprocates through a standby expansion stroke and a standby exhaust stroke during the first rotation of the crankshaft and through a primary expansion stroke and a primary exhaust stroke during the second rotation of the crankshaft, a second expansion piston slidably received within a second expansion cylinder and operatively connected to the crankshaft such that the second expansion piston reciprocates through a primary expansion stroke and a primary exhaust stroke during the first rotation of the crankshaft and through a standby expansion stroke and a standby exhaust stroke during the second rotation of the crankshaft, a first crossover passage interconnecting the compression cylinder and the first expansion cylinder, a second crossover passage interconnecting the compression cylinder and the second expansion cylinder, a first fuel injector configured to inject fuel into the first expansion cylinder during at least a portion of at least one of the standby expansion stroke and the standby exhaust stroke of the first expansion piston, and a second fuel injector configured to inject fuel into the second expansion cylinder during at least a portion of at least one of the standby expansion stroke and the standby exhaust stroke of the second expansion piston.

Related aspects of at least one embodiment of the invention provide an engine (e.g., as described above) in which the engine is configured to continuously alternate between the first rotation of the crankshaft and the second rotation of the crankshaft.

Related aspects of at least one embodiment of the invention provide an engine (e.g., as described above) that includes an intake valve configured to control fluid communication between an intake port and the compression cylinder, a first exhaust valve configured to control fluid communication between the first expansion cylinder and a first exhaust port, and a second exhaust valve configured to control fluid communication between the second expansion cylinder and a second exhaust port.

Related aspects of at least one embodiment of the invention provide an engine (e.g., as described above) that includes a first crossover compression (XovrC) valve configured to control fluid communication between the compression cylinder and the first crossover passage, a second crossover compression (XovrC) valve configured to control fluid communication between the compression cylinder and the second crossover passage, a first crossover expansion (XovrE) valve configured to control fluid communication between the first crossover passage and the first expansion cylinder, and a second crossover expansion (XovrE) valve configured to control fluid communication between the second crossover passage and the second expansion cylinder.

Related aspects of at least one embodiment of the invention provide an engine (e.g., as described above) in which the first exhaust valve is configured to remain closed during the standby expansion stroke and the standby exhaust stroke of the first expansion cylinder to idle the first expansion cylinder during the first rotation of the crankshaft.

Related aspects of at least one embodiment of the invention provide an engine (e.g., as described above) in which the first exhaust valve is configured to remain open during the standby expansion stroke of the first expansion cylinder and during a first portion of the standby exhaust stroke of the first expansion cylinder, and is configured to remain closed during a second portion of the standby exhaust stroke of the first expansion cylinder, and in which the first fuel injector is configured to inject fuel into the first expansion cylinder only during the second portion of the standby exhaust stroke of the first expansion cylinder.

Related aspects of at least one embodiment of the invention provide an engine (e.g., as described above) in which the volume of the first expansion cylinder is the same as the volume of the second expansion cylinder and wherein the volume of the compression cylinder is less than the volume of the first expansion cylinder.

Related aspects of at least one embodiment of the invention provide an engine (e.g., as described above) in which the volume of the first expansion cylinder is at least twice the volume of the compression cylinder.

Related aspects of at least one embodiment of the invention provide an engine (e.g., as described above) that includes an air tank operatively coupled to the first crossover passage and the second crossover passage such that the first expansion cylinder is operable in at least one firing mode and at least one non-firing mode and the second expansion cylinder is operable in at least one firing mode and at least one non-firing mode.

Related aspects of at least one embodiment of the invention provide an engine (e.g., as described above) in which the first fuel injector is configured to inject fuel into the first expansion cylinder only when the first expansion cylinder is operating in the at least one firing mode, and wherein the first expansion piston is configured to compress air into the air tank during the standby exhaust stroke of the first expansion cylinder when the first expansion cylinder is operating in the at least one non-firing mode.

Related aspects of at least one embodiment of the invention provide an engine (e.g., as described above) in which the compression cylinder, the first expansion cylinder, and the second expansion cylinder are arranged in an inline configuration.

Related aspects of at least one embodiment of the invention provide an engine (e.g., as described above) in which the compression cylinder is arranged between the first and second expansion cylinders.

Related aspects of at least one embodiment of the invention provide an engine (e.g., as described above) in which the compression cylinder, the first expansion cylinder, and the second expansion cylinder are arranged in a boxer or V configuration.

Related aspects of at least one embodiment of the invention provide an engine (e.g., as described above) in which the compression cylinder is arranged in a first cylinder bank of the engine and the first and second expansion cylinders are arranged in a second cylinder bank of the engine.

Related aspects of at least one embodiment of the invention provide an engine (e.g., as described above) in which the engine includes first and second operative units, the first operative unit includes the compression cylinder and the first and second expansion cylinders, and the second operative unit includes its own respective compression cylinder and first and second expansion cylinders.

Related aspects of at least one embodiment of the invention provide an engine (e.g., as described above) in which the first operative unit is arranged in a first cylinder bank of the engine and the second operative unit is arranged in a second cylinder bank of the engine.

Related aspects of at least one embodiment of the invention provide an engine (e.g., as described above) in which the compression cylinder of the first operative unit is arranged in a first cylinder bank of the engine with the first and second expansion cylinders of the second operative unit, and the compression cylinder of the second operative unit is arranged in a second cylinder bank of the engine with the first and second expansion cylinders of the first operative unit.

In another aspect of at least one embodiment of the invention, a method of operating an engine is provided that includes, during a first rotation of a crankshaft about a crankshaft axis, drawing air into a compression cylinder as a compression piston reciprocally disposed therein and operatively connected to the crankshaft descends in a primary intake stroke, compressing the air as the compression piston ascends in a primary compression stroke, idling an expansion cylinder having an expansion piston reciprocally disposed therein and operatively coupled to the crankshaft as the expansion piston descends in a standby expansion stroke, and idling the expansion cylinder as the expansion piston ascends in a standby exhaust stroke. The method also includes, during a second rotation of the crankshaft immediately following the first rotation of the crankshaft, idling the compression cylinder as the compression piston descends in a standby intake stroke, idling the compression cylinder as the compression piston ascends in a standby compression stroke, combusting fuel to drive the expansion piston down in a primary expansion stroke, and exhausting the expansion cylinder as the expansion piston ascends in a primary exhaust stroke. The method also includes injecting fuel into the expansion cylinder during at least one of the standby expansion stroke and the standby exhaust stroke.

Related aspects of at least one embodiment of the invention provide a method (e.g., as described above) in which idling the compression cylinder in the standby intake and standby compression strokes comprises keeping an intake valve configured to control fluid communication between an intake port and the compression cylinder closed during said strokes.

Related aspects of at least one embodiment of the invention provide a method (e.g., as described above) in which idling the compression cylinder in the standby intake and standby compression strokes comprises keeping an intake valve configured to control fluid communication between an intake port and the compression cylinder open during said strokes.

Related aspects of at least one embodiment of the invention provide a method (e.g., as described above) in which idling the expansion cylinder in the standby expansion and standby exhaust strokes comprises keeping an exhaust valve configured to control fluid communication between the expansion cylinder and an exhaust port closed during said strokes.

Related aspects of at least one embodiment of the invention provide a method (e.g., as described above) in which idling the expansion cylinder in the standby expansion and standby exhaust strokes comprises keeping an exhaust valve configured to control fluid communication between the expansion cylinder and an exhaust port open during the standby expansion stroke and during a first portion of the standby exhaust stroke and keeping the exhaust valve closed during a second portion of the standby exhaust stroke, and wherein injecting the fuel is performed only during the second portion of the standby exhaust stroke.

Related aspects of at least one embodiment of the invention provide a method (e.g., as described above) that includes compressing air disposed in the compression cylinder into an air tank during the standby compression stroke.

Related aspects of at least one embodiment of the invention provide a method (e.g., as described above) in which injecting the fuel is performed only when the engine is operating in at least one firing mode, and wherein the method further comprises compressing air disposed in the expansion cylinder into an air tank during the standby exhaust stroke when the engine is operating in at least one non-firing mode.

In another aspect of at least one embodiment of the invention, a method of operating an engine is provided that includes, during a first rotation of a crankshaft about a crankshaft axis, drawing air into a compression cylinder as a compression piston reciprocally disposed therein and operatively connected to the crankshaft descends in a first intake stroke, compressing the air as the compression piston ascends in a first compression stroke, idling a first expansion cylinder having a first expansion piston reciprocally disposed therein and operatively coupled to the crankshaft as the first expansion piston descends in a standby expansion stroke, idling the first expansion cylinder as the first expansion piston ascends in a standby exhaust stroke, combusting fuel to drive a second expansion piston reciprocally disposed in a second expansion cylinder and operatively coupled to the crankshaft down in a primary expansion stroke, and exhausting the second expansion cylinder as the second expansion piston ascends in a primary exhaust stroke. The method also includes, during a second rotation of the crankshaft immediately following the first rotation of the crankshaft, drawing air into the compression cylinder as the compression piston descends in a second intake stroke, compressing the air as the compression piston ascends in a second compression stroke, combusting fuel to drive the first expansion piston down in a primary expansion stroke, exhausting the first expansion cylinder as the first expansion piston ascends in a primary exhaust stroke, idling the second expansion cylinder as second expansion piston descends in a standby expansion stroke, and idling the second expansion cylinder as the second expansion piston ascends in a standby exhaust stroke. The method also includes injecting fuel into the first expansion cylinder during at least one of the standby expansion stroke and the standby exhaust stroke of the first expansion cylinder, and injecting fuel into the second expansion cylinder during at least one of the standby expansion stroke and the standby exhaust stroke of the second expansion cylinder.

Related aspects of at least one embodiment of the invention provide a method (e.g., as described above) in which injecting the fuel into the first expansion cylinder is performed only when the first expansion cylinder is operating in a firing mode, and wherein the method further comprises compressing air disposed in the first expansion cylinder into an air tank during the standby exhaust stroke of the first expansion cylinder when the engine is operating in a non-firing mode.

Related aspects of at least one embodiment of the invention provide a method (e.g., as described above) in which injecting the fuel into the second expansion cylinder is performed only when the second expansion cylinder is operating in a firing mode, and wherein the method further comprises compressing air disposed in the second expansion cylinder into an air tank during the standby exhaust stroke of the second expansion cylinder when the engine is operating in a non-firing mode.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through an intake stroke and a compression stroke during a first rotation of the crankshaft, an expansion piston slidably received within an expansion cylinder and operatively connected to the crankshaft such that the expansion piston reciprocates through an expansion stroke and an exhaust stroke during the first rotation of the crankshaft, a crossover passage interconnecting the compression and expansion cylinders, and a fuel injector configured to inject fuel into the expansion cylinder during a portion of the exhaust stroke.

Related aspects of at least one embodiment of the invention provide an engine (e.g., as described above) that includes an exhaust valve that controls fluid communication between the expansion cylinder and an exhaust port, the exhaust valve being configured to close part way through the exhaust stroke, before the portion of the exhaust stroke during which fuel is injected into the expansion cylinder.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through a primary intake stroke and a primary compression stroke during a first rotation of the crankshaft and through a standby intake stroke and a standby compression stroke during a second rotation of the crankshaft immediately following the first rotation of the crankshaft, an expansion piston slidably received within an expansion cylinder and operatively connected to the crankshaft such that the expansion piston reciprocates through a standby expansion stroke and a standby exhaust stroke during the first rotation of the crankshaft and through a primary expansion stroke and a primary exhaust stroke during the second rotation of the crankshaft, a crossover passage interconnecting the compression and expansion cylinders, a fuel injector configured to inject fuel into the expansion cylinder during at least a portion of at least one of the standby expansion stroke and the standby exhaust stroke, and a valve configured to control fluid communication between the expansion cylinder and a source of fresh air, the valve being configured to be open during at least a portion of the standby expansion stroke before fuel is injected into the expansion cylinder.

Related aspects of at least one embodiment of the invention provide an engine (e.g., as described above) in which the valve is configured to control fluid communication between the expansion cylinder and an intake air port.

Related aspects of at least one embodiment of the invention provide an engine (e.g., as described above) in which the valve is a diverter valve having a first position in which an exhaust port of the expansion cylinder is in fluid communication with an intake air port and a second position in which the exhaust port is in fluid communication with an exhaust system.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through a primary intake stroke and a primary compression stroke during a first rotation of the crankshaft and through a standby intake stroke and a standby compression stroke during a second rotation of the crankshaft immediately following the first rotation of the crankshaft, an expansion piston slidably received within an expansion cylinder and operatively connected to the crankshaft such that the expansion piston reciprocates through a standby expansion stroke and a standby exhaust stroke during the first rotation of the crankshaft and through a primary expansion stroke and a primary exhaust stroke during the second rotation of the crankshaft, a crossover passage interconnecting the compression and expansion cylinders, a fuel injector configured to inject fuel into the expansion cylinder during at least a portion of the standby exhaust stroke, and a valve configured to control fluid communication between the expansion cylinder and a source of fresh air, the valve being configured to be open during at least a portion of the standby expansion stroke.

Related aspects of at least one embodiment of the invention provide an engine (e.g., as described above) in which the valve is a crossover expansion valve configured to control fluid communication between the crossover passage and the expansion cylinder.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through a primary intake stroke and a primary compression stroke during a first rotation of the crankshaft and through a standby intake stroke and a standby compression stroke during a second rotation of the crankshaft immediately following the first rotation of the crankshaft, and an expansion piston slidably received within an expansion cylinder and operatively connected to the crankshaft such that the expansion piston reciprocates through a standby expansion stroke and a standby exhaust stroke during the first rotation of the crankshaft and through a primary expansion stroke and a primary exhaust stroke during the second rotation of the crankshaft. The engine also includes a crossover passage interconnecting the compression and expansion cylinders, an exhaust valve configured to be in a closed position during a later portion of the primary exhaust stroke to trap residual combustion gases in the expansion cylinder, and a fuel injector configured to inject fuel into the expansion cylinder during at least one of the later portion of the primary exhaust stroke, the standby expansion stroke, and the standby exhaust stroke.

In another aspect of at least one embodiment of the invention, a split-cycle engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, an expansion piston slidably received within an expansion cylinder and operatively connected to the crankshaft such that the expansion piston reciprocates through an expansion stroke and an exhaust stroke during the single rotation of the crankshaft, a crossover passage interconnecting the compression and expansion cylinders, an exhaust valve configured to be in a closed position during a later portion of the exhaust stroke to trap residual combustion gases in the expansion cylinder, and a fuel injector configured to inject fuel into the expansion cylinder during said later portion of the exhaust stroke.

Related aspects of at least one embodiment of the invention provide an engine (e.g., as described above) in which the fuel injector is configured to inject diesel fuel into the trapped residuals and in which the diesel fuel is mixed with air supplied from the crossover passage and ignited in the expansion cylinder by compression ignition.

Related aspects of at least one embodiment of the invention provide an engine (e.g., as described above) that includes a crossover expansion valve that controls fluid communication between the crossover passage and the expansion cylinder, the crossover expansion valve being configured to open to supply combustion air to the expansion cylinder and to subsequently close before fuel is injected by the fuel injector.

In another aspect of at least one embodiment of the invention, an expander system is provided that includes a source of compressed air, an expansion piston slidably received within an expansion cylinder and operatively connected to an expander crankshaft such that the expansion piston reciprocates through an expansion stroke and an exhaust stroke during a single rotation of the expander crankshaft, an intake valve that controls fluid communication between the source of compressed air and the expansion cylinder, an exhaust valve configured to be in a closed position during a later portion of the exhaust stroke to trap residual combustion gases in the expansion cylinder, and a fuel injector configured to inject fuel into the expansion cylinder during said later portion of the exhaust stroke.

Related aspects of at least one embodiment of the invention provide an expander system (e.g., as described above) in which the source of compressed air is at least one of an air storage tank and a compressor having a compressor crankshaft that is distinct from the expander crankshaft.

Related aspects of at least one embodiment of the invention provide an expander system (e.g., as described above) in which the intake valve is configured to open to supply combustion air to the expansion cylinder and to subsequently close before fuel is injected by the fuel injector.

The present invention further provides devices, systems, and methods as claimed.

BRIEF DESCRIPTION OF THE DRAWINGS

The invention will be more fully understood from the following detailed description taken in conjunction with the accompanying drawings, in which.

DETAILED DESCRIPTION

Figure 1:
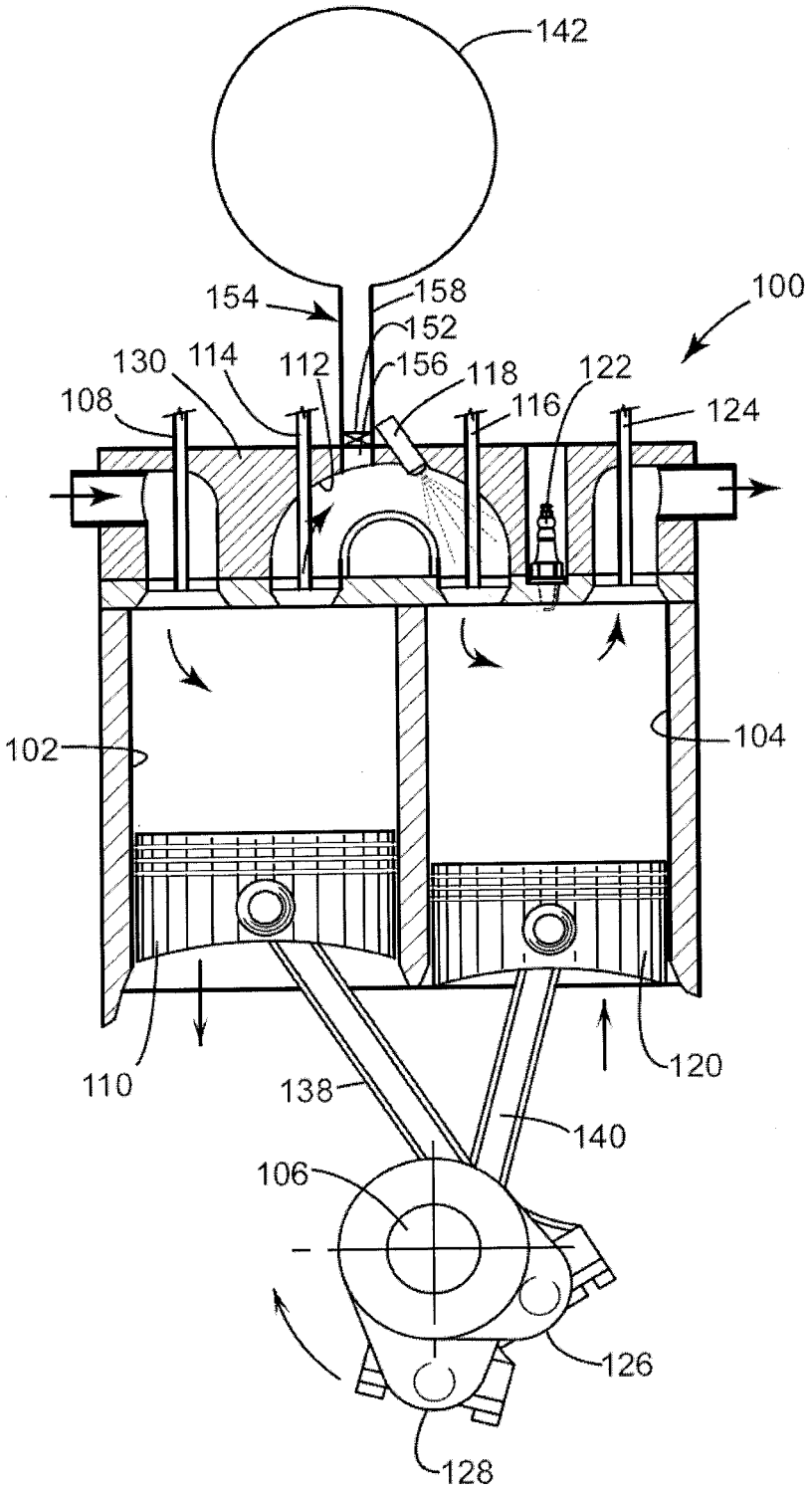
FIG. 1 (PRIOR ART)
FIG. 1 is a schematic cross-sectional view of a prior art air hybrid split-cycle engine.

In some embodiments, split-cycle engines are disclosed that are capable of operating in a normal firing mode in which a firing stroke is performed in the expansion cylinder only on every other rotation of the crankshaft. Fuel can be injected directly into the expansion cylinder during the non-firing rotation of the crank shaft over a period of time greater than what is possible with traditional split-cycle engines. A number of other advantages are associated with such engines. In some embodiments, two expansion cylinders can be provided such that a firing stroke is performed on every rotation of the crankshaft, even though each individual expansion cylinder only performs a firing stroke on every other rotation of the crankshaft. Air hybridized and/or Millerized variations of these engines, as well as various cylinder arrangements, are also disclosed herein.

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Although certain methods and devices are disclosed herein in the context of a split-cycle engine and/or an air hybrid engine, a person having ordinary skill in the art will appreciate that the methods and devices disclosed herein can be used in any of a variety of contexts, including, without limitation, non-hybrid engines, two-stroke and four-stroke engines, conventional engines, gasoline engines, natural gas engines, diesel engines, etc. The methods and devices disclosed herein are suitable for use in mobile applications (e.g., cars, trucks, boats, aircraft, etc.) as well as stationary applications (e.g., stationary generators).

Four-Stroke Expansion Cylinder with Vacuum and Recovery Strokes

FIGS. 2A-2L illustrate one exemplary embodiment of a split-cycle engine 200. Except as indicated below, the structure of the engine 200 is substantially the same as that of the engine 100 described above, and therefore a detailed explanation of said structure is omitted here for the sake of brevity.

The engine 200 is operable in a normal firing mode in which two rotations of the engine 200 are required to complete one cycle. The compression cylinder 202 can be described as operating in a four-stroke mode in which the expansion and exhaust strokes are replaced with standby intake and standby compression strokes. The expansion cylinder 204 can be described as operating in a four-stroke mode in which the intake and compression strokes are replaced with standby expansion (or "vacuum") and standby exhaust (or "recovery") strokes. In this normal firing mode, a firing stroke is performed in the expansion cylinder 204 only on every other rotation of the crankshaft. Fuel can be injected directly into the expansion cylinder 204 during the non-firing rotation of the crankshaft over a period of time greater than what is possible with traditional split-cycle engines.

The engine 200 includes at least one direct injection fuel injector 218 configured to inject fuel directly into the expansion cylinder 204. In other words, the outlet of the fuel injector 218 is disposed within the expansion cylinder 204 such that injected fuel flows into the expansion cylinder 204 without first travelling through the crossover passage 212. In addition, the engine 200 include a valve train, valve actuation system, and/or engine controller that is/are configured to actuate the engine valves, inject fuel, and fire the spark plug 222 according to an operating cycle that differs from that of the engine 100 described above. An exemplary embodiment of this operating cycle is described in detail below with respect to FIGS. 2A-2L, which depict sequential snapshots of engine operation over two rotations of the crankshaft.

In the illustrated embodiment, the expansion piston 220 leads the compression piston 210 (e.g., by approximately 10 to 30 degrees CA) throughout the engine cycle, such that each stroke of the expansion piston 220 begins slightly before the counterpart stroke of the compression piston 210. For convenience of description, strokes of the compression piston 210 are sometimes referred to herein as occurring simultaneously with counterpart strokes of the expansion piston 220. It will be appreciated, however, that the expansion piston strokes begin and end slightly before the compression piston strokes begin and end. By the same token, two consecutive strokes of the compression piston 210 and the two counterpart strokes of the expansion piston 220 are sometimes referred to herein as occurring during a single rotation of the crankshaft. It will be appreciated, however, that a portion of one stroke extends into another rotation of the crankshaft, due to the offset timing of the compression and expansion pistons 210, 220. With this in mind, the engine state shown in FIG. 2A can be described as the start of a first rotation of the crankshaft and the end of a second rotation of the crankshaft. In a normal firing mode of operation, the engine 200 continuously alternates between the first rotation and the second rotation.

Figure 2A:
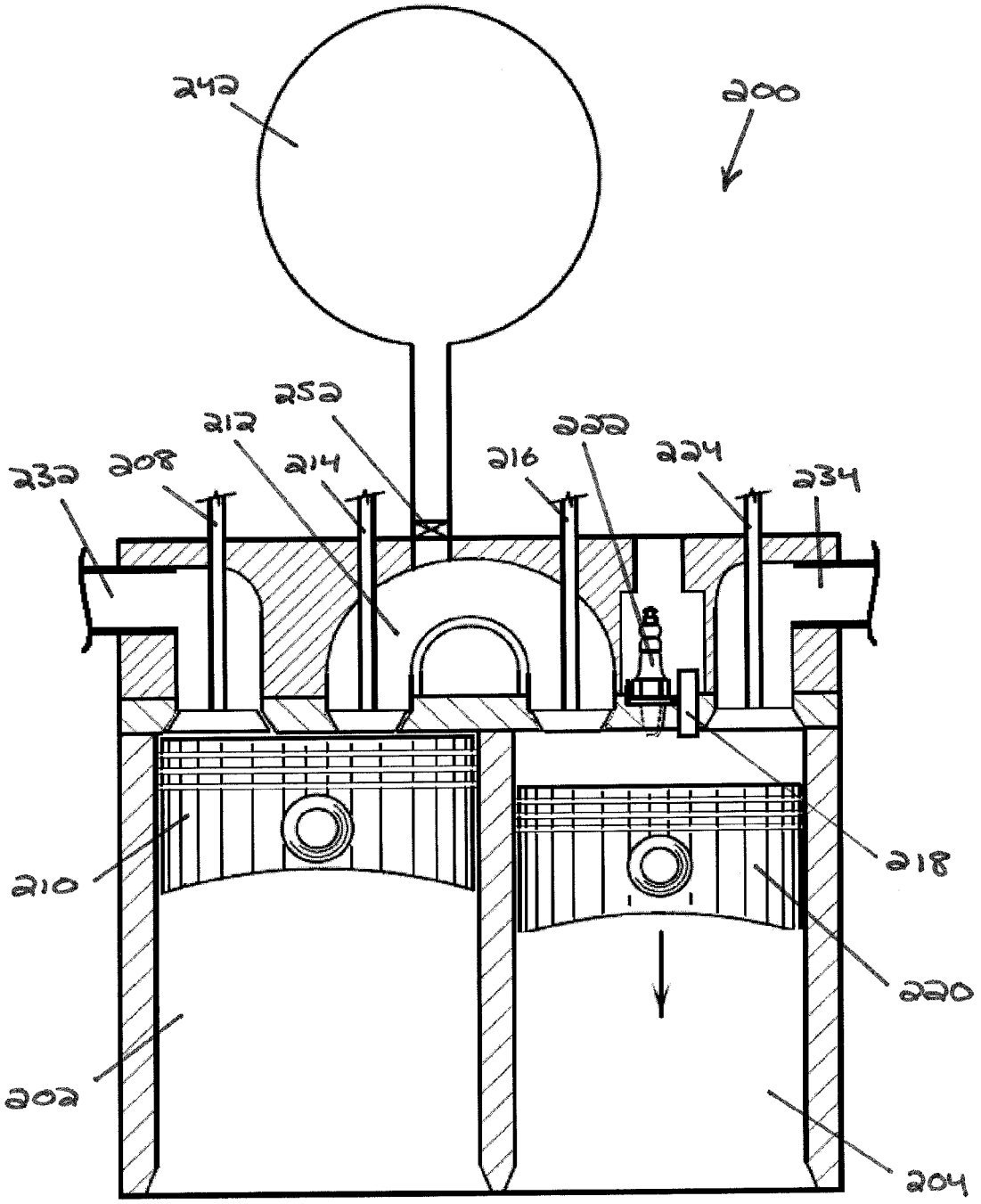
FIGS. 2A-2L are sequential, schematic illustrations of the operation of an exemplary embodiment of a split-cycle engine over two rotations of a crankshaft.

In FIG. 2A, the compression piston 210 is shown at its TDC position, at the end of a standby compression stroke and the beginning of a primary intake stroke. The expansion piston 220 is shown descending in a standby expansion stroke.

Figure 2B:
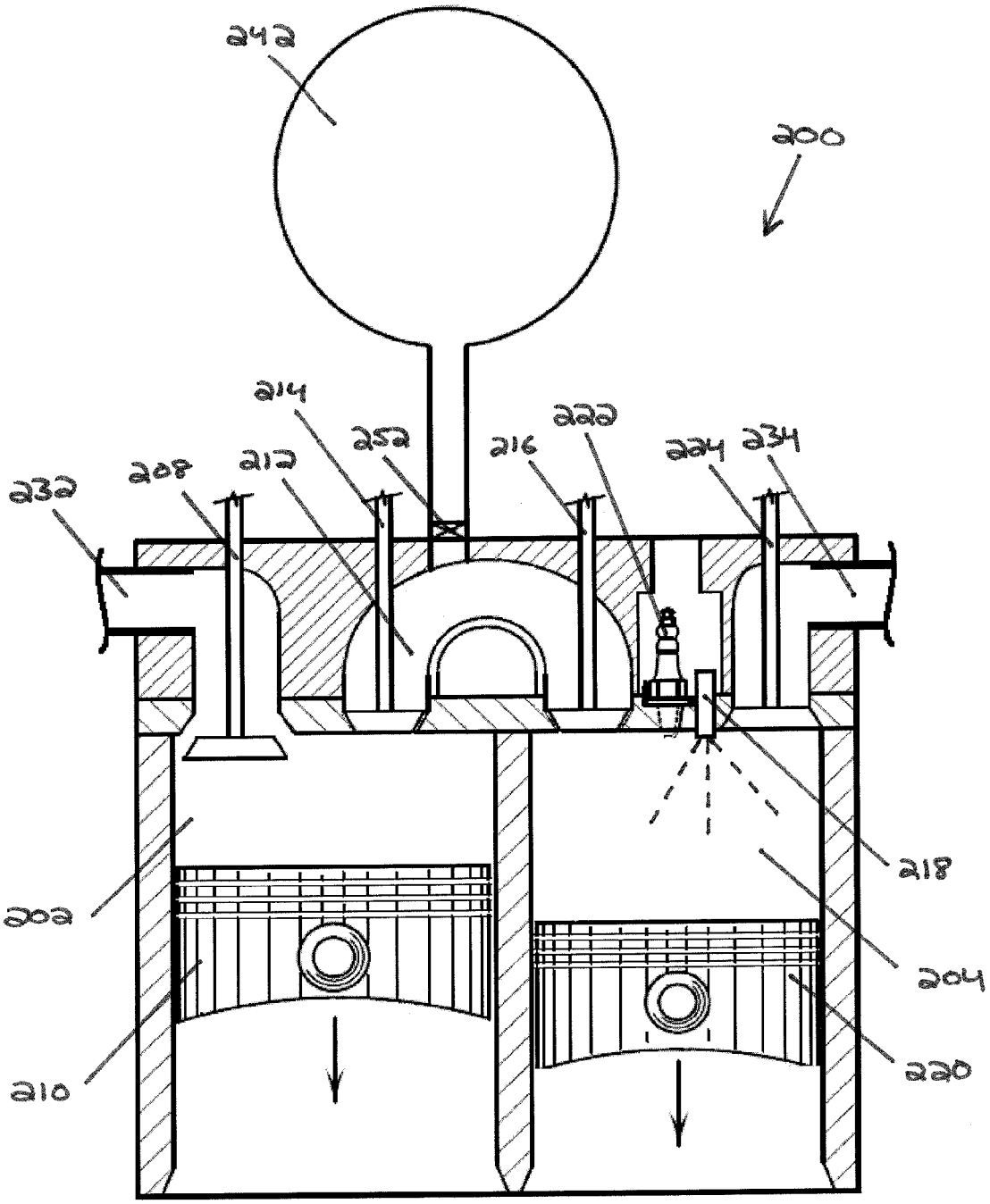

In FIG. 2B, the compression piston 210 descends within the compression cylinder 202 in a primary intake stroke. The intake valve 208 is open during the primary intake stroke such that air is drawn through the intake port 232 and into the compression cylinder 202. The crossover compression valve 214 can be closed to prevent any air that may be disposed in the crossover passage 212 from flowing back into the compression cylinder 202. The expansion piston 220 continues to descend within the expansion cylinder 204 in the standby expansion stroke. The crossover expansion valve 216 and the exhaust valve 224 are both closed during the standby expansion stroke, effectively sealing the expansion cylinder 204 such that the expansion piston 220 pulls a vacuum as it descends. No firing occurs during the standby expansion stroke and fuel can be injected directly into the expansion cylinder 204 at any time during the standby expansion stroke.

Figure 2C:
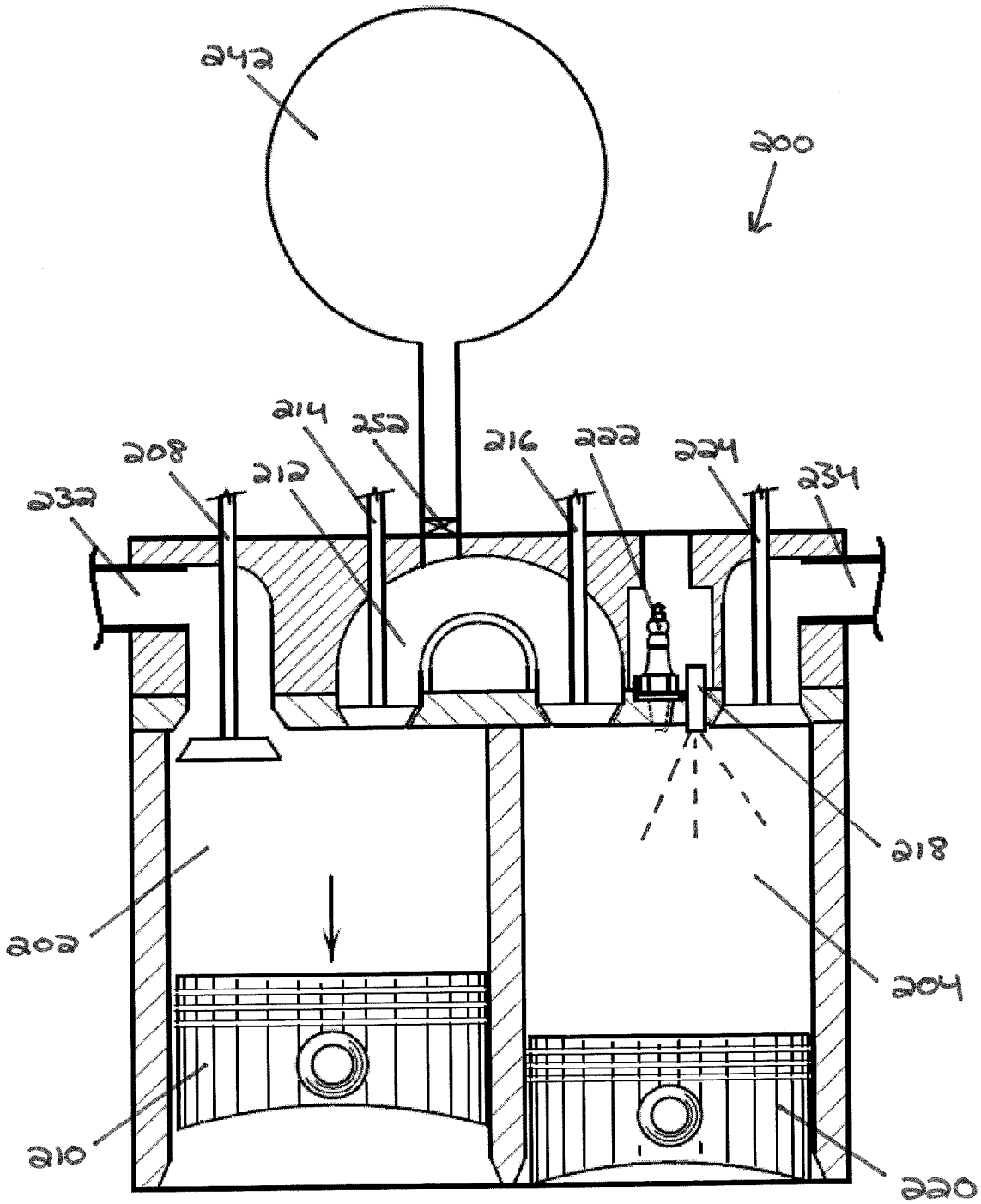

In FIG. 2C, the compression piston 210 continues its primary intake stroke, drawing in air from the intake port 232 as it descends in the compression cylinder 202. The expansion piston 220 reaches its BDC position, thereby ending the standby expansion stroke and beginning the standby exhaust stroke.

Figure 2D:
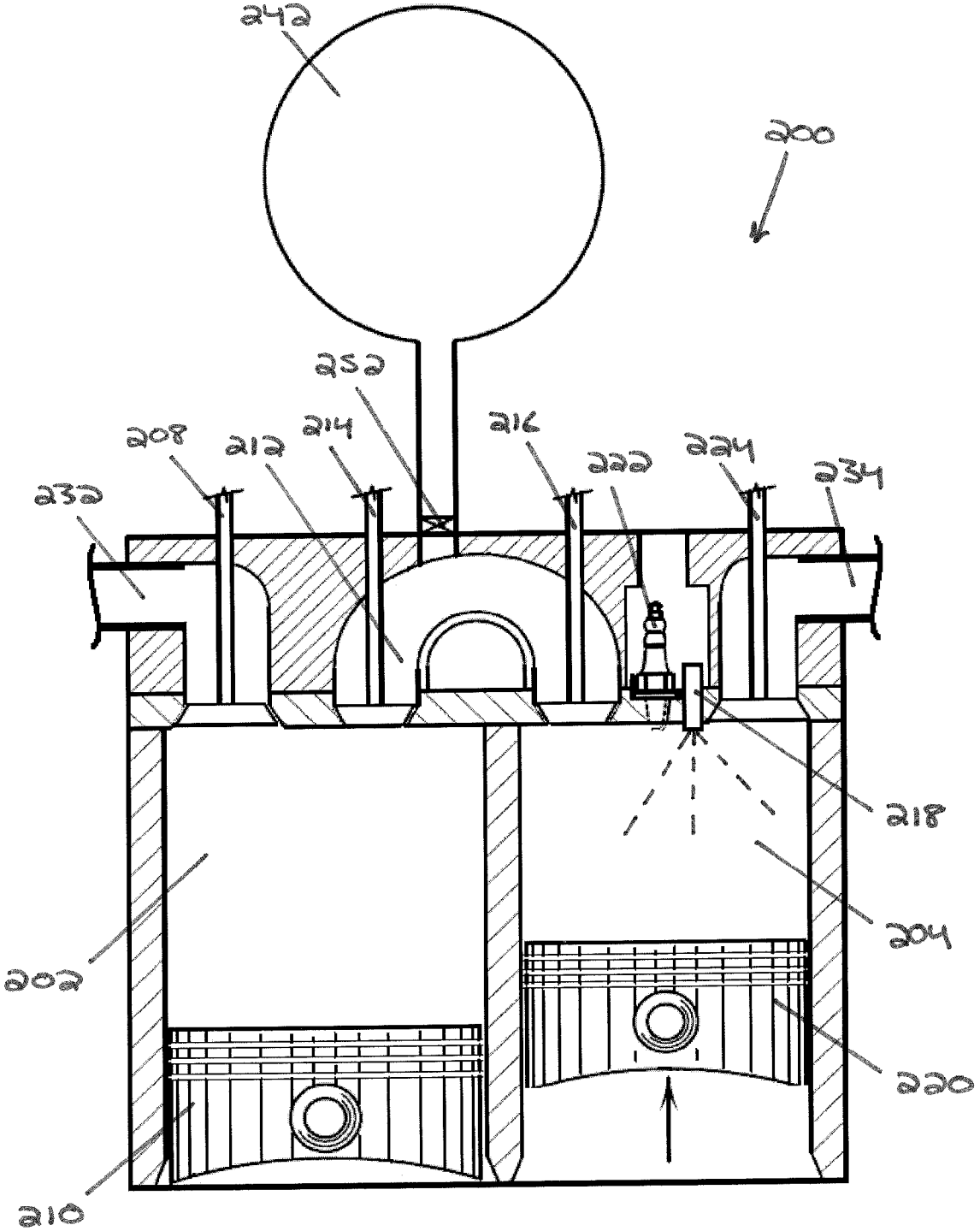

In FIG. 2D, the compression piston 210 reaches its BDC position, thereby ending the primary intake stroke and beginning a primary compression stroke. The expansion piston 220 ascends during the standby exhaust stroke while the crossover expansion valve 216 and the exhaust valve 224 remain closed. The vacuum created in the expansion cylinder 204 during the previous standby expansion stroke pulls the ascending expansion piston 220 towards its TDC position, recovering much of the work exerted in creating the vacuum. Fuel can be injected directly into the expansion cylinder 204 at any time during the standby exhaust stroke.

Figure 2E:
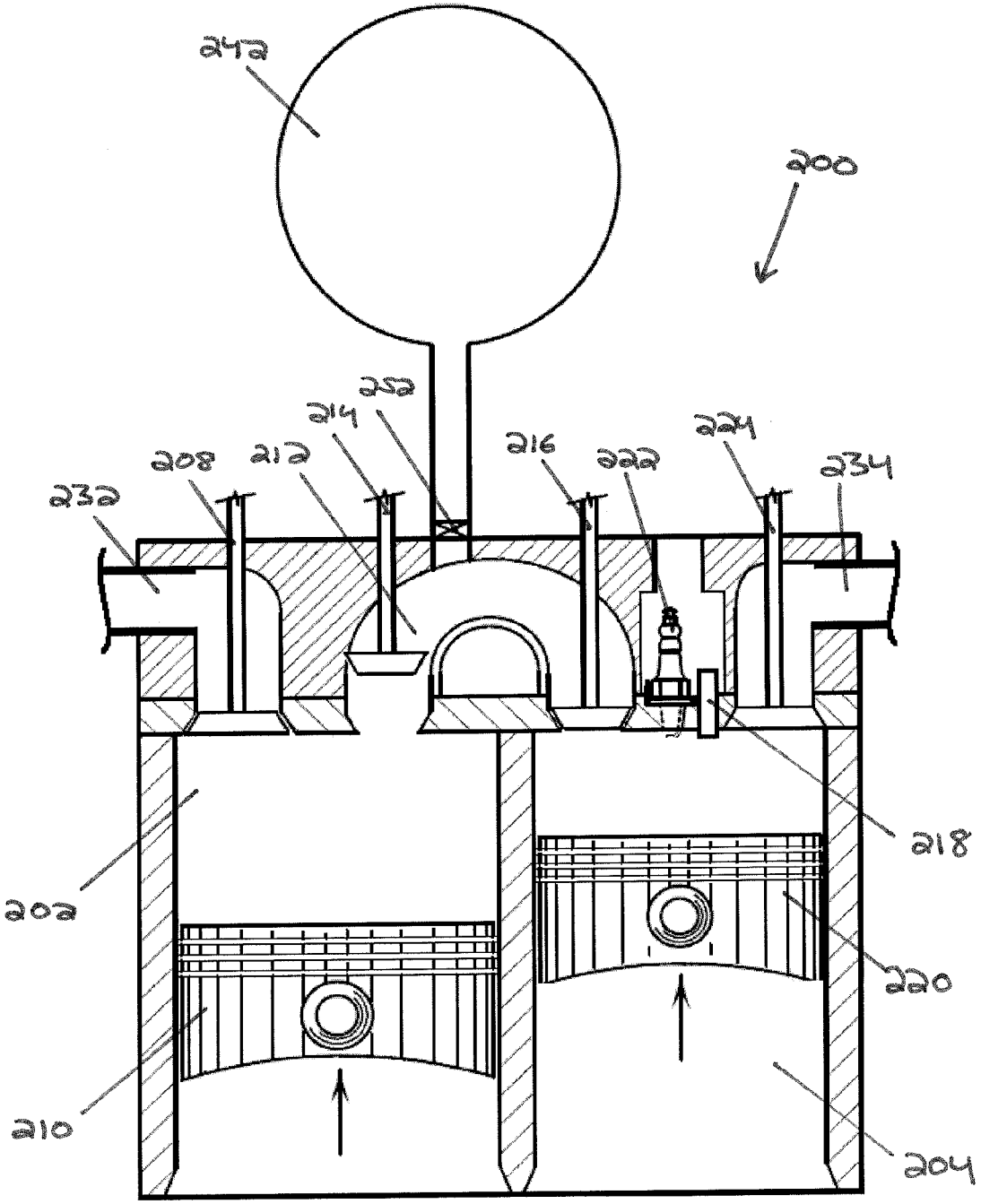

In FIG. 2E, the compression piston 210 continues its primary compression stroke, compressing air contained in the compression cylinder 202. The crossover compression valve 214 can be opened during the primary compression stroke to allow air to be compressed into the crossover passage 212. The expansion piston 220 continues its standby exhaust stroke, recovering the vacuum created during the previous standby expansion stroke.

Figure 2F:
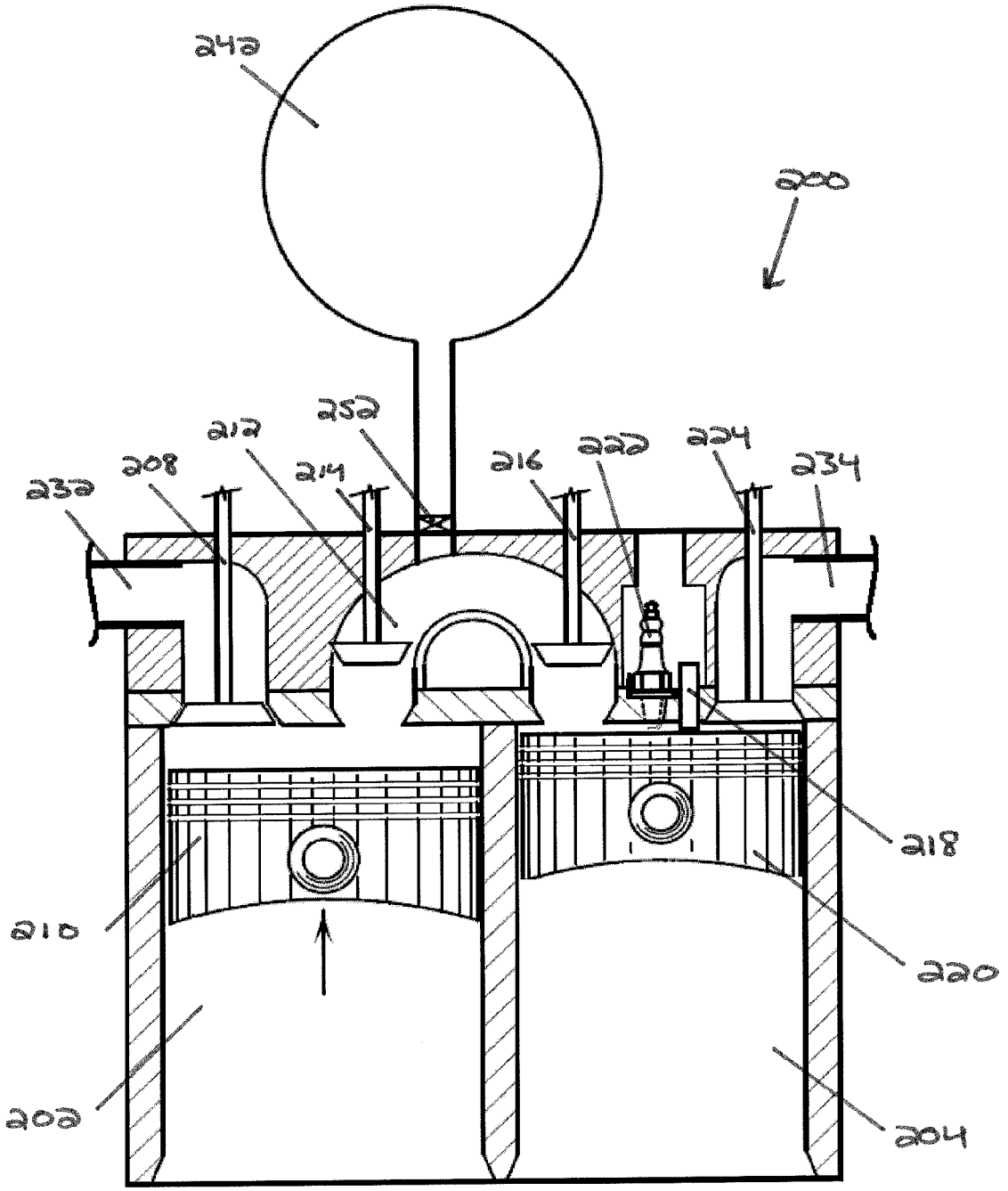

In FIG. 2F, the compression piston 210 continues to ascend, compressing air into the crossover passage 212 through the open crossover compression valve 214. The expansion piston 220 reaches its TDC position, thereby ending the standby exhaust stroke and beginning a primary expansion stroke. The crossover expansion valve 216 is opened momentarily as the expansion piston 220 begins to descend in the primary expansion stroke, resulting in the push-pull transfer gas transfer effect described above. As the expansion piston 220 descends (i.e., after TDC of the expansion piston 220), the spark plug 222 is fired to ignite the air-fuel mixture in the expansion cylinder 204 and drive the expansion piston 220 down in the primary expansion stroke to power the crankshaft and the load coupled to the engine 200. The crossover expansion valve 216 is closed before or after the spark plug 222 is fired.

Figure 2G:
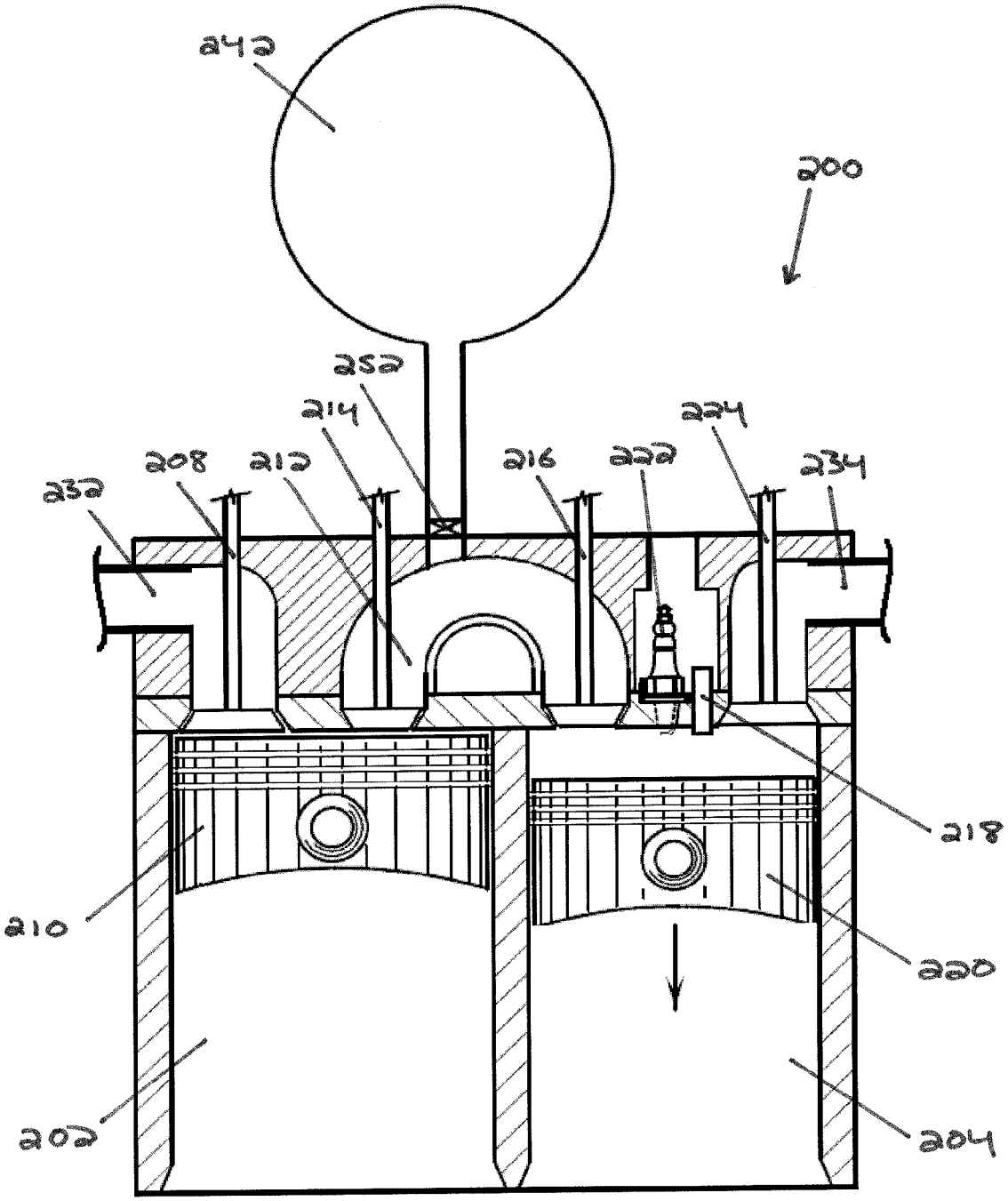

In FIG. 2G, the compression piston 210 reaches its TDC position, thereby ending the primary compression stroke and beginning a standby intake stroke. The expansion piston 220 continues to descend in the primary expansion stroke. The engine state shown in FIG. 2G can be described as the completion of the first rotation of the crankshaft and the start of the second rotation of the crankshaft.

Figure 2H:
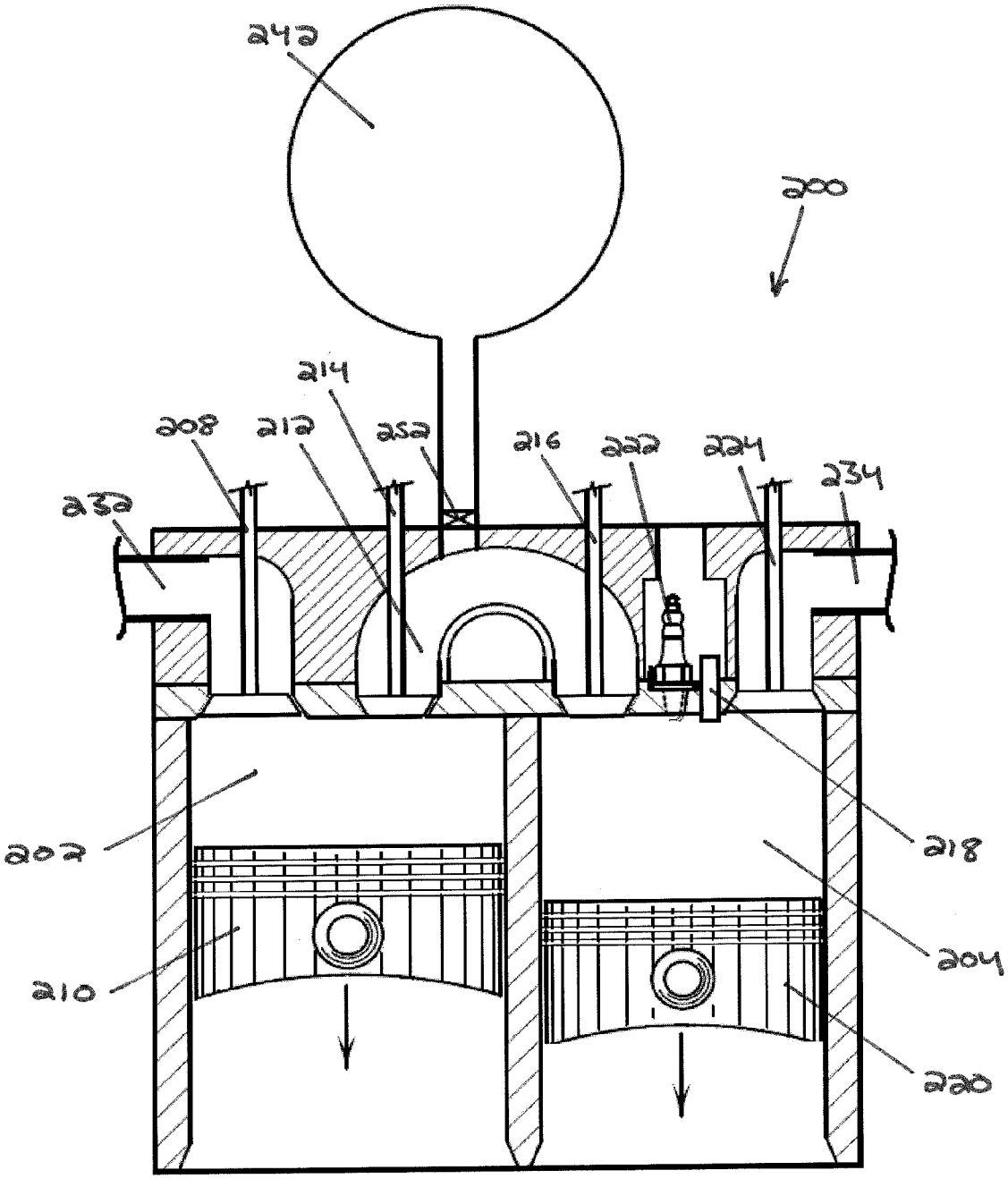

In FIG. 2H, the compression piston 210 descends in the standby intake stroke. The compression cylinder 202 can be idled during the standby intake stroke, for example by keeping the intake valve 208 and the crossover compression valve 214 closed as shown. In other embodiments, the compression cylinder 202 can be idled during the standby intake stroke by keeping the intake valve 208 open while keeping the crossover compression valve 214 closed. The expansion piston 220 continues to descend in the primary expansion stroke.

Figure 2I:
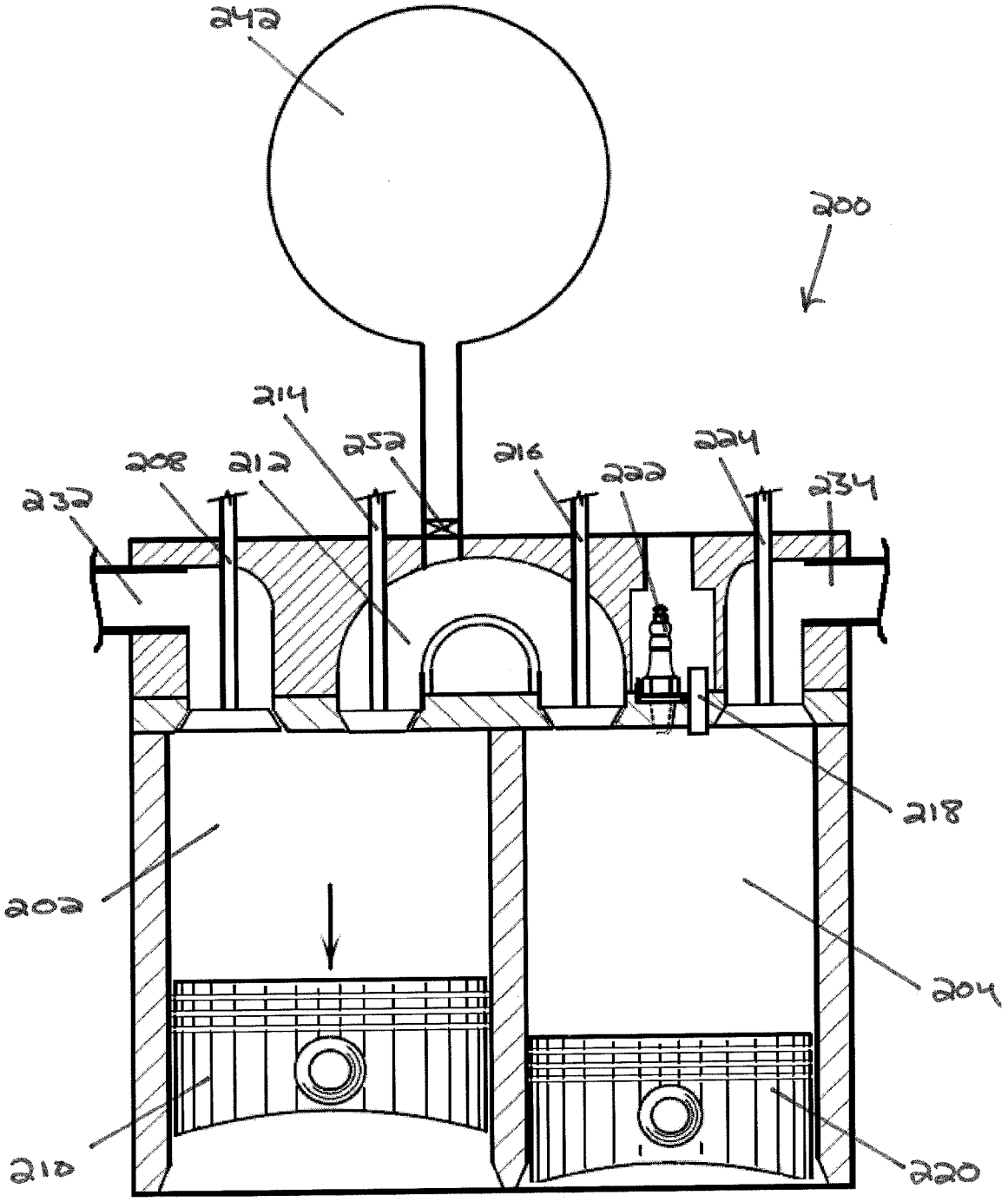

In FIG. 2I, the compression piston 210 continues to descend in the standby intake stroke. The expansion piston 220 reaches its BDC position, thereby ending the primary expansion stroke and beginning the primary exhaust stroke.

Figure 2J:
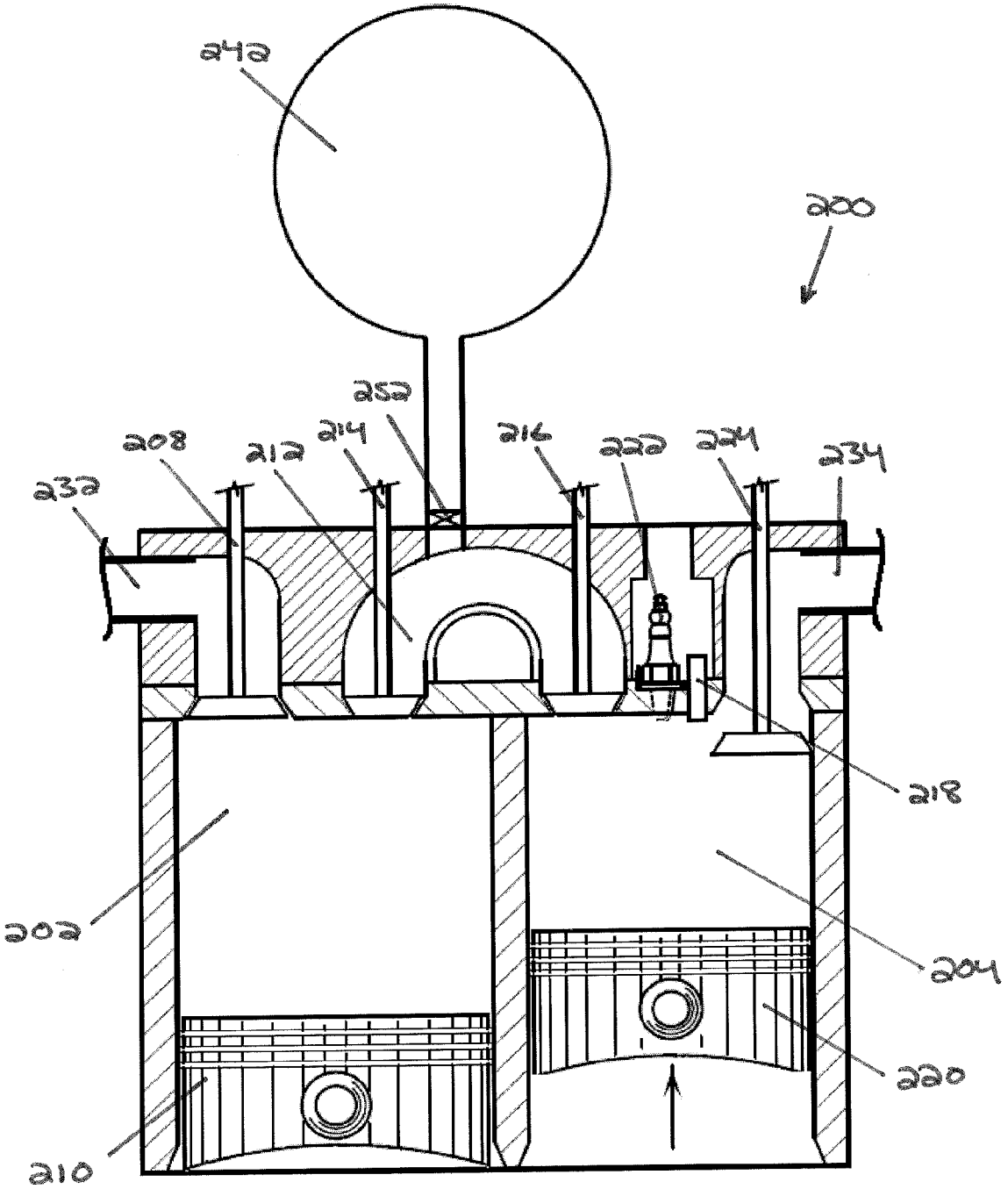

In FIG. 2J, the compression piston 210 reaches its BDC position, ending the standby intake stroke and beginning the standby compression stroke. The compression cylinder 202 can be idled during the standby compression stroke, for example by keeping the intake valve 208 and the crossover compression valve 214 closed as shown. In other embodiments, the compression cylinder 202 can be idled during the standby compression stroke by keeping the intake valve 208 open while keeping the crossover compression valve 214 closed. When the compression cylinder 202 is idled by closing the intake valve 208 and crossover compression valve 214 during the standby intake and standby compression strokes, the compression piston 210 pulls a vacuum on the standby intake stroke and then recovers the vacuum during the standby compression stroke, preventing unnecessary compression work and reducing parasitic losses. When the compression cylinder 202 is idled by opening the intake valve 208 during the standby intake and standby compression strokes, air is drawn into the cylinder during the standby intake stroke and then expelled back through the intake port 232 during the standby compression stroke, preventing unnecessary compression work and reducing parasitic losses. The exhaust valve 224 is open as the expansion piston 220 ascends in the primary exhaust stroke, forcing combustion gases out through the exhaust valve 224 and exhaust port 234.

Figure 2K:
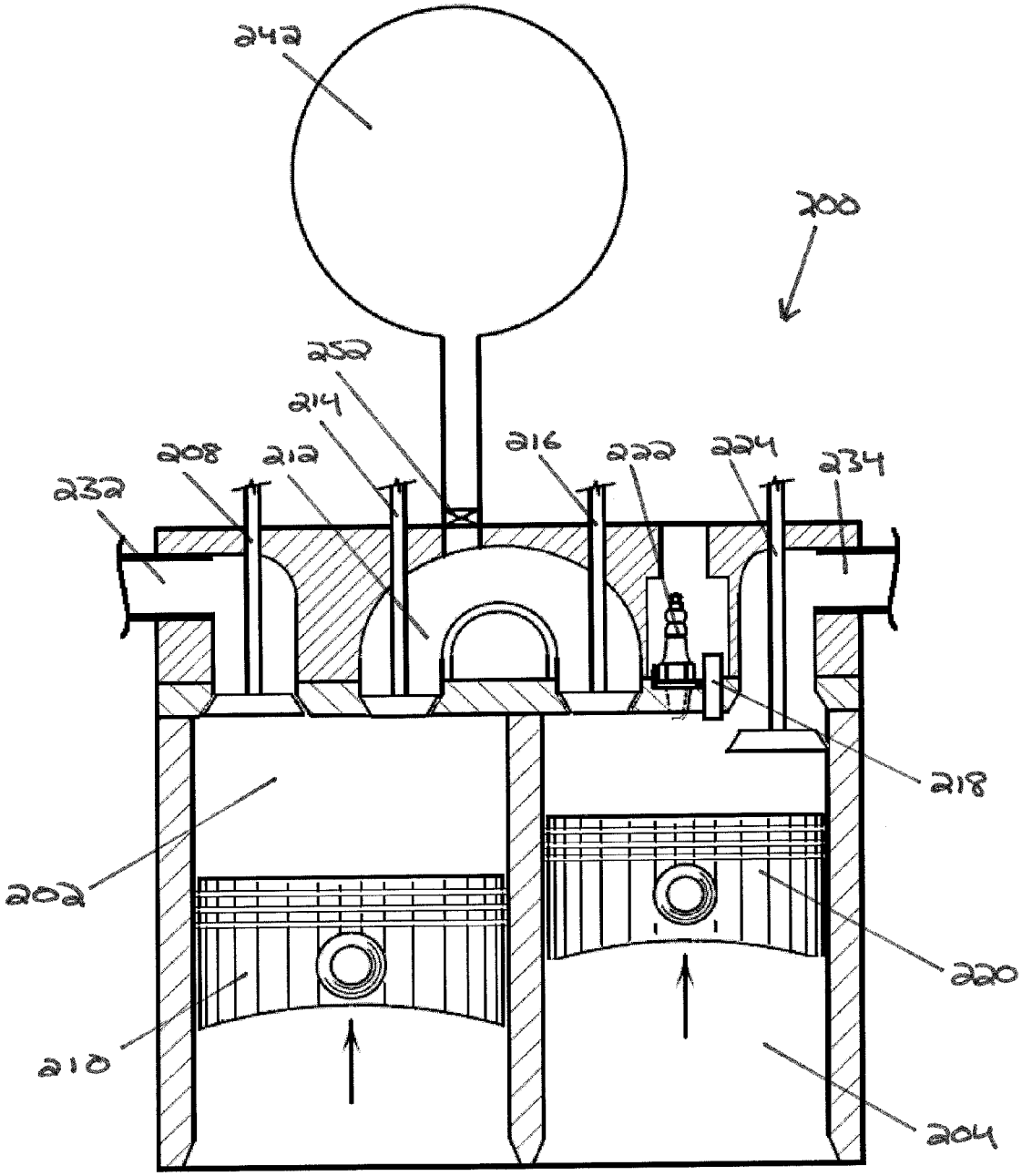

In FIG. 2K, the compression piston 210 continues to ascend in the standby compression stroke. The expansion piston 220 continues to ascend in the primary exhaust stroke.

Figure 2L:
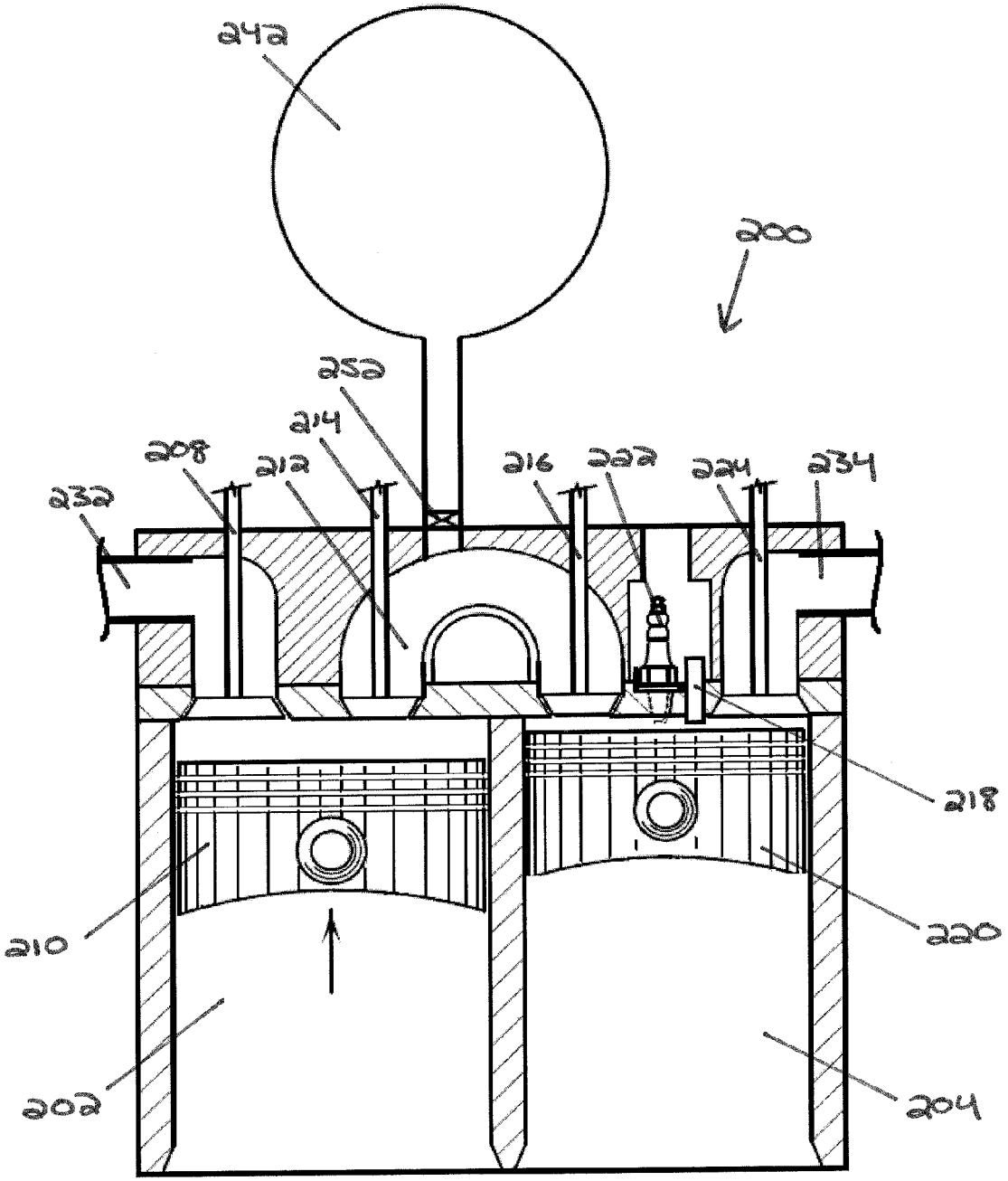

In FIG. 2L, the compression piston 210 continues to ascend in the standby compression stroke. The exhaust valve 224 is closed and the expansion piston 220 reaches its TDC position, ending the primary exhaust stroke and beginning a new standby expansion stroke. Operation of the engine 200 then returns to the state shown in FIG. 2A and the cycle repeats. Thus, as noted above, the state shown in FIG. 2A can be described as the completion of the second rotation of the crankshaft and the start of a subsequent first rotation of the crankshaft.

In the illustrated embodiment, the exhaust valve 224 is closed during the standby expansion and standby exhaust strokes of FIGS. 2A-2F to create a vacuum condition within the expansion cylinder 204. In other words, when the expansion piston 220 reaches TDC at the conclusion of the primary exhaust stroke (FIG. 2L), the pressure in the expansion cylinder 204 is about 1 atm (or the pressure of the exhaust port 234 and any exhaust system coupled thereto). The pressure then drops to below 1 atm as the expansion piston 220 descends in the standby expansion stroke to a minimum pressure when the expansion piston 220 is at BDC (FIG. 2C). As the expansion piston 220 ascends in the subsequent standby exhaust stroke, the pressure in the expansion cylinder 204 increases back to about 1 atm when the expansion piston 220 reaches TDC (FIG. 2F). In some embodiments, the exhaust valve 224 can be opened during at least a portion of the standby expansion stroke and then closed before or during the standby exhaust stroke. This can allow a quantity of air to be drawn into the expansion cylinder 220 from the exhaust port 234, which is subsequently compressed during the standby exhaust stroke such that the pressure in the expansion cylinder 204 is greater than 1 atm at the conclusion of the standby exhaust stroke. While some pumping losses result from compressing an air charge in the expansion cylinder 204, it can be desirable for the pressure in the expansion cylinder 204 to be increased at the start of the next primary expansion stroke. In particular, increasing the pressure in the expansion cylinder 204 reduces the pressure differential between the expansion cylinder 204 and the crossover passage 212 when the crossover expansion valve 216 is opened. This lower differential results in fewer losses as air is transferred from the crossover passage 212 to the expansion cylinder 204, and requires less energy to open the crossover expansion valve 216. In some embodiments, the expansion cylinder pressure at the start of the primary expansion stroke can be at least about 2 atm, at least about 5 atm, and/or at least about 10 atm.

The compression cylinder 202 of the engine 200 can be downsized relative to the expansion cylinder 204 to produce a Miller effect. Further details on the Miller effect in the context of split-cycle engines is available in U.S. Provisional Application No. 61/721,545, filed on Nov. 2, 2012, entitled "SPLIT-CYCLE DIRECT INJECTION ENGINE WITH ADVANCED MILLER CYCLE," the entire contents of which are hereby incorporated by reference herein. By reducing the volume of the compression cylinder 202 (e.g., to less than half the volume of the expansion cylinder 204), the reduction in brake mean effective pressure (BMEP) of the engine 200 introduced by requiring two rotations of the crankshaft for each firing stroke can be minimized.

The engine 200 can provide a number of advantages as compared with conventional engines and the prior art split-cycle engine 100 described above. For example, direct injection of fuel into the expansion cylinder 204 can improve the BMEP and efficiency of the engine 200. In addition, direct injection can reduce the chances of premature combustion or knocking, as the fuel is exposed to high temperature and high pressure conditions for a shorter amount of time than in alternative injection schemes. The knock resistance of the engine 200 is further enhanced by the vacuum condition that exists as the fuel is injected, as the lack of air in the expansion cylinder 204 during injection inhibits combustion. The engine 200 can thus have a high volumetric compression ratio in the expansion cylinder 204 without there being a concern of over-compression and detonation.

Another advantage is that the standby expansion and standby exhaust strokes provide a window of up to 360 degrees CA to inject fuel into the expansion cylinder 204 (as compared with about 30 degrees CA in the prior art split-cycle engine 100). The availability of extra time to inject the fuel can allow the fuel to be injected at lower pressures, while at the same time reducing the chances of a lean condition when the engine 200 is operating at full load. The fuel can also be injected at times when the expansion piston 220 is relatively distant from its TDC position, providing more space to spray and mix the fuel. By providing more time and space to inject the fuel, low-cost conventional fuel injectors can be used with the engine 200. The lower injection pressures can also allow the engine 200 to be used with low-pressure fuel sources, such as uncompressed natural gas. Natural gas is typically supplied from a gas utility through a service line pressurized to less than 60 psi. After passing through a gas meter, this supply is usually regulated to a pressure of less than about 0.25 psi. It is difficult if not impossible to operate prior art split-cycle engines using such a low-pressure supply without providing a pump or compressor to boost the fuel supply pressure. In the engine 200, the added time for injecting fuel coupled with the vacuum in the expansion cylinder 204 can allow the engine 200, and in particular the fuel injector 218, to be fed directly by a low pressure supply of natural gas (e.g., a supply that is less than about 60 psi, about 20 psi, about 5 psi, about 1 psi, about 0.5 psi, and/or about 0.25 psi). This can be advantageous particularly for stationary applications such as generators.

A further advantage of the engine 200 is that the standby expansion and standby exhaust strokes provide a window during which the expansion cylinder 204 can cool. In prior art split-cycle engines operating in normal firing mode, every stroke of the expansion piston involves either a combustion event or an exhaust event, both of which maintain the temperature of the expansion cylinder at a high level. By incorporating intermediate standby expansion and standby exhaust strokes, the expansion cylinder 204 can be allowed to cool between each combustion event.

Four-Stroke Expansion Cylinder with Ambient Air Shot

FIGS. 3A-3L illustrate another exemplary embodiment of a split-cycle engine 300. Except as indicated below, the structure of the engine 300 is substantially the same as that of the engine 100 described above, and therefore a detailed explanation of said structure is omitted here for the sake of brevity.

The engine 300 is operable in a normal firing mode in which two rotations of the engine 300 are required to complete one cycle. The compression cylinder 302 can be described as operating in a four-stroke mode in which the expansion and exhaust strokes are replaced with standby intake and standby compression strokes. The expansion cylinder 304 can be described as operating in a four-stroke mode in which the intake and compression strokes are replaced with standby expansion and standby exhaust strokes. In this normal firing mode, a firing stroke is performed in the expansion cylinder 304 only on every other rotation of the crankshaft. Fuel can be injected directly into the expansion cylinder 304 during the non-firing rotation of the crankshaft over a period of time greater than what is possible with traditional split-cycle engines. In the engine 300, the exhaust valve 324 is selectively coupled to a source of intake air and opened during part of the non-firing rotation of the crankshaft to allow a cooling stroke to be performed in the expansion cylinder 304. Alternatively, a dedicated expansion-intake valve can be provided in the expansion cylinder 304 to supply the intake air.

The engine 300 includes at least one direct injection fuel injector 318 configured to inject fuel directly into the expansion cylinder 304. In other words, the outlet of the fuel injector 318 is disposed within the expansion cylinder 304 such that injected fuel flows into the expansion cylinder 304 without first travelling through the crossover passage 312. In addition, the engine 300 includes a valve train, valve actuation system, and/or engine controller that is/are configured to actuate the engine valves, inject fuel, and fire the spark plug 322 according to an operating cycle that differs from that of the engine 100 described above. An exemplary embodiment of this operating cycle is described in detail below with respect to FIGS. 3A-3L, which depict sequential snapshots of engine operation over two rotations of the crankshaft.

In the illustrated embodiment, the expansion piston 320 leads the compression piston 310 (e.g., by approximately 10-30 degrees CA) throughout the engine cycle, such that each stroke of the expansion piston 320 begins slightly before the counterpart stroke of the compression piston 310. For convenience of description, strokes of the compression piston 310 are sometimes referred to herein as occurring simultaneously with counterpart strokes of the expansion piston 320. It will be appreciated, however, that the expansion piston strokes begin and end slightly before the compression piston strokes begin and end. By the same token, two consecutive strokes of the compression piston 310 and the two counterpart strokes of the expansion piston 320 are sometimes referred to herein as occurring during a single rotation of the crankshaft. It will be appreciated, however, that a portion of one stroke extends into another rotation of the crankshaft, due to the offset timing of the compression and expansion pistons 310, 320. With this in mind, the engine state shown in FIG. 3A can be described as the start of a first rotation of the crankshaft and the end of a second rotation of the crankshaft. In a normal firing mode of operation, the engine 300 continuously alternates between the first rotation and the second rotation.

Figure 3A:
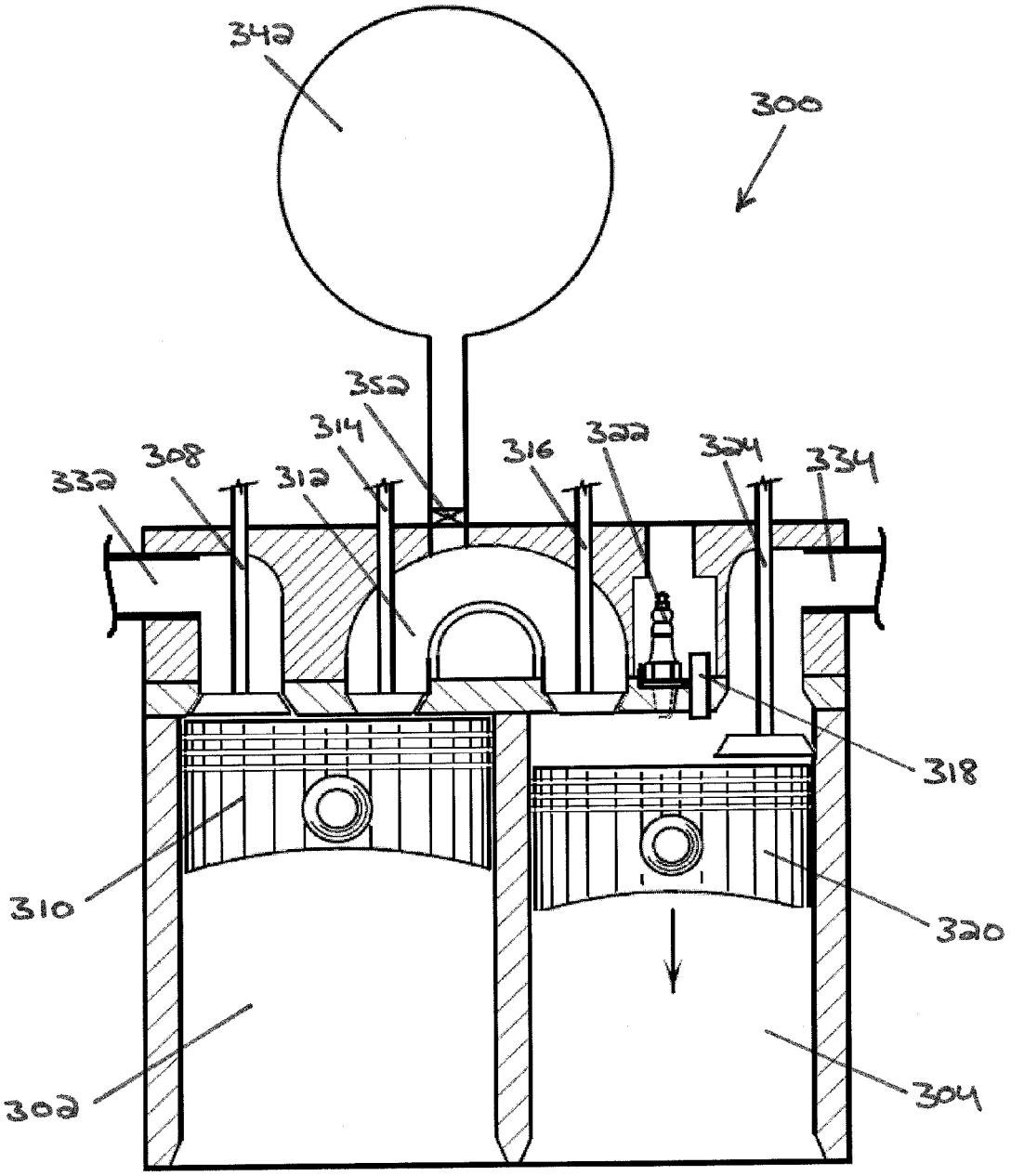
FIGS. 3A-3L are sequential, schematic illustrations of the operation of another exemplary embodiment of a split-cycle engine over two rotations of a crankshaft.

In FIG. 3A, the compression piston 310 is shown at its TDC position, at the end of a standby compression stroke and the beginning of a primary intake stroke. The expansion piston 320 is shown descending in a standby expansion stroke.

Figure 3B:
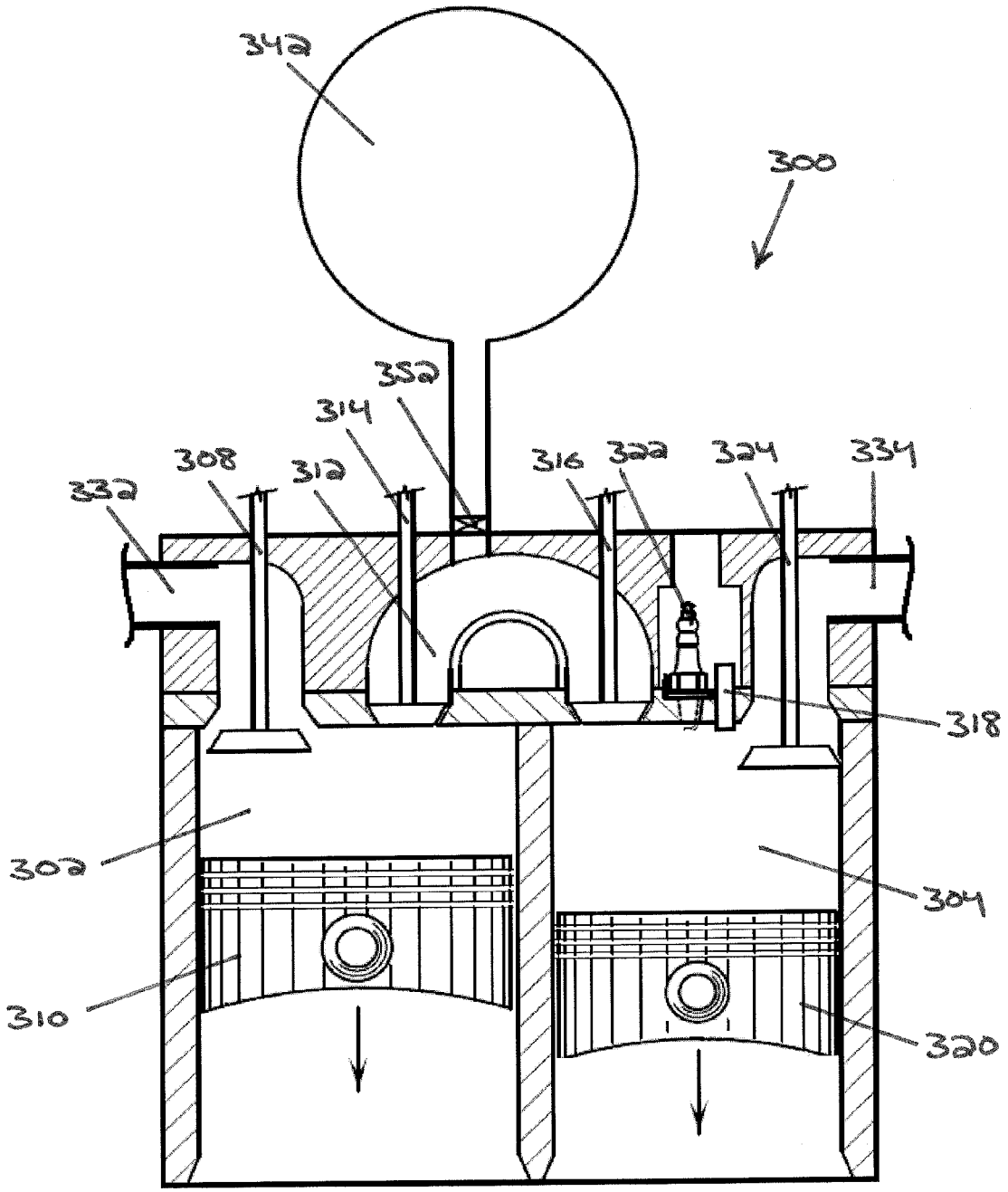
Figure 7:
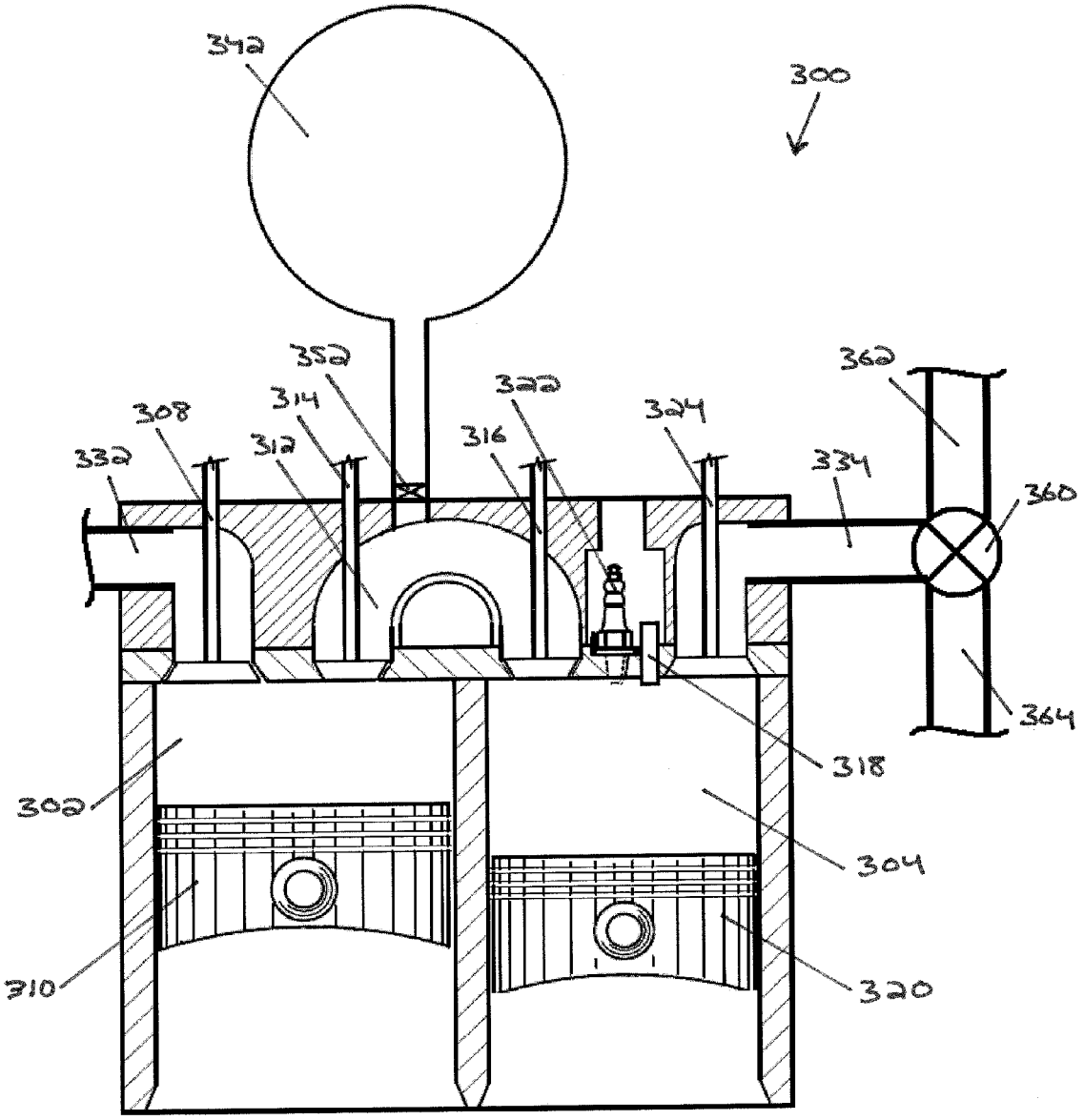
FIG. 7 is a schematic cross-sectional view of a split-cycle engine that includes an exhaust manifold diverter valve.

In FIG. 3B, the compression piston 310 descends within the compression cylinder 302 in a primary intake stroke. The intake valve 308 is open during the primary intake stroke such that air is drawn through the intake port 332 and into the compression cylinder 302. The crossover compression valve 314 can be closed to prevent any air that may be disposed in the crossover passage 312 from flowing back into the compression cylinder 302. The expansion piston 320 continues to descend within the expansion cylinder 304 in the standby expansion stroke. In contrast with the engine 200 described above, the engine 300 operates such that the exhaust valve 324 is open during the standby expansion stroke, allowing air to be pulled into the expansion cylinder 304 through the exhaust port 334 as the expansion piston 320 descends. In order to provide fresh intake air through the exhaust port 334, as shown in FIG. 7, a diverter valve 360 can be disposed downstream of the exhaust port 334. The diverter valve 360 is configured to selectively place the exhaust port 334 in fluid communication with an intake port 362 or with an exhaust system 364. In operation, the diverter valve 360 is controlled to couple the exhaust port 334 to the exhaust system 364 to allow residual combustion gases to be discharged (e.g., during the primary expansion and primary exhaust strokes). The diverter valve 360 is controlled to couple the exhaust port 334 to the intake port 362 to supply fresh intake air to the expansion cylinder 304 (e.g., during the standby expansion and standby exhaust strokes). Accordingly, when the exhaust valve 324 is opened during the standby expansion stroke and/or the standby exhaust stroke, cool, fresh air can be drawn into the expansion cylinder 304 through the intake port 362 to cool the expansion cylinder 304. In other embodiments, the expansion cylinder 304 can include an expansion-intake valve (not shown) configured to control fluid communication between the expansion cylinder 304 and an intake port (not shown), e.g., a supply of fresh ambient air. The expansion-intake valve can be opened during the standby expansion stroke and/or the standby exhaust stroke (e.g., at the timing described herein with respect to the exhaust valve 324) to supply air to the expansion cylinder 304. This can be done instead of or in addition to opening the exhaust valve 324 and diverter system. The crossover expansion valve 316 is closed during the standby expansion stroke. No firing or fuel injection occurs during the standby expansion stroke.

Figure 3C:
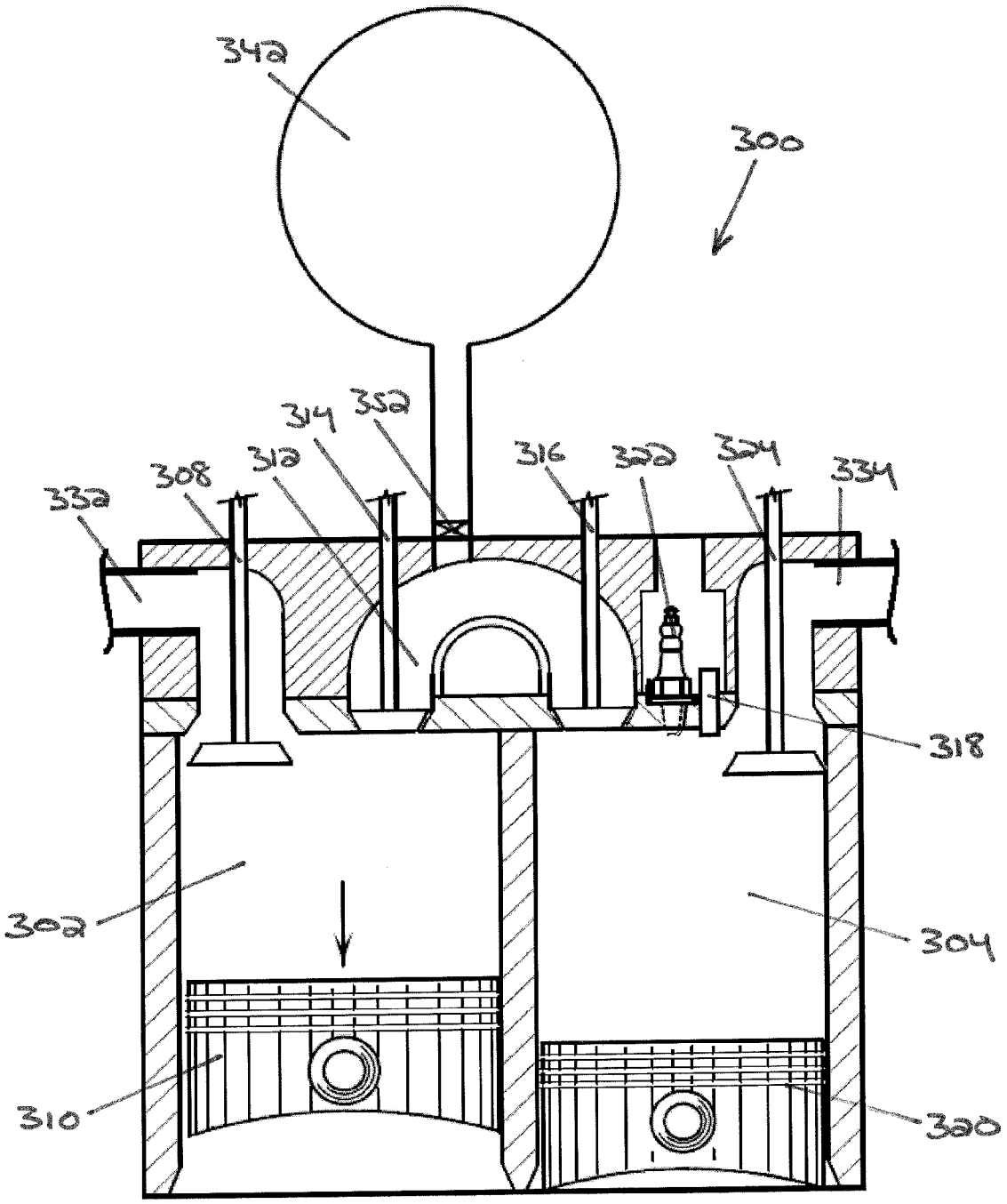

In FIG. 3C, the compression piston 310 continues its primary intake stroke, drawing in air from the intake port 332 as it descends in the compression cylinder 302. The expansion piston 320 reaches its BDC position, thereby ending the standby expansion stroke and beginning a standby exhaust stroke.

Figure 3D:
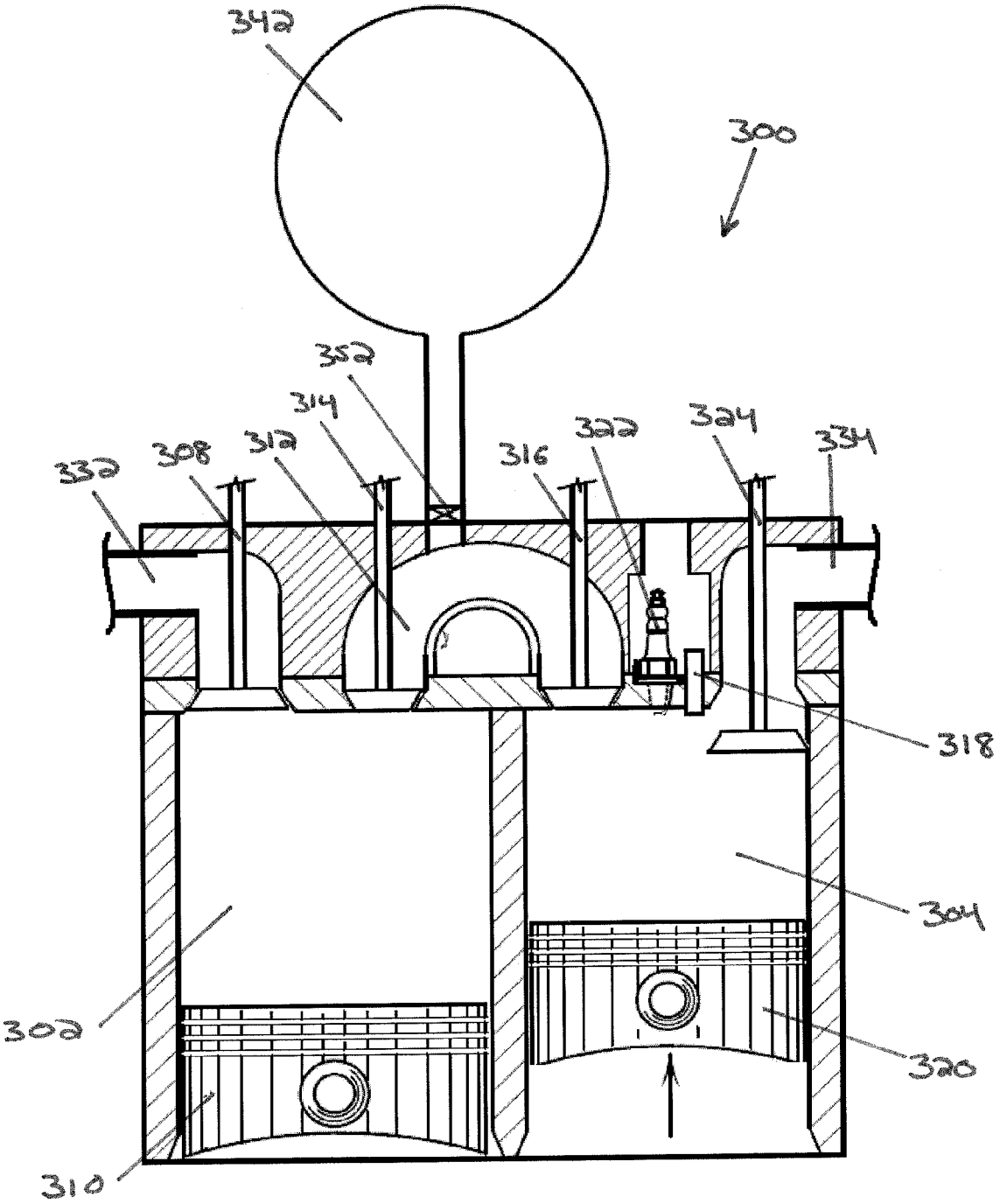

In FIG. 3D, the compression piston 310 reaches its BDC position, thereby ending the primary intake stroke and beginning a primary compression stroke. The expansion piston 320 ascends during the standby exhaust stroke while the crossover expansion valve 316 remains closed. The exhaust valve 324 remains open during a first portion of the standby exhaust stroke, allowing air pulled into the expansion cylinder 304 during the previous standby expansion stroke to be expelled through the exhaust port 334. By allowing the air to be expelled through the exhaust port 334, unnecessary compression work can be avoided and heat can be removed from the expansion cylinder 304.

Figure 3E:
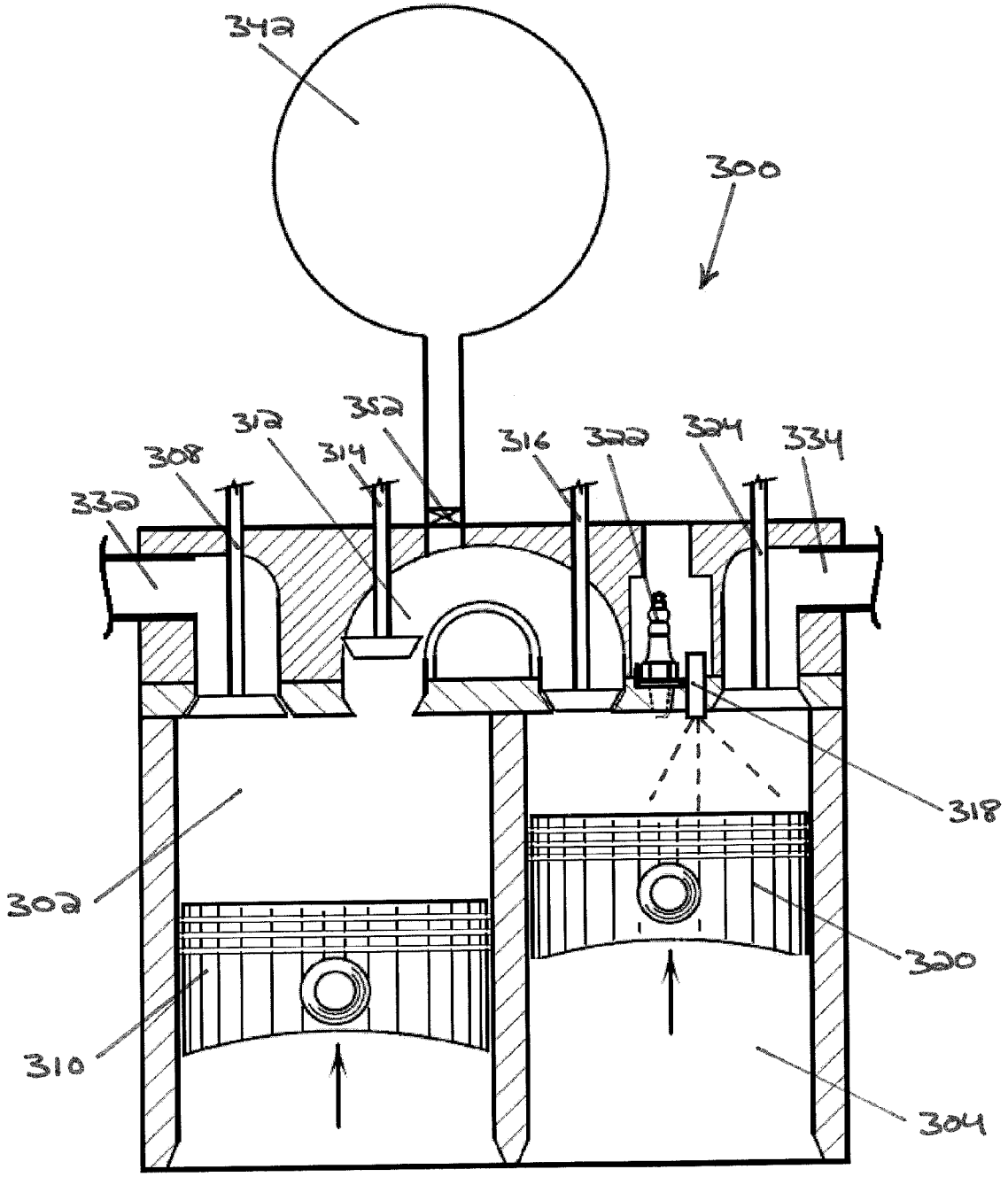

In FIG. 3E, the compression piston 310 continues its primary compression stroke, compressing air contained in the compression cylinder 302. The crossover compression valve 314 can be opened during the primary compression stroke to allow air to be compressed into the crossover passage 312. The expansion piston 320 continues its standby exhaust stroke. The exhaust valve 324 is closed during this second portion of the standby exhaust stroke. The crossover expansion valve 316 is also closed, effectively sealing the expansion cylinder 304 and allowing air disposed therein to be compressed by the ascending expansion piston 320. Fuel can be injected directly into the expansion cylinder 304 during this second portion of the standby exhaust stroke. As described in further detail below, the entire quantity of fuel required for the next combustion event can be injected at this time, creating a rich air-fuel mixture that inhibits or prevents premature detonation. Later, the rich mixture is returned to stoichiometric or near-stoichiometric levels, depending on the current load, by metering in the required amount of air through the crossover expansion valve 316. In other embodiments, a very small amount of fuel can be injected at this time, creating a lean mixture to inhibit or prevent premature detonation. In such embodiments, the remaining fuel required for combustion can be injected at or around the time the additional air is supplied through the crossover expansion valve 316.

Figure 3F:
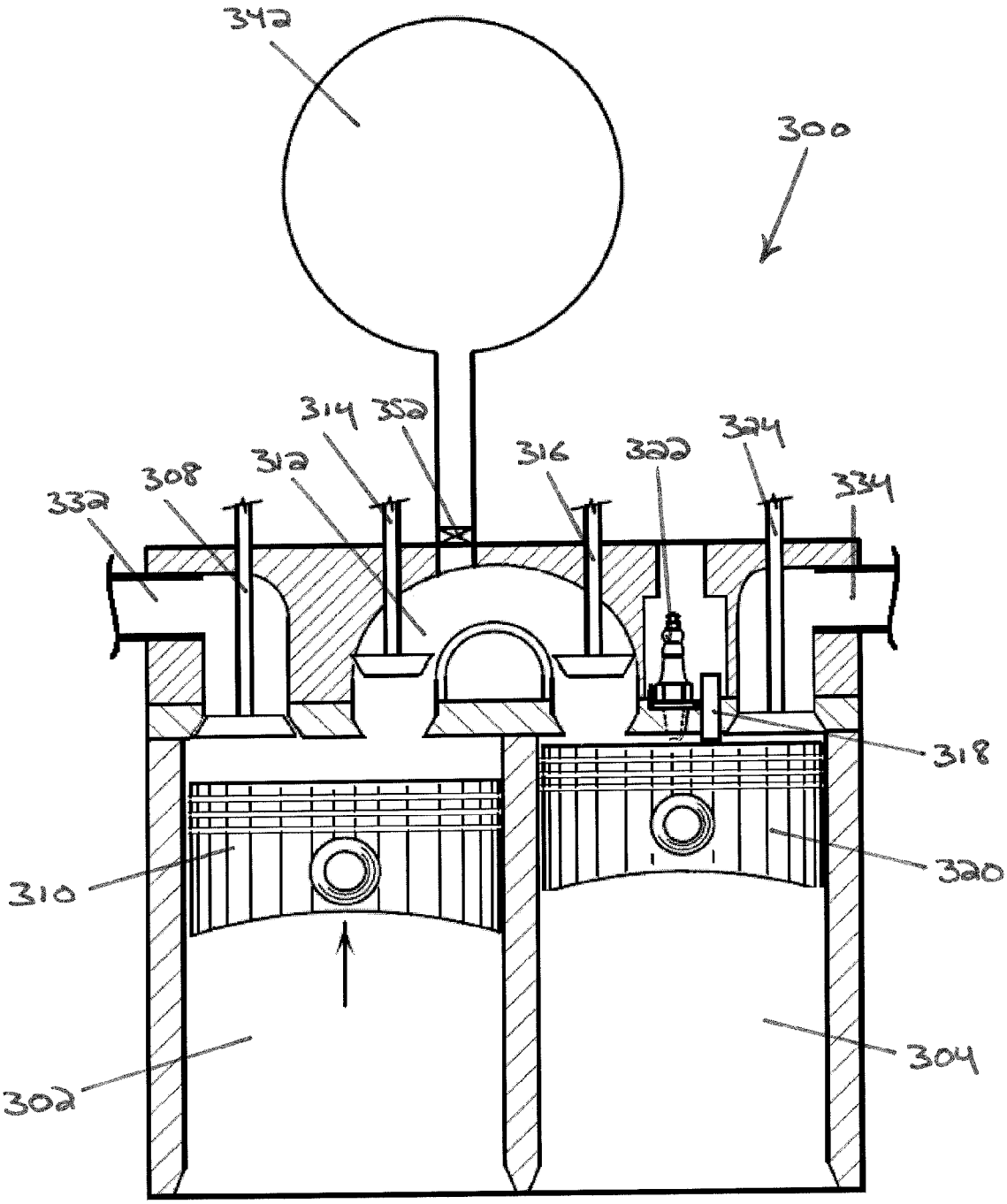

In FIG. 3F, the compression piston 310 continues to ascend, compressing air into the crossover passage 312 through the open crossover compression valve 314. The expansion piston 320 reaches its TDC position, thereby ending the standby exhaust stroke and beginning a primary expansion stroke. The crossover expansion valve 316 is opened momentarily as the expansion piston 320 begins to descend in the primary expansion stroke, resulting in the push-pull transfer gas transfer effect described above. As the expansion piston 320 descends (i.e., after TDC of the expansion piston 320), the spark plug 322 is fired to ignite the air-fuel mixture in the expansion cylinder 304 and drive the expansion piston 320 down in the primary expansion stroke to power the crankshaft and the load coupled to the engine 300. The crossover expansion valve 316 is closed before or after the spark plug 322 is fired.

Figure 3G:
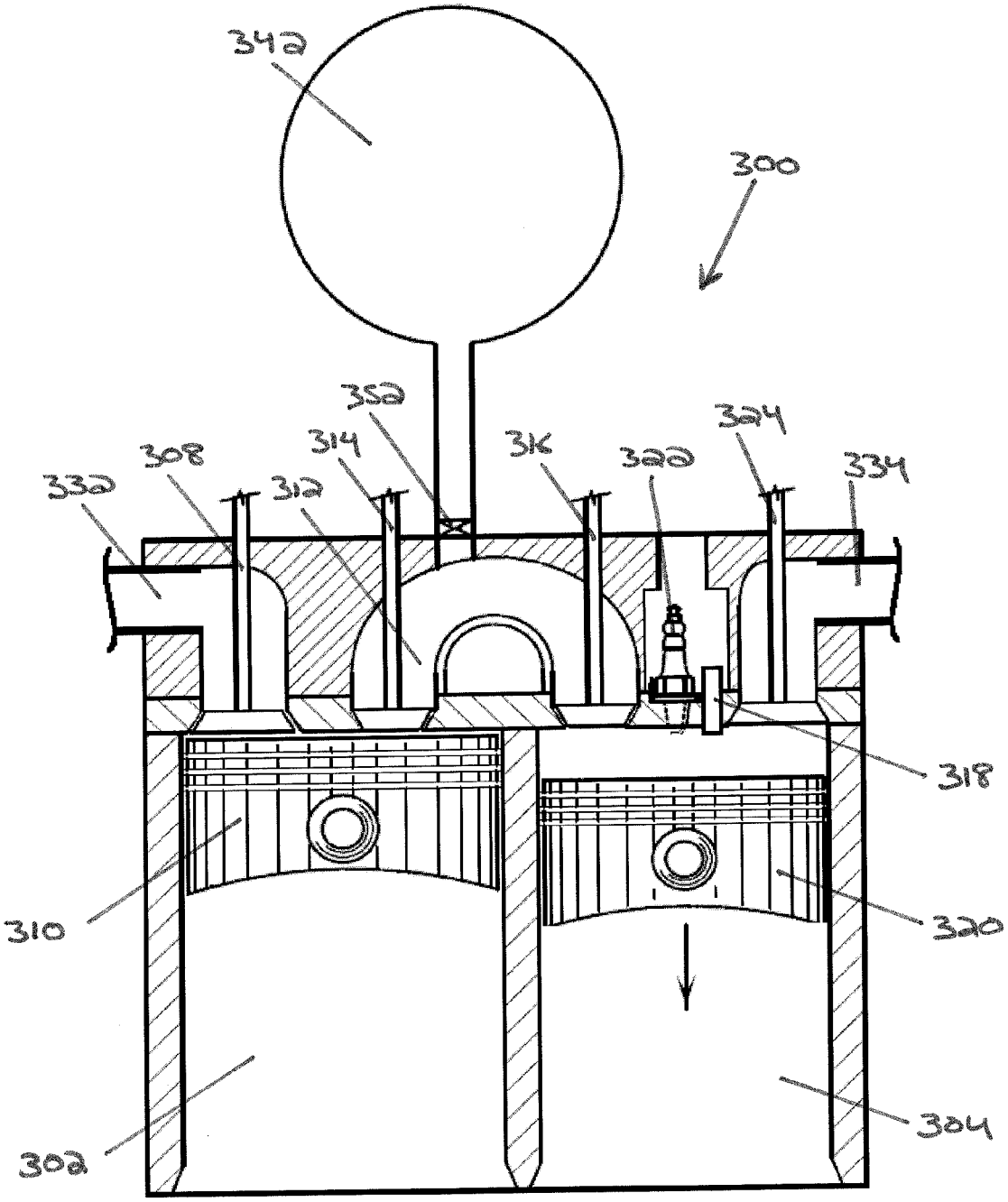

In FIG. 3G, the compression piston 310 reaches its TDC position, thereby ending the primary compression stroke and beginning a standby intake stroke. The expansion piston 320 continues to descend in the primary expansion stroke. The engine state shown in FIG. 3G can be described as the completion of the first rotation of the crankshaft and the start of the second rotation of the crankshaft.

Figure 3H:
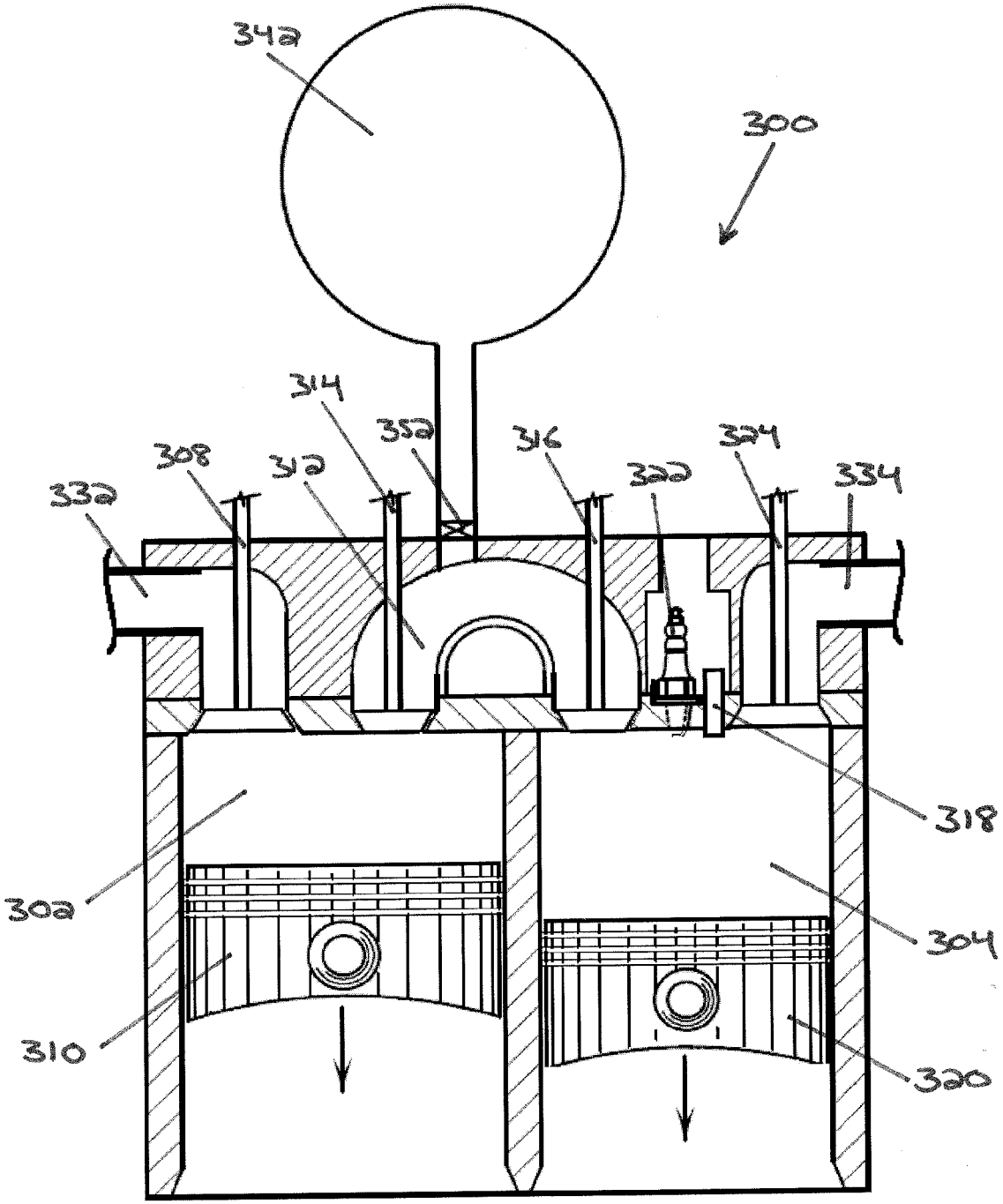

In FIG. 3H, the compression piston 310 descends in the standby intake stroke. The compression cylinder 302 can be idled during the standby intake stroke, for example by keeping the intake valve 308 and the crossover compression valve 314 closed as shown. In other embodiments, the compression cylinder 302 can be idled during the standby intake stroke by keeping the intake valve 308 open while keeping the crossover compression valve 314 closed. The expansion piston 320 continues to descend in the primary expansion stroke.

Figure 3I:
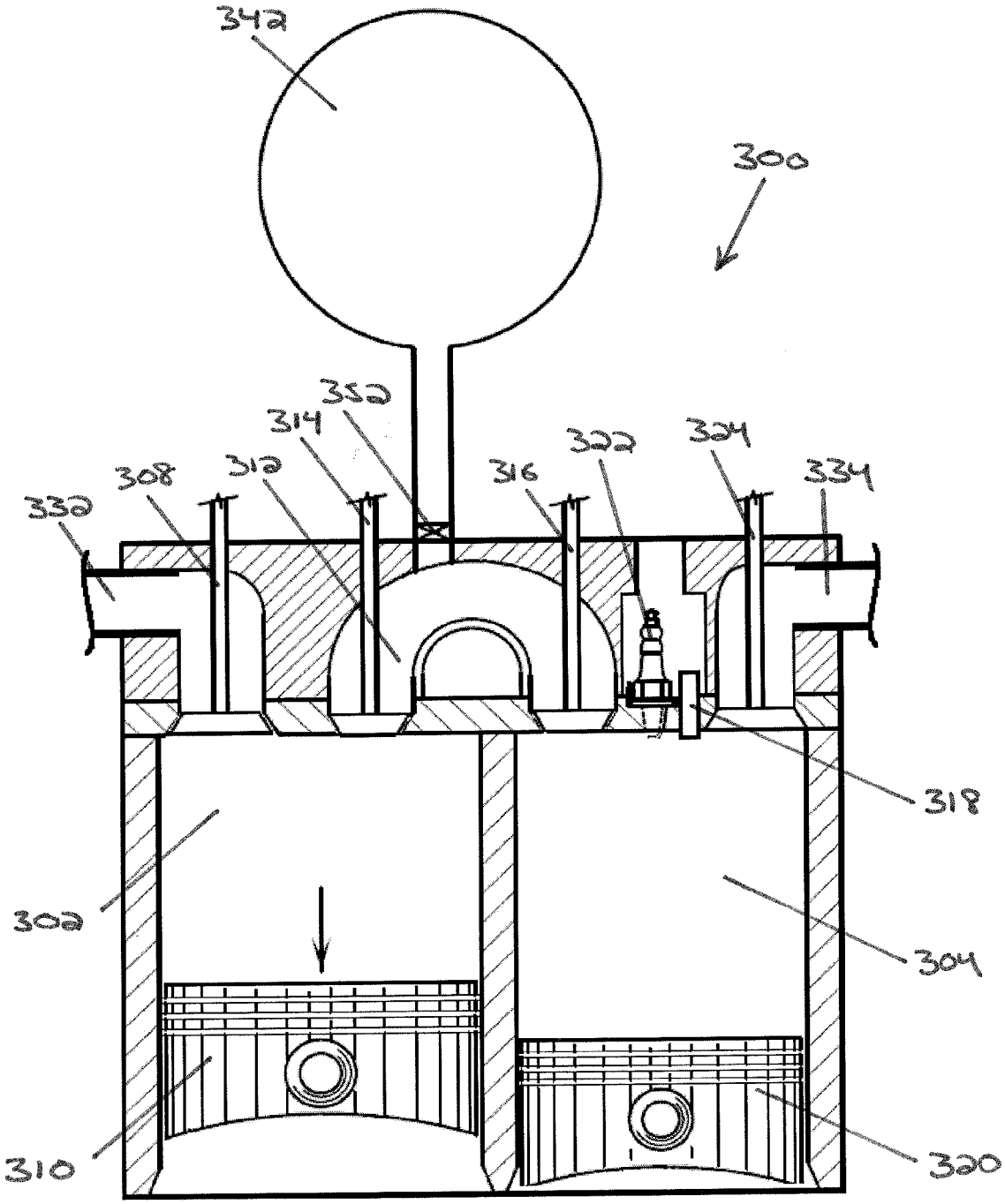

In FIG. 3I, the compression piston 310 continues to descend in the standby intake stroke. The expansion piston 320 reaches its BDC position, thereby ending the primary expansion stroke and beginning the primary exhaust stroke.

Figure 3J:
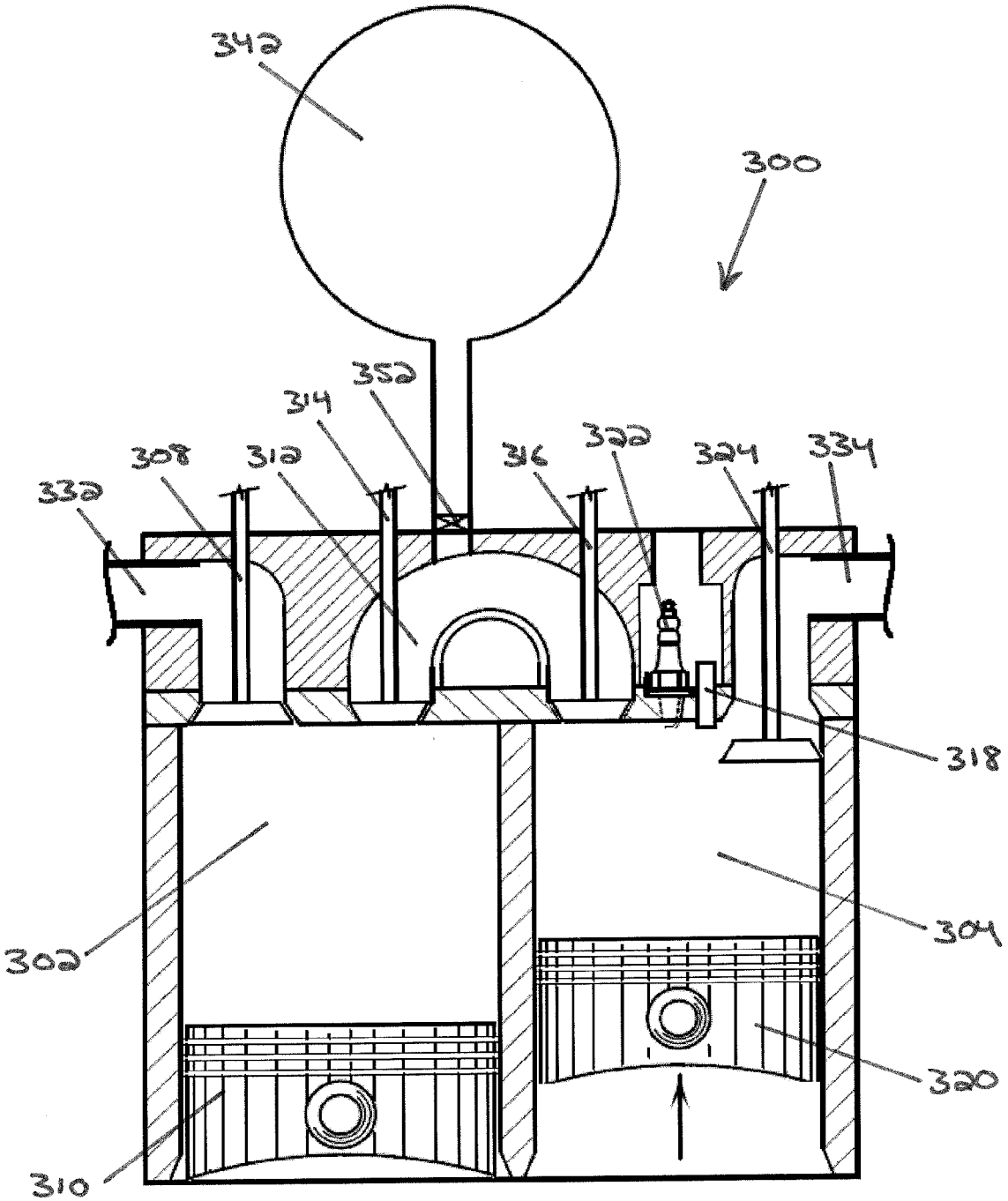

In FIG. 3J, the compression piston 310 reaches its BDC position, ending the standby intake stroke and beginning the standby compression stroke. The compression cylinder 302 can be idled during the standby compression stroke, for example by keeping the intake valve 308 and the crossover compression valve 314 closed as shown. In other embodiments, the compression cylinder 302 can be idled during the standby compression stroke by keeping the intake valve 308 open while keeping the crossover compression valve 314 closed. When the compression cylinder 302 is idled by closing the intake valve 308 and crossover compression valve 314 during the standby intake and standby compression strokes, the compression piston 310 pulls a vacuum on the standby intake stroke and then recovers the vacuum during the standby compression stroke, preventing unnecessary compression work and reducing parasitic losses. When the compression cylinder 302 is idled by opening the intake valve 308 during the standby intake and standby compression strokes, air is drawn into the cylinder during the standby intake stroke and then expelled back through the intake port 332 during the standby compression stroke, preventing unnecessary compression work and reducing parasitic losses. The exhaust valve 324 is open as the expansion piston 320 ascends in the primary exhaust stroke, forcing combustion gases out through the exhaust valve 324 and the exhaust port 334.

Figure 3K:
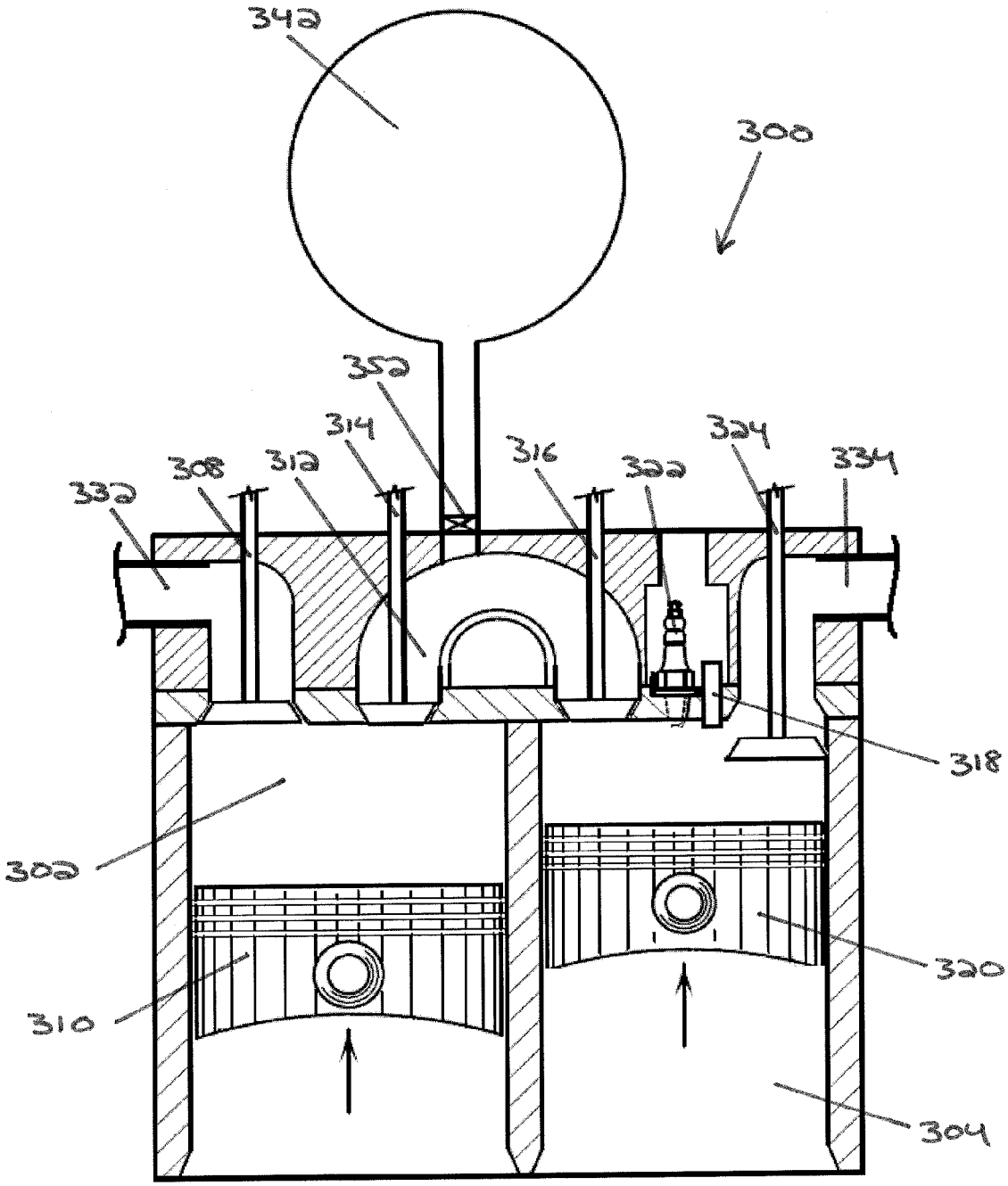

In FIG. 3K, the compression piston 310 continues to ascend in the standby compression stroke. The expansion piston 320 continues to ascend in the primary exhaust stroke.

Figure 3L:
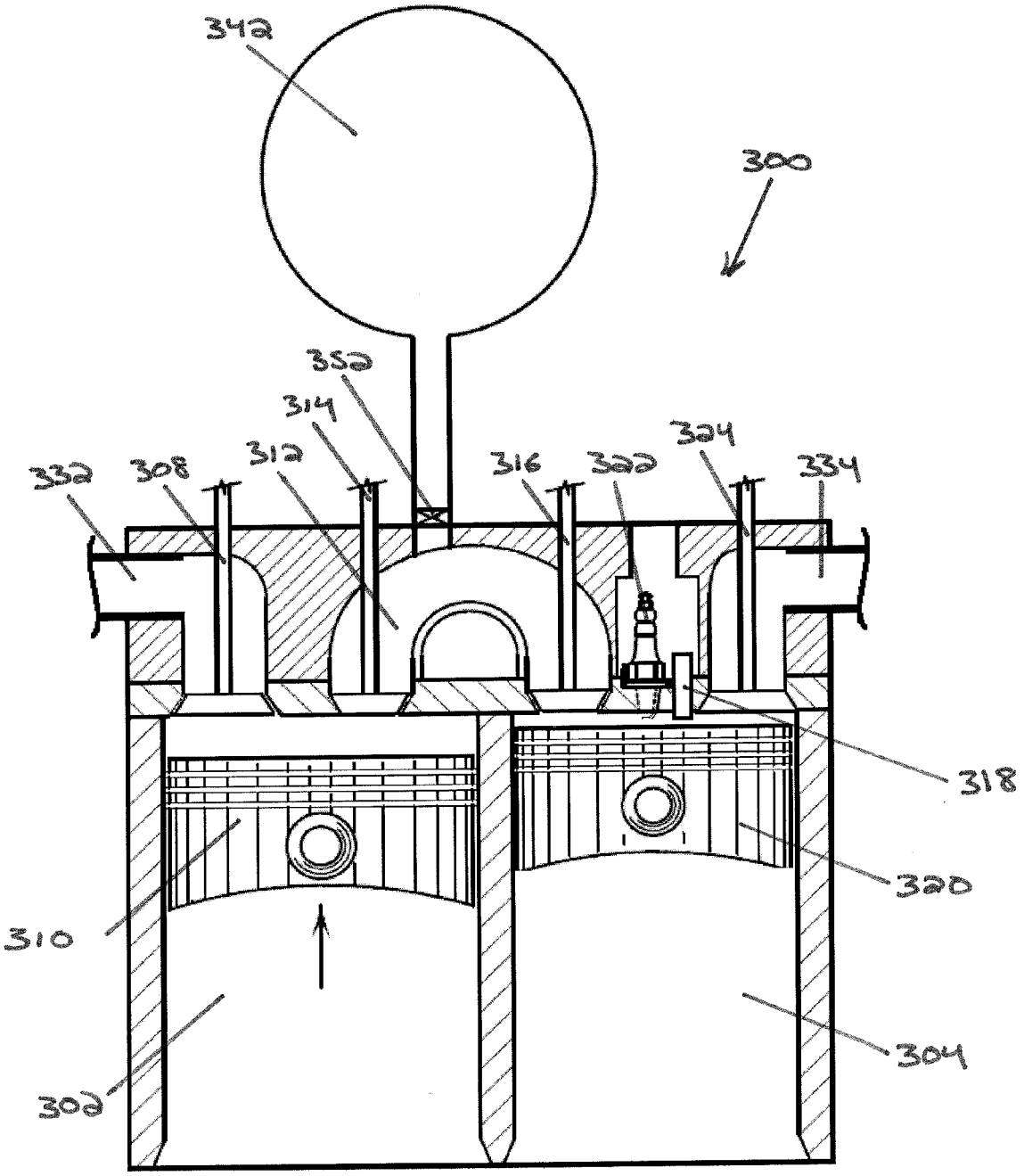

In FIG. 3L, the compression piston 310 continues to ascend in the standby compression stroke. The exhaust valve 324 is closed and the expansion piston 320 reaches its TDC position, ending the primary exhaust stroke and beginning a new standby expansion stroke. Operation of the engine 300 then returns to the state shown in FIG. 3A and the cycle repeats. Thus, as noted above, the state shown in FIG. 3A can be described as the completion of the second rotation of the crankshaft and the start of a subsequent first rotation of the crankshaft.

In the illustrated embodiment, the exhaust valve 324 (and an associated diverter system or some other supply of intake air), is open for at least a portion of the standby expansion stroke and/or at least a portion of the standby exhaust stroke. Preferably, the exhaust valve 324 is open for a portion of the standby expansion stroke and about half of the standby exhaust stroke. Leaving the exhaust valve 324 open during this time reduces the window during which fuel can be injected into the expansion cylinder 304 without risking blow-through of the fuel out the exhaust port 334. For example, waiting until halfway through the standby exhaust stroke to close the exhaust valve 324 reduces the fuel injection window to about 90 degrees CA as compared with 360 degrees CA when the exhaust valve 324 is closed throughout the standby expansion and standby exhaust strokes. The resulting intake and expulsion of air, however, can enhance the expansion cylinder 304 cooling that occurs during the standby expansion and standby exhaust strokes. In particular, the air that is circulated through the expansion cylinder 304 can remove heat therefrom. In some embodiments, the exhaust valve 324 can be closed earlier. For example, the exhaust valve 324 can be closed during the standby expansion stroke and can remain closed throughout the standby exhaust stroke, capturing air in the expansion cylinder to which fuel can be added.

An exemplary cycle in which cooling air is supplied to the expansion cylinder 304 during the standby expansion stroke and, optionally, during the standby exhaust stroke is as follows. (1) Spark ignition occurs, igniting an air-fuel mixture and driving the expansion piston 320 down in a primary expansion stroke. (2) The exhaust valve opens near BDC of the expansion piston 320 and exhaust gases are flushed from the expansion cylinder 304 during a primary exhaust stroke. (3) The exhaust valve is closed at or near TDC of the expansion piston 320. (4) A cooling air charge is supplied to the expansion cylinder (e.g., by opening an expansion-intake valve or by opening the exhaust valve and an associated diverter system) when the expansion piston 320 is at or near TDC. (5) The cooling air charge is drawn into the expansion cylinder 304 as the expansion piston descends in a standby expansion stroke. (6) Early or late closure of the supply of cooling air traps a desired mass of cooling charge (e.g., when the piston 320 is not close to BDC). (7) Direct injection of fuel into the expansion cylinder (e.g., about 60 degrees CA after the expansion piston 320 reaches BDC), without enough air for combustion to create a rich condition within the expansion cylinder reduces or prevents premature detonation. (8) The crossover expansion valve 316 opens (e.g., before TDC of the expansion piston 320), adding air to the fuel in the expansion cylinder. (9) The cycle returns to step (1) above, before or after closing the crossover expansion valve 316. In some embodiments, the crossover expansion valve 316 can be closed before TDC.

The compression cylinder 302 of the engine 300 can be downsized relative to the expansion cylinder 304 to produce a Miller effect. Further details on the Miller effect in the context of split-cycle engines are available in U.S. Provisional Application No. 61/721,545, filed on Nov. 2, 2012, entitled "SPLIT-CYCLE DIRECT INJECTION ENGINE WITH ADVANCED MILLER CYCLE," the entire contents of which are hereby incorporated by reference herein. By reducing the volume of the compression cylinder 302 (e.g., to less than half the volume of the expansion cylinder 304), the reduction in brake mean effective pressure (BMEP) of the engine 300 introduced by requiring two rotations of the crankshaft for each firing stroke can be minimized.

The engine 300 can provide some or all of the advantages described above with respect to the engine 200, including, for example, improved BMEP, improved efficiency, reduced knocking, high volumetric compression ratio, enhanced cooling, more time and space to inject fuel, and/or support for low pressure natural gas operation.

Four-Stroke Expansion Cylinder with Crossover Air Shot

In some embodiments, the crossover expansion valve 316 can be opened during the standby expansion stroke and/or the standby exhaust stroke (e.g., at the timing described above with respect to the exhaust valve 324) to supply air to the expansion cylinder 304 from the crossover passage 312 or the air tank 342. This can be done instead of or in addition to opening the exhaust valve 324 or an expansion-intake valve.

In some embodiments, air can be introduced into the expansion cylinder 304 during the primary exhaust stroke (e.g., after closing the exhaust valve 324). For example, the following cycle can include supplying air through the crossover expansion valve during the primary exhaust stroke to cool the expansion cylinder. (1) Spark ignition occurs, igniting an air-fuel mixture and driving the expansion piston 320 down in a primary expansion stroke. (2) The exhaust valve opens near BDC of the expansion piston 320 and exhaust gases are flushed from the expansion cylinder 304 during a first portion of a primary exhaust stroke. (3) The exhaust valve is closed early (e.g., about 60 degrees CA before the expansion piston 320 reaches TDC), trapping a quantity of residual combustion gases in the expansion cylinder 304. (4) The crossover expansion valve 316 opens before the expansion piston 320 reaches TDC (e.g., approximately 5 degrees CA before TDC) for cooling air charge induction. (5) At or near TDC of the expansion piston 320 (e.g., approximately 3 degrees CA after TDC), the crossover expansion valve 316 is closed and the cooling air charge expands within the expansion cylinder 304 as the expansion piston descends in a standby expansion stroke. (6) The exhaust valve 324 optionally opens when the expansion piston 320 is near BDC to begin a standby exhaust stroke in which the charge of cooling air, now heated by the expansion cylinder 304, is exhausted. (7) The exhaust valve 324, if opened in step (6) above, closes part way through the standby exhaust stroke, trapping some air in the expansion cylinder 304. (8) Direct injection of fuel into the expansion cylinder can begin as soon as the exhaust valve 324 closes (e.g., to create a rich condition within the expansion cylinder to reduce or prevent premature detonation). (9) The crossover expansion valve 316 opens again, adding air to the fuel in the expansion cylinder. (10) The cycle returns to step (1) above, before or after closing the crossover expansion valve 316. In another exemplary cycle, step (3) above can be omitted such that, instead of closing the exhaust valve 324 early during the primary exhaust stroke, a complete primary exhaust stroke is executed.

Multiple Expansion Cylinders

FIGS. 4A-4L illustrate another exemplary embodiment of a split-cycle engine 400. Except as indicated below, the structure of the engine 400 is substantially the same as that of the engine 100 described above, and therefore a detailed explanation of said structure is omitted here for the sake of brevity.

The engine 400 is operable in a normal firing mode in which two rotations of the engine 400 are required to complete one cycle. The compression cylinder 402 can be described as operating in a four-stroke mode that includes intake and compression strokes for feeding a first expansion cylinder 404A and intake and compression strokes for feeding a second expansion cylinder 404B. The expansion cylinders 404A, 404B each can be described as operating in a four-stroke mode in which the intake and compression strokes are replaced with standby expansion and standby exhaust strokes. In this normal firing mode, a firing stroke is performed in each expansion cylinder 404A, 404B only on every other rotation of the crankshaft, resulting in one total firing stroke on each rotation of the crankshaft. Fuel can be injected directly into the expansion cylinders 404A, 404B during their respective non-firing rotation of the crankshaft over a period of time greater than what is possible with traditional split-cycle engines.

The engine 400 includes a first expansion cylinder 404A having a first expansion piston 420A reciprocally disposed therein and operably coupled to a crankshaft. The engine 400 also includes a compression cylinder 402 having a compression piston 410 reciprocally disposed therein and operably coupled to the crankshaft. The engine 400 also includes a second expansion cylinder 404B having a second expansion piston 420B reciprocally disposed therein and operably coupled to the crankshaft. For convenience of illustration, the crankshaft and the connecting rods coupling the pistons 410, 420A, 420B thereto are not shown in FIGS. 4A-4L.

The engine 400 also includes a first crossover passage 412A interconnecting the first expansion cylinder 404A and the compression cylinder 402. The engine 400 also includes a second crossover passage 412B interconnecting the second expansion cylinder 404B and the compression cylinder 402.

A first exhaust valve 424A controls fluid communication between a first exhaust port 434A and the first expansion cylinder 404A. A first crossover expansion valve 416A controls fluid communication between the first expansion cylinder 404A and the first crossover passage 412A. A first crossover compression valve 414A controls fluid communication between the first crossover passage 412A and the compression cylinder 402. An intake valve 408 controls fluid communication between an intake port 432 and the compression cylinder 402. A second crossover compression valve 414B controls fluid communication between the compression cylinder 402 and the second crossover passage 412B. A second crossover expansion valve 416B controls fluid communication between the second crossover passage 412B and the second expansion cylinder 404B. A second exhaust valve 424B controls fluid communication between the second expansion cylinder 404B and the second exhaust port 434B.

Each of the first and second expansion cylinders 404A, 404B includes at least one respective fuel injector 418A, 418B and at least one respective spark plug 422A, 422B. The first and second crossover passages 412A, 412B can be selectively placed in fluid communication with first and second respective air tanks 442A, 442B via first and second control valves 452A, 452B. In some embodiments, the first and second air tanks 442A, 442B can be a single air tank or can be in fluid communication with one another to define a single enclosed volume, as indicated by the dotted lines in FIG. 4A.

The fuel injectors 418A, 418B are configured to inject fuel directly into the expansion cylinders 404A, 404B. In other words, the outlets of the fuel injectors 418A, 418B are disposed within the expansion cylinders 404A, 404B such that injected fuel flows into the expansion cylinders 404A, 404B without first travelling through the crossover passages 412A, 412B. In addition, the engine 400 includes a valve train, valve actuation system, and/or engine controller that is/are configured to actuate the engine valves, inject fuel, and fire the spark plugs 422A, 422B according to an operating cycle that differs from that of the engine 100 described above. An exemplary embodiment of this operating cycle is described in detail below with respect to FIGS. 4A-4L, which depict sequential snapshots of engine operation over two rotations of the crankshaft.

In the illustrated embodiment, the first and second expansion pistons 420A, 420B lead the compression piston 410 by the same amount (e.g., by approximately 10-30 degrees CA) throughout the engine cycle, such that each stroke of the first expansion piston 420A and each stroke of the second expansion piston 420B begins slightly before the counterpart stroke of the compression piston 410. For convenience of description, strokes of the compression piston 410 are sometimes referred to herein as occurring simultaneously with counterpart strokes of the expansion pistons 420A, 420B. It will be appreciated, however, that the expansion piston strokes begin and end slightly before the compression piston strokes begin and end. By the same token, two consecutive strokes of the compression piston 410, two counterpart strokes of the first expansion piston 420A, and two counterpart strokes of the second expansion piston 420B are sometimes referred to herein as occurring during a single rotation of the crankshaft. It will be appreciated, however, that portions of two of these strokes extend into another rotation of the crankshaft, due to the offset timing of the compression piston 410 and the expansion pistons 420A, 420B. With this in mind, the engine state shown in FIG. 4A can be described as the start of a first rotation of the crankshaft and the end of a second rotation of the crankshaft. In a normal firing mode of operation, the engine 400 continuously alternates between the first rotation and the second rotation.

Figure 4A:
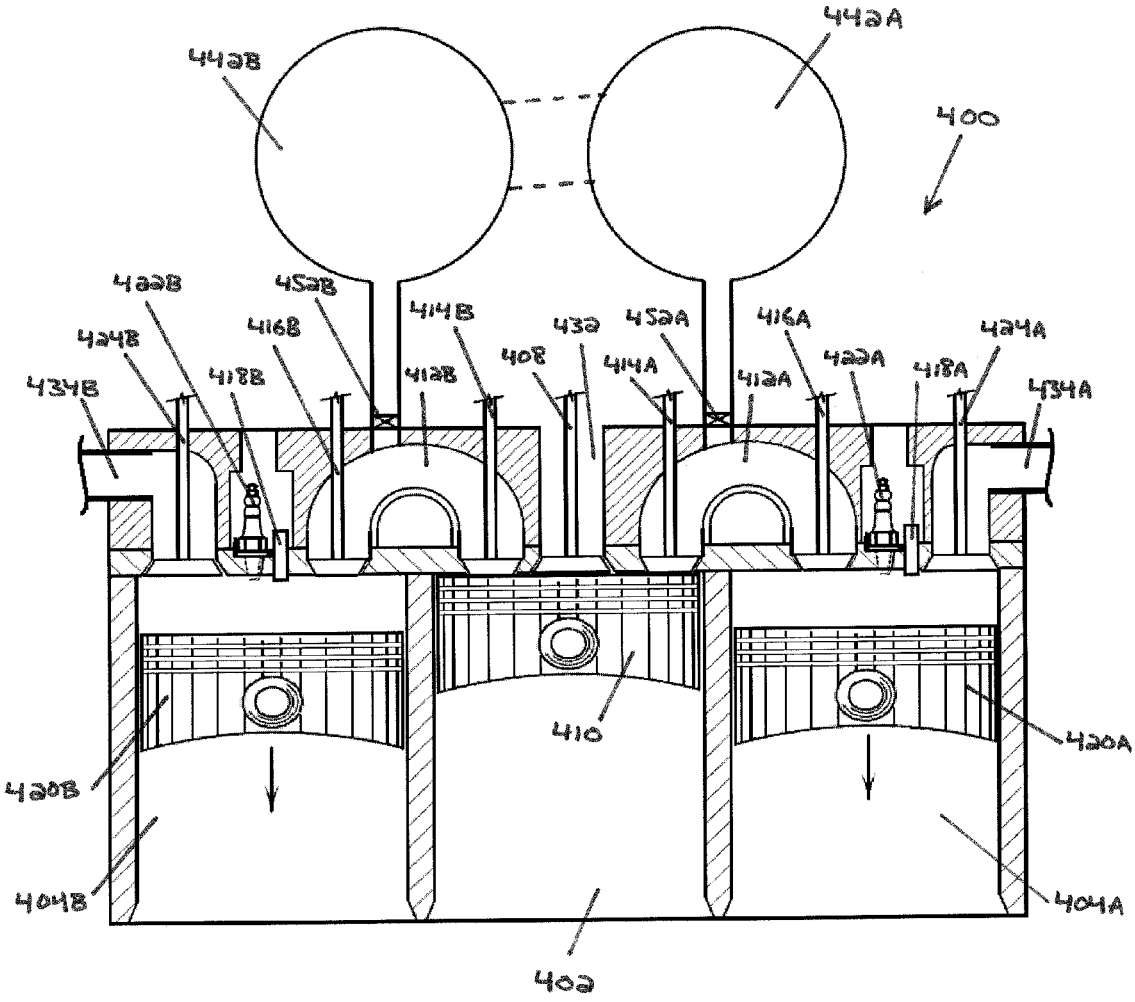
FIGS. 4A-4L are sequential, schematic illustrations of the operation of another exemplary embodiment of a split-cycle engine over two rotations of a crankshaft.

In FIG. 4A, the compression piston 410 is shown at its TDC position, at the end of a second compression stroke and the beginning of a first intake stroke. The first expansion piston 420A is shown descending in a standby expansion stroke. The second expansion piston 420B is shown descending in a primary expansion stroke.

Figure 4B:
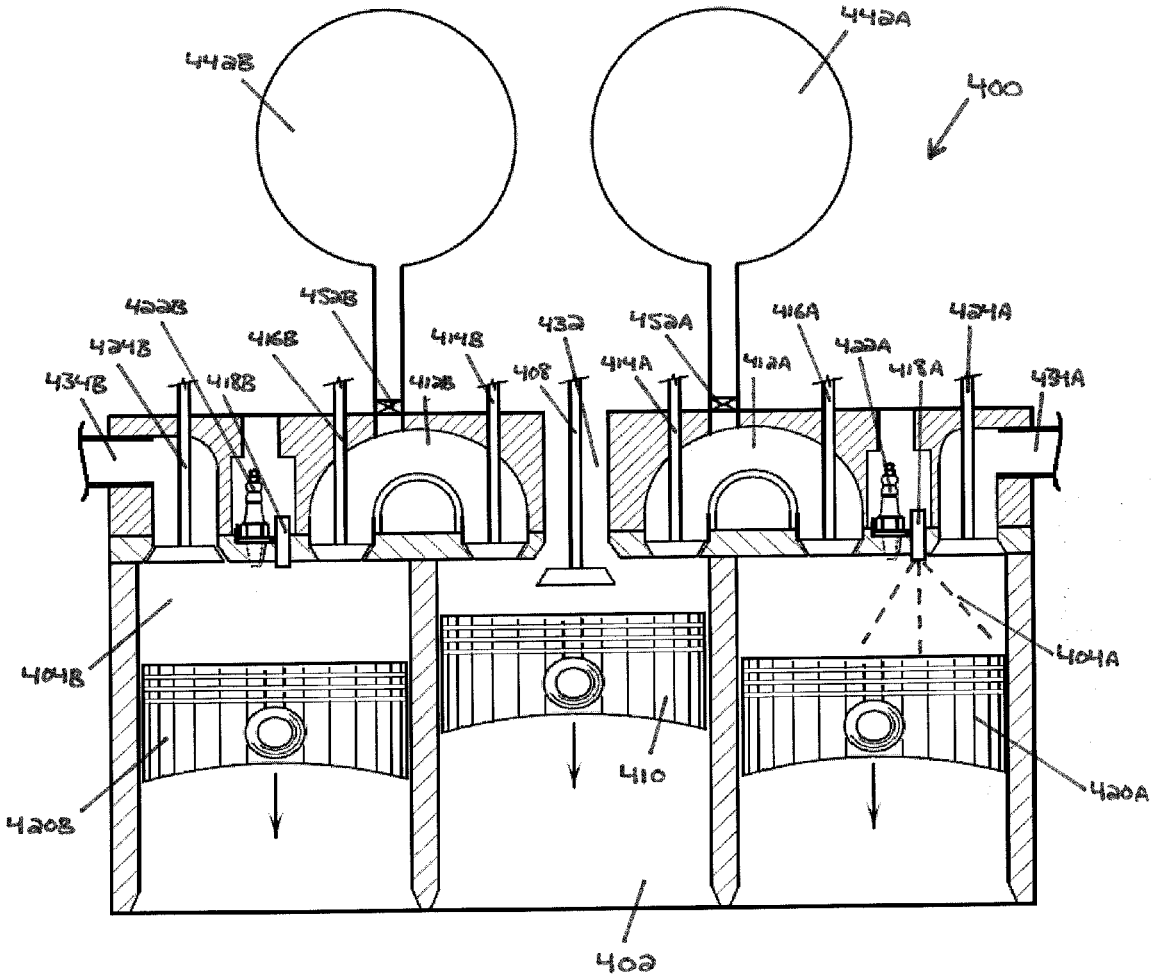

In FIG. 4B, the compression piston 410 descends within the compression cylinder 402 in the first intake stroke. The intake valve 408 is open during the first intake stroke such that air is drawn through the intake port 432 and into the compression cylinder 402. The crossover compression valves 414A, 414B can be closed to prevent any air that may be disposed in the crossover passages 412A, 412B from flowing back into the compression cylinder 402. The first expansion piston 420A continues to descend within the first expansion cylinder 404A in the standby expansion stroke. The first crossover expansion valve 416A and the first exhaust valve 424A are both closed during the standby expansion stroke, effectively sealing the first expansion cylinder 404A such that the first expansion piston 420A pulls a vacuum as it descends. No firing occurs during the standby expansion stroke and fuel can be injected directly into the first expansion cylinder 404A at any time during the standby expansion stroke. The second expansion piston 420B continues to descend in the primary expansion stroke.

Figure 4C:
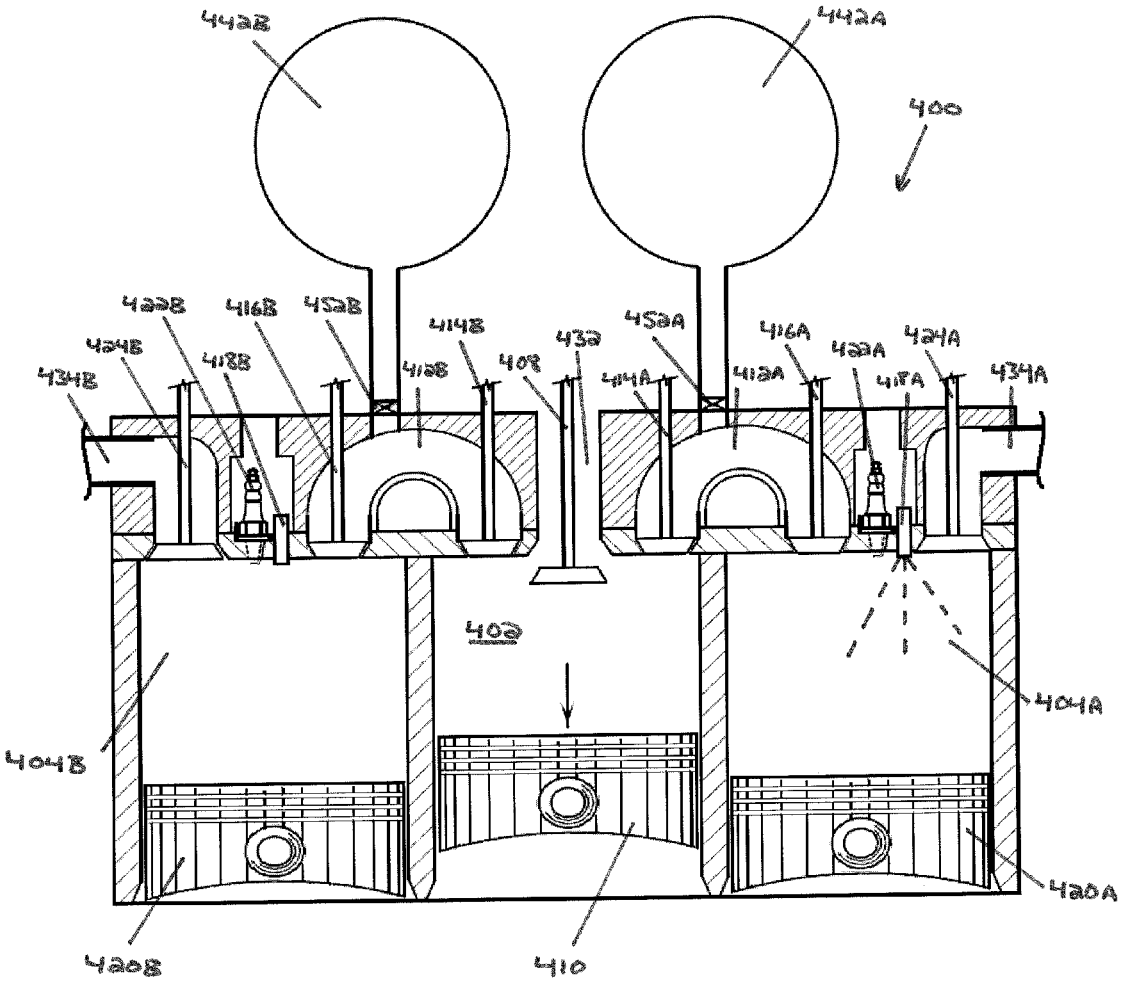

In FIG. 4C, the compression piston 410 continues its first intake stroke, drawing in air from the intake port 432 as it descends in the compression cylinder 402. The first expansion piston 420A reaches its BDC position, thereby ending the standby expansion stroke and beginning a standby exhaust stroke. The second expansion piston 420B reaches its BDC position, thereby ending the primary expansion stroke and beginning a primary exhaust stroke.

Figure 4D:
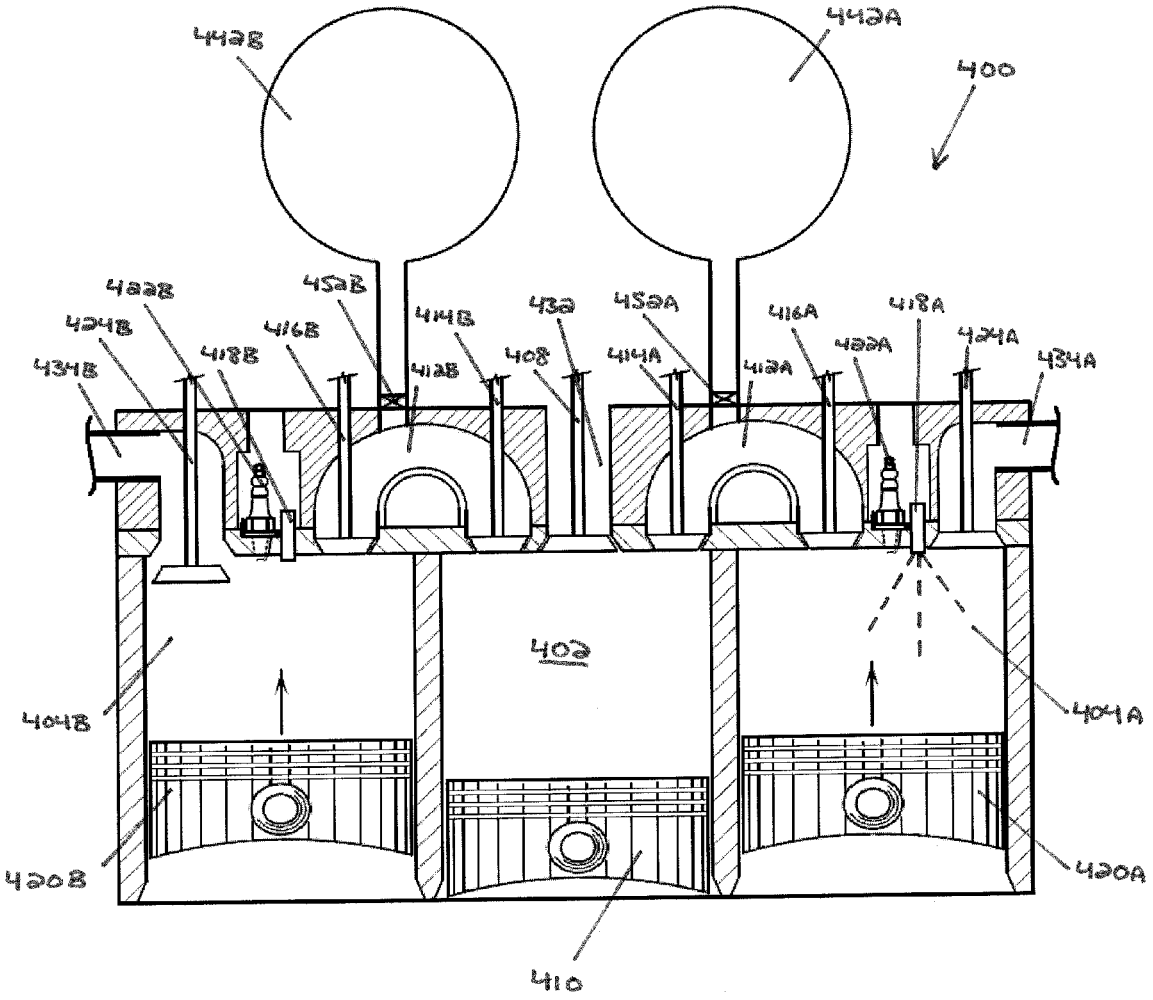

In FIG. 4D, the compression piston 410 reaches its BDC position, thereby ending the first intake stroke and beginning a first compression stroke. The first expansion piston 420A ascends during the standby exhaust stroke while the first crossover expansion valve 416A and the first exhaust valve 424A remain closed. The vacuum created in the first expansion cylinder 404A during the previous standby expansion stroke pulls the ascending expansion piston 420A towards its TDC position, recovering much of the work exerted in creating the vacuum. Fuel can be injected directly into the first expansion cylinder 404A at any time during the standby exhaust stroke. The second exhaust valve 424B is open as the second expansion piston 420B ascends in the primary exhaust stroke, forcing combustion gases out through the second exhaust valve 424B and the second exhaust port 434B.

Figure 4E:
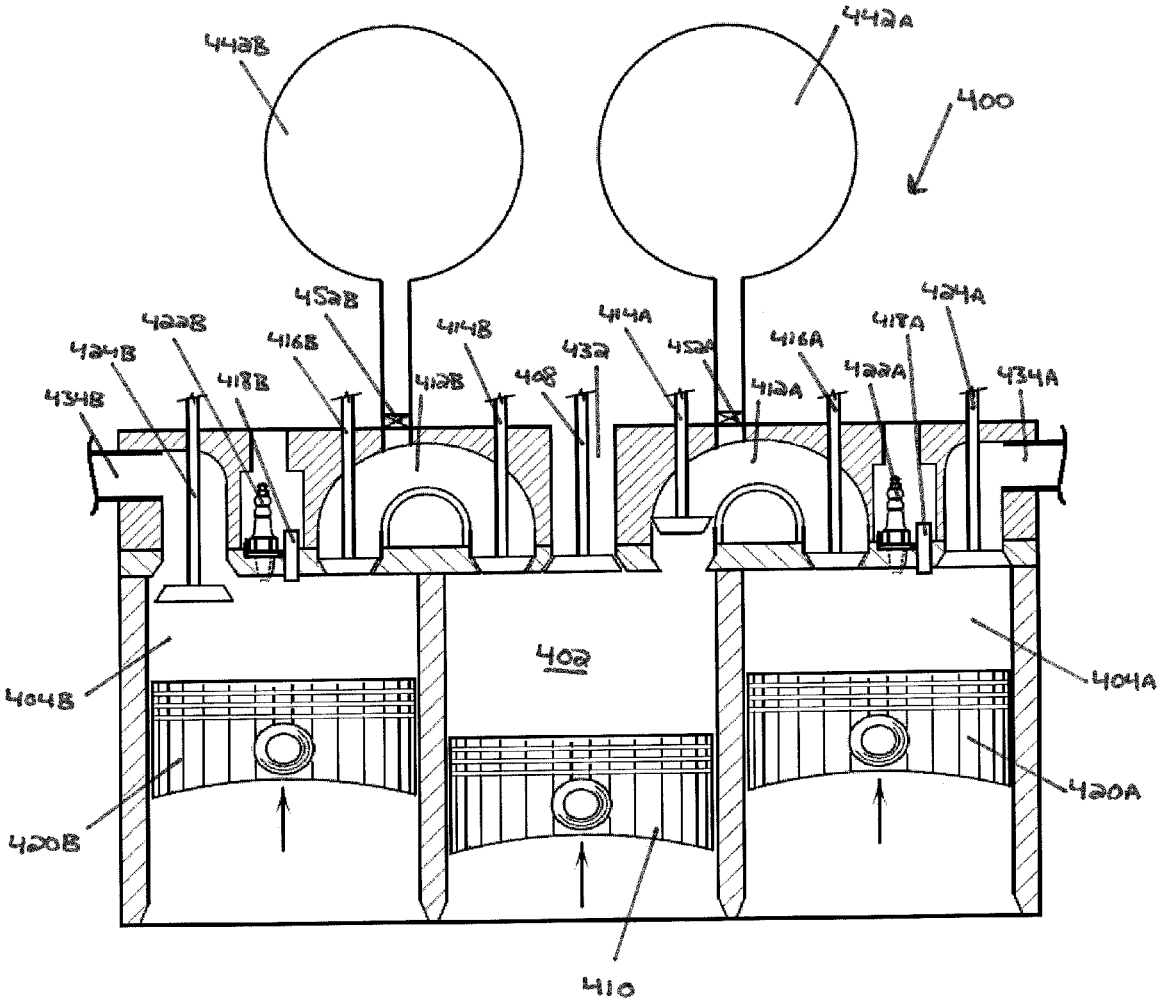

In FIG. 4E, the compression piston 410 continues its first compression stroke, compressing air contained in the compression cylinder 402. The first crossover compression valve 414A can be opened during the first compression stroke to allow air to be compressed into the first crossover passage 412A. The first expansion piston 420A continues its standby exhaust stroke, recovering the vacuum created during the previous standby expansion stroke. The second expansion piston 420B continues to ascend in the primary exhaust stroke.

Figure 4F:
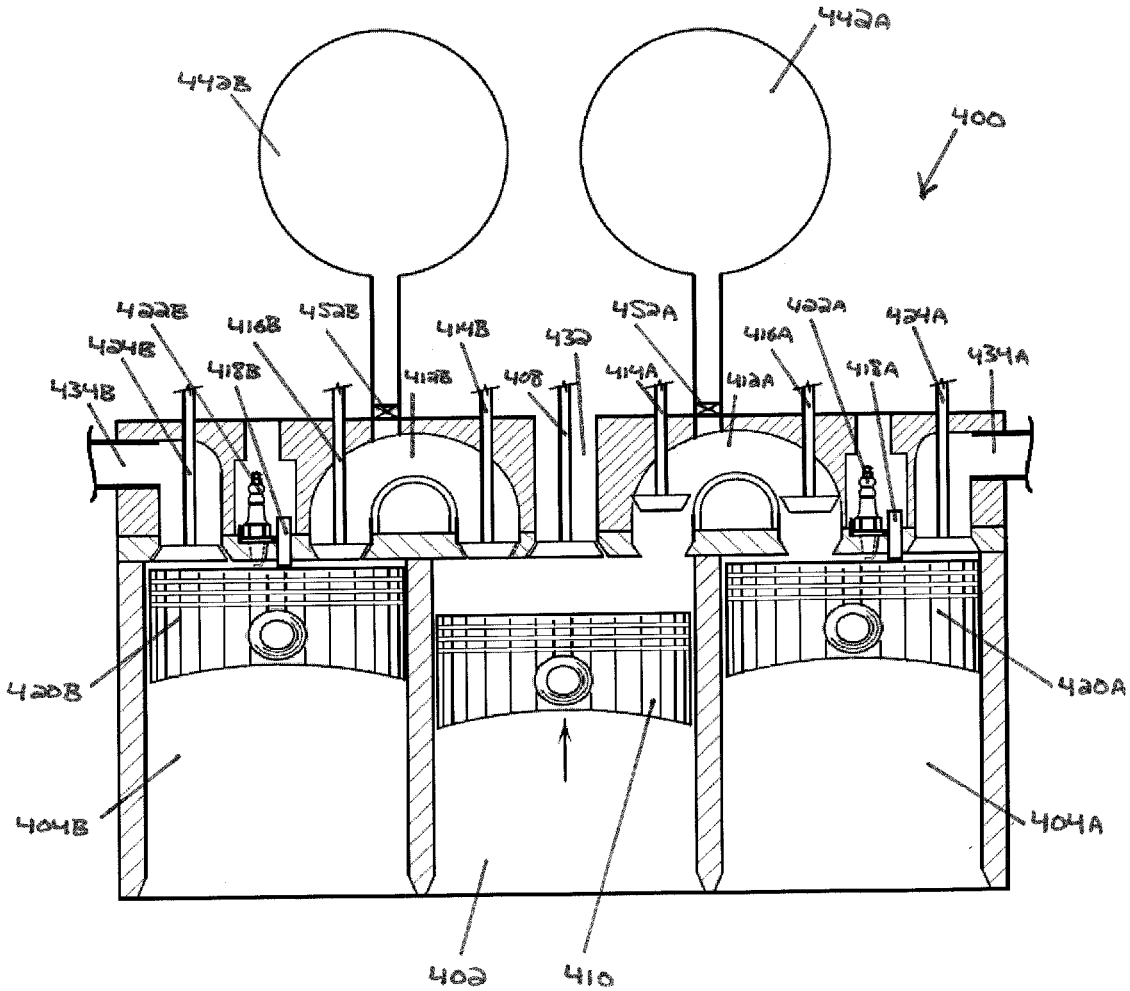

In FIG. 4F, the compression piston 410 continues to ascend, compressing air into the first crossover passage 412A through the open first crossover compression valve 414A. The first expansion piston 420A reaches its TDC position, thereby ending the standby exhaust stroke and beginning a primary expansion stroke. The first crossover expansion valve 416A is opened momentarily as the first expansion piston 420A begins to descend in the primary expansion stroke, resulting in the push-pull gas transfer effect described above. As the first expansion piston 420A descends (i.e., after TDC of the first expansion piston 420A), the first spark plug 422A is fired to ignite the air-fuel mixture in the first expansion cylinder 404A and drive the first expansion piston 420A down in the primary expansion stroke to power the crankshaft and the load coupled to the engine 400. The first crossover expansion valve 416A can be closed before or after the first spark plug 422A is fired. The second exhaust valve 424B is closed and the second expansion piston 420B reaches its TDC position, ending the primary exhaust stroke and beginning a new standby expansion stroke.

Figure 4G:
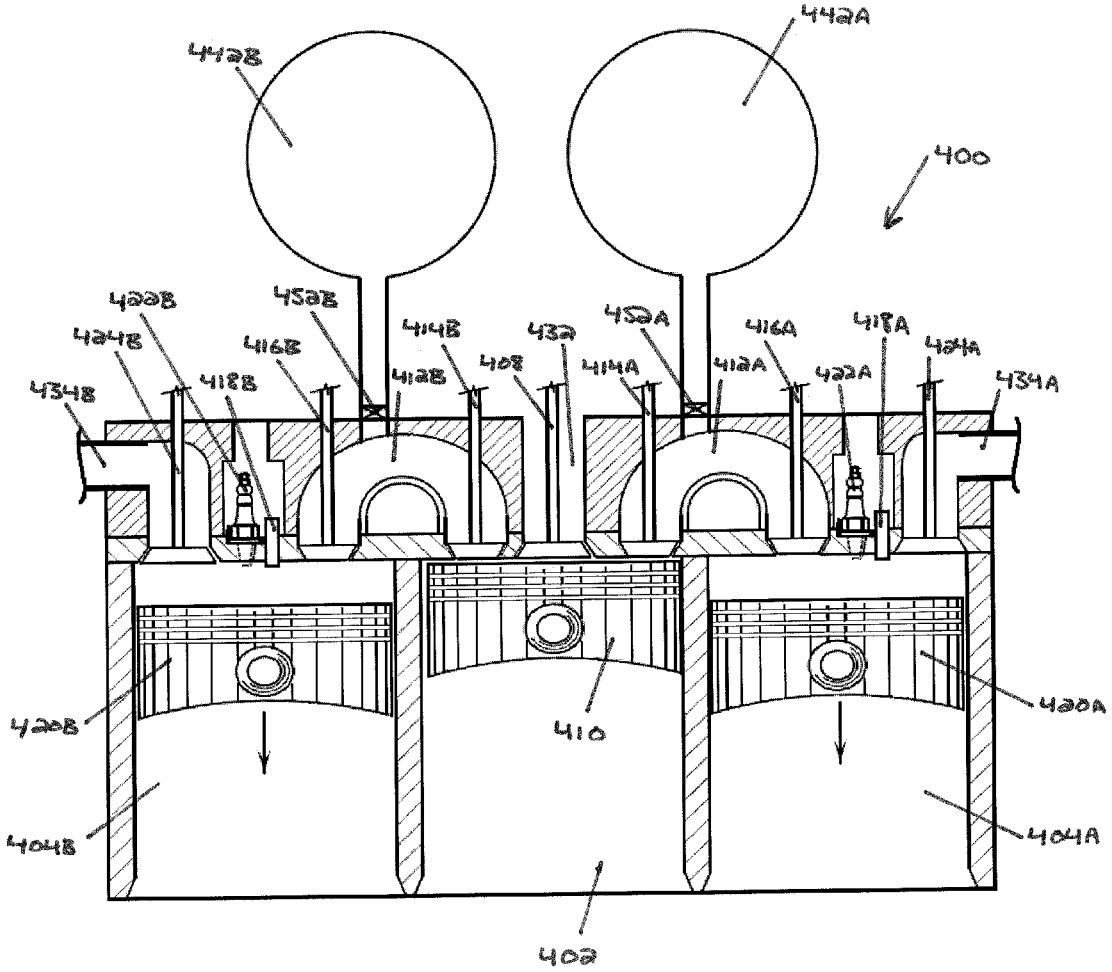

In FIG. 4G, the compression piston 410 reaches its TDC position, thereby ending the first compression stroke and beginning a second intake stroke. The first expansion piston 420A continues to descend in the primary expansion stroke. The second expansion piston 420B continues to descend in a standby expansion stroke. The engine state shown in FIG. 4G can be described as the completion of the first rotation of the crankshaft and the start of the second rotation of the crankshaft.

Figure 4H:
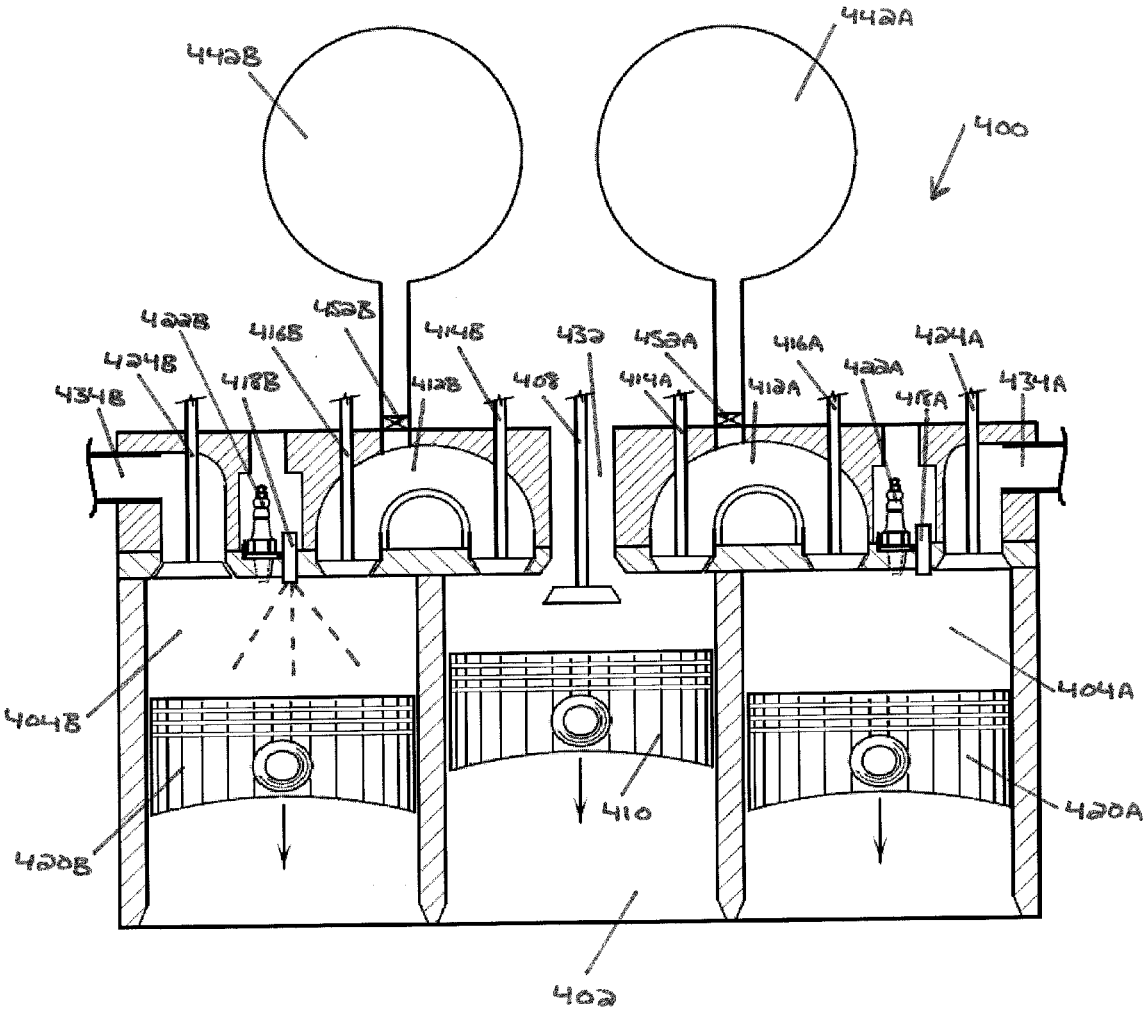

In FIG. 4H, the compression piston 410 continues its second intake stroke, drawing in air from the intake port 432 as it descends in the compression cylinder 402. The first expansion piston 420A continues to descend in the primary expansion stroke. The second expansion piston 420B continues to descend within the second expansion cylinder 404B in the standby expansion stroke. The second crossover expansion valve 416B and the second exhaust valve 424B are both closed during the standby expansion stroke, effectively sealing the second expansion cylinder 404B such that the second expansion piston 420B pulls a vacuum as it descends. No firing occurs during the standby expansion stroke and fuel can be injected directly into the second expansion cylinder 404B at any time during the standby expansion stroke.

Figure 4I:
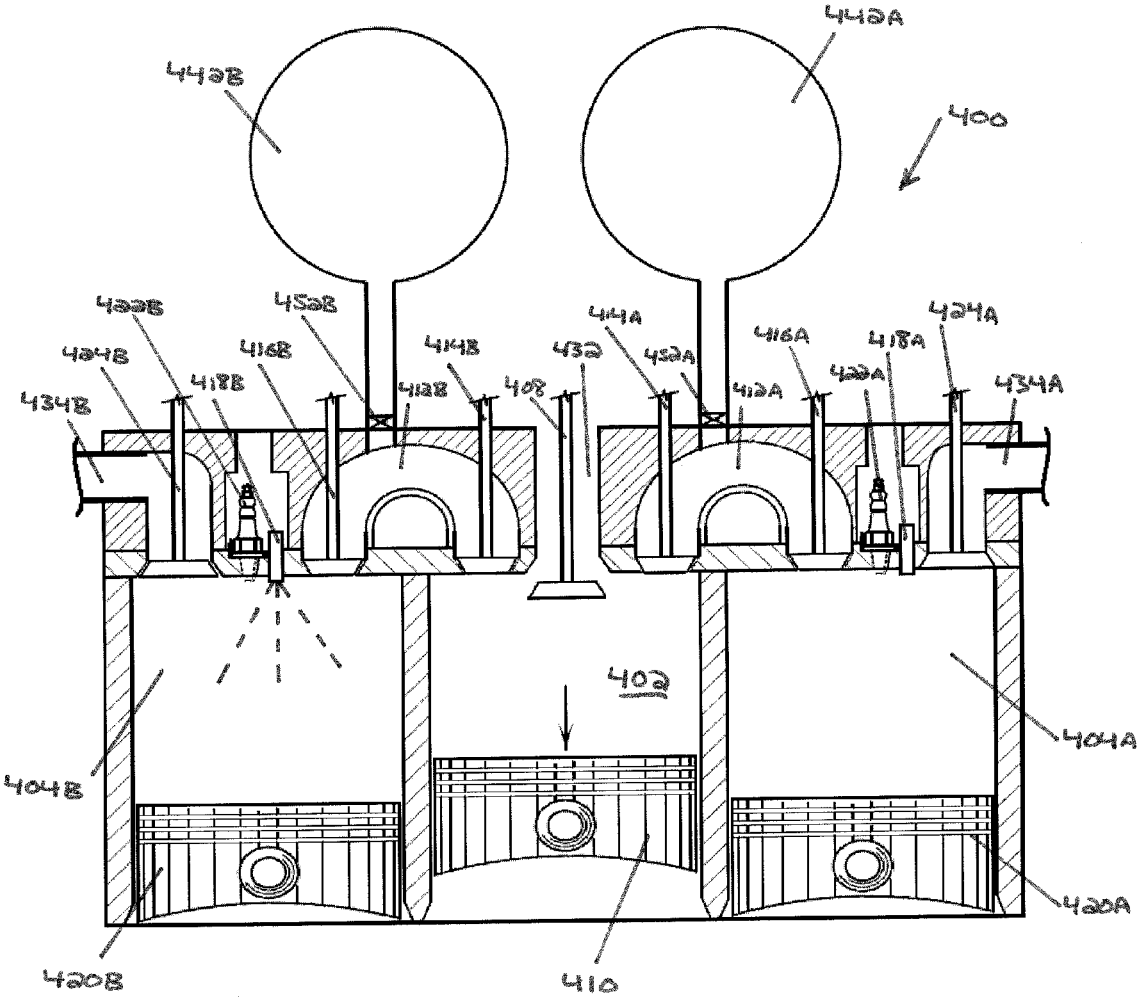

In FIG. 4I, the compression piston 410 continues to descend in the second intake stroke. The first expansion piston 420A reaches its BDC position, thereby ending the primary expansion stroke and beginning the primary exhaust stroke. The second expansion piston 420B reaches its BDC position, thereby ending the standby expansion stroke and beginning a standby exhaust stroke.

Figure 4J:
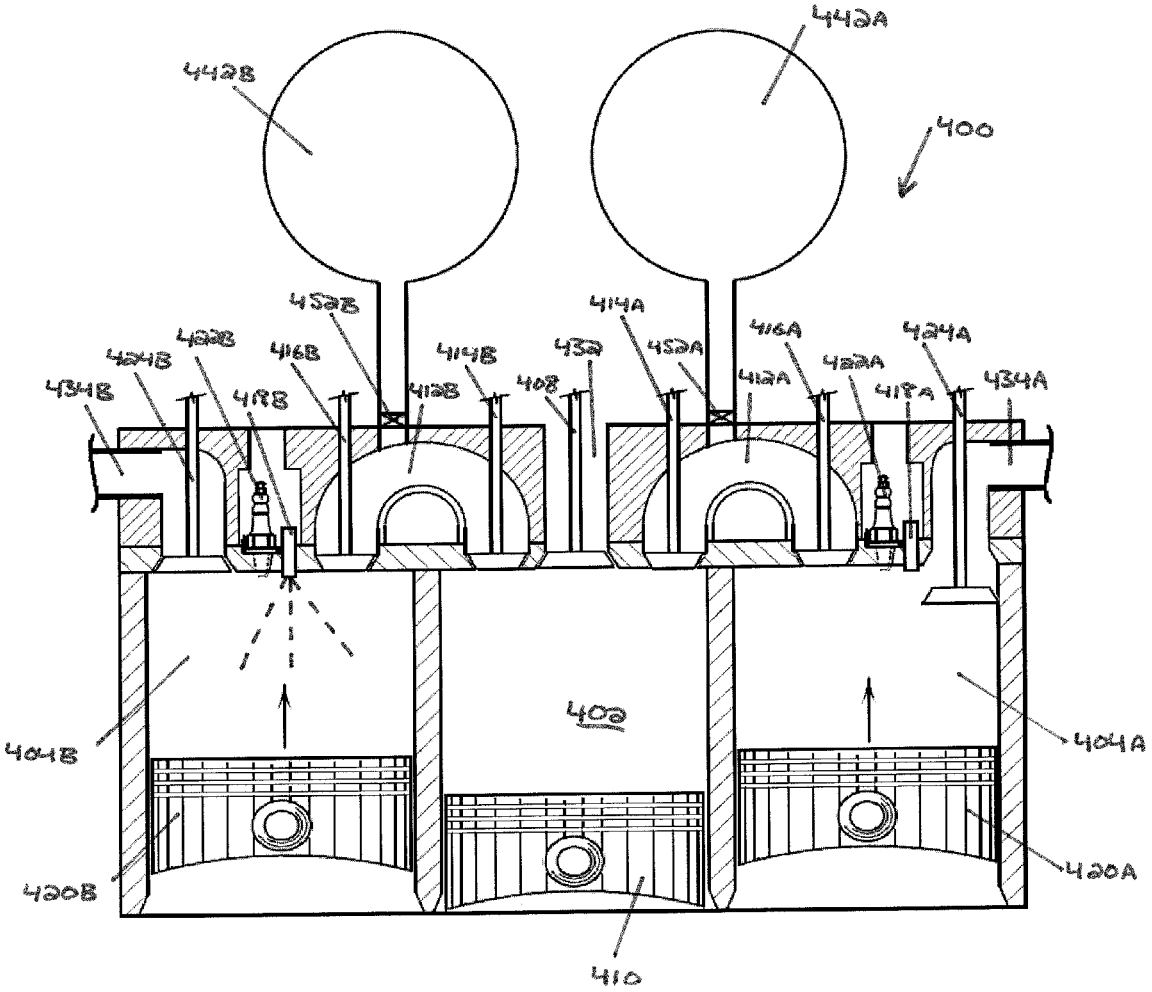

In FIG. 4J, the compression piston 410 reaches its BDC position, ending the second intake stroke and beginning the second compression stroke. The first exhaust valve 424A is open as the first expansion piston 420A ascends in the primary exhaust stroke, forcing combustion gases out through the first exhaust valve 424A and the first exhaust port 434A. The second expansion piston 420B ascends during the standby exhaust stroke while the second crossover expansion valve 416B and the second exhaust valve 424B remain closed. The vacuum created in the second expansion cylinder 404B during the previous standby expansion stroke pulls the ascending second expansion piston 420B towards its TDC position, recovering much of the work exerted in creating the vacuum. Fuel can be injected directly into the second expansion cylinder 404B at any time during the standby exhaust stroke.

Figure 4K:
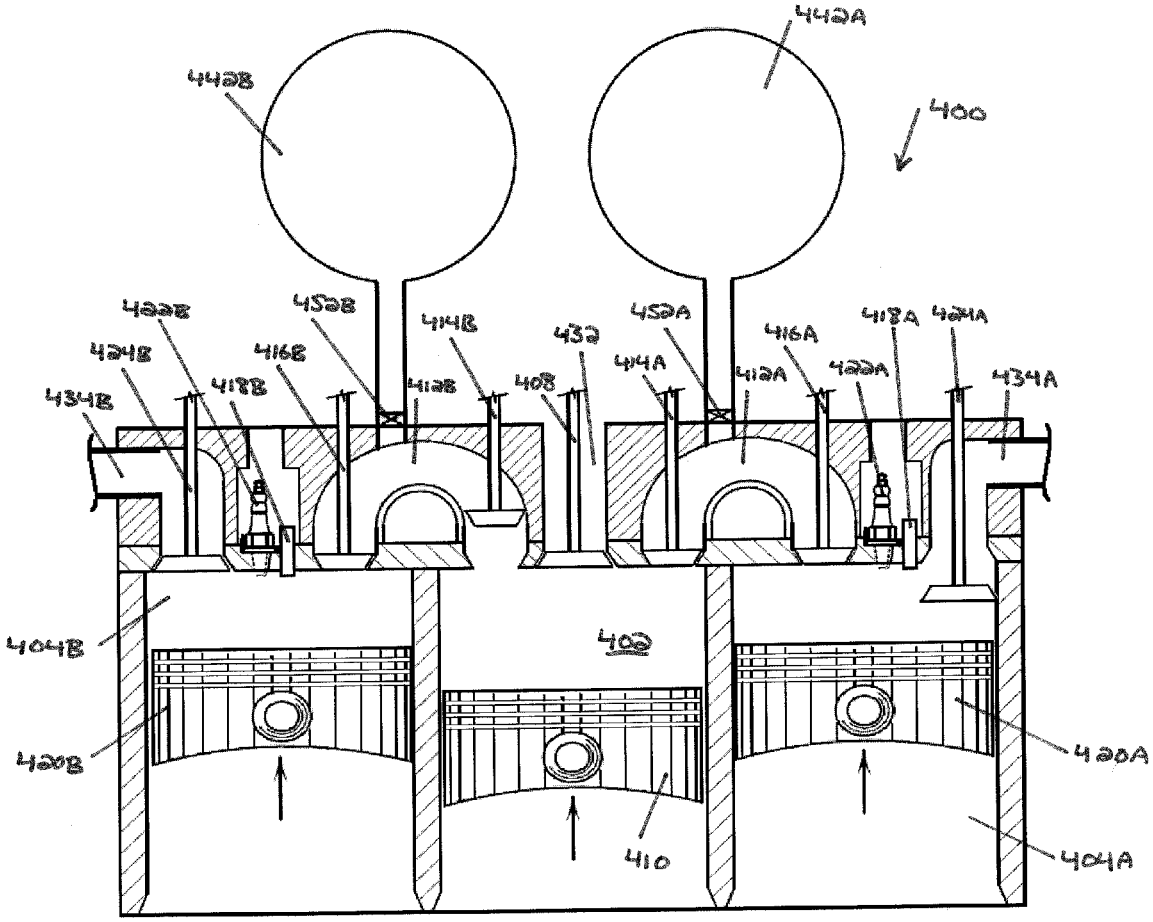

In FIG. 4K, the compression piston 410 continues its second compression stroke, compressing air contained in the compression cylinder 402. The second crossover compression valve 414B can be opened during the second compression stroke to allow air to be compressed into the second crossover passage 412B. The first expansion piston 420A continues to ascend in the primary exhaust stroke. The second expansion piston 420B continues its standby exhaust stroke, recovering the vacuum created during the previous standby expansion stroke.

Figure 4L:
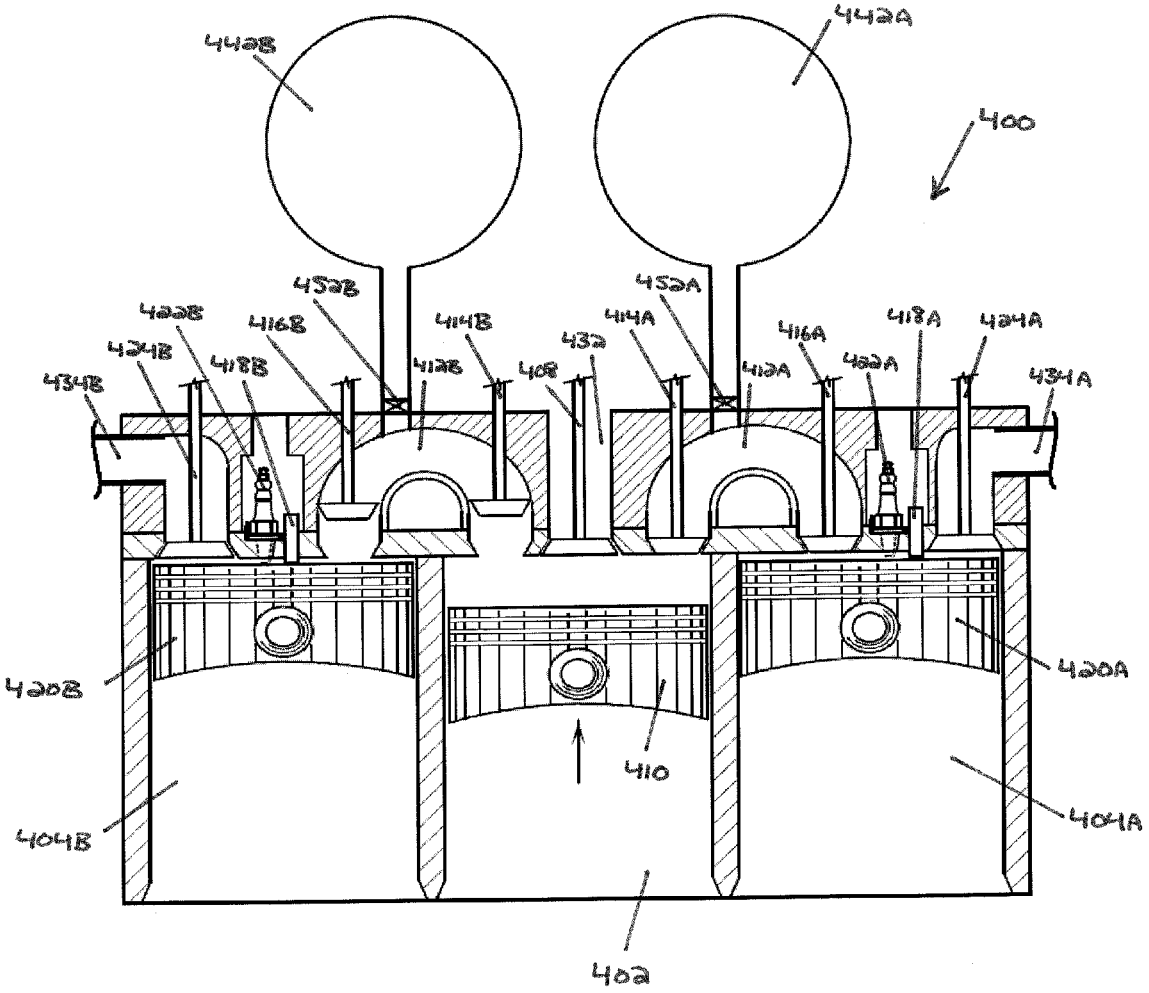

In FIG. 4L, the compression piston 410 continues to ascend, compressing air into the second crossover passage 412B through the open second crossover compression valve 414B. The first exhaust valve 424A is closed and the first expansion piston 420A reaches its TDC position, ending the primary exhaust stroke and beginning a new standby expansion stroke. The second expansion piston 420B reaches its TDC position, thereby ending the standby exhaust stroke and beginning a primary expansion stroke. The second crossover expansion valve 416B is opened momentarily as the second expansion piston 420B begins to descend in the primary expansion stroke, resulting in the push-pull gas transfer effect described above. As the second expansion piston 420B descends (i.e., after TDC of the second expansion piston 420B), the second spark plug 422B is fired to ignite the air-fuel mixture in the second expansion cylinder 404B and drive the second expansion piston 420B down in the primary expansion stroke to power the crankshaft and the load coupled to the engine 400. The second crossover expansion valve 416B can be closed before or after the second spark plug 422B is fired. Operation of the engine 400 then returns to the state shown in FIG. 4A and the cycle repeats. Thus, as noted above, the state shown in FIG. 4A can be described as the completion of the second rotation of the crankshaft and the start of a subsequent first rotation of the crankshaft.

In the illustrated embodiment, the exhaust valves 424A, 424B are closed during the standby expansion and standby exhaust strokes of their respective cylinders 404A, 404B to create a vacuum condition. As discussed above with respect to FIGS. 2A-2L, however, operation of the engine 400 can be modified such that the exhaust valves 424A, 424B open during at least a portion of the standby expansion strokes to allow air into the expansion cylinders and reduce the pressure differential between the expansion cylinders and their respective crossover passages.

In other embodiments, operation of the engine 400 can be modified as described above with respect to FIGS. 3A-3L such that the exhaust valves 424A, 424B are opened for the standby expansion strokes of their respective cylinders 404A, 404B and then closed part way through the standby exhaust strokes of their respective cylinders 404A, 404B to further cool said cylinders.

The compression cylinder 402 of the engine 400 can be downsized relative to the first and second expansion cylinders 404A, 404B to produce a Miller effect. Further details on the Miller effect in the context of split-cycle engines are available in U.S. Provisional Application No. 61/721,545, filed on Nov. 2, 2012, entitled "SPLIT-CYCLE DIRECT INJECTION ENGINE WITH ADVANCED MILLER CYCLE," the entire contents of which are hereby incorporated by reference herein. By reducing the volume of the compression cylinder 402 (e.g., to less than half the volume of the expansion cylinders 404A, 404B), the reduction in brake mean effective pressure (BMEP) of the engine 400 introduced by adding a third cylinder can be minimized.

In the illustrated embodiment, rather than wasting a standby intake and standby compression stroke idling the compression cylinder, the compression cylinder can be used to feed an expander on every rotation of the crankshaft. In particular, the compression cylinder feeds the first expansion cylinder during the first rotation of the crankshaft and feeds the second expansion cylinder during the second rotation of the crankshaft. The addition of the second expansion cylinder thus allows the compression cylinder to perform a true intake and compression stroke during each rotation of the crankshaft and allows the engine 400 to fire on every revolution of the crankshaft. The BMEP of the engine 400 can be reduced, however, by the addition of the third cylinder. But, if the compression cylinder 402 is downsized relative to the expansion cylinders 404A, 404B to achieve a Miller effect, the reduction in BMEP can be minimized. For example, if the compression cylinder is sized to be half the volume of the two expansion cylinders, the engine 400 would only include about 25% more cylinder volume than a conventional engine or a comparable prior art two-cylinder split-cycle engine without Millerization. The engine 400 produces two firing strokes every two revolutions of the crankshaft with effectively two-and-one-half cylinders. A conventional engine produces two firing strokes every two revolutions of the crankshaft with two cylinders. Thus, considering only volume, the BMEP of the engine 400 would be 20% (or 1-2/2.5) less than that of a conventional engine. However, the BMEP of the engine 400 (and split-cycle engines generally) is potentially very high due to extreme Millerization. Accordingly, even with a 20% BMEP reduction based on differing volumes, the engine 400 can actually meet or exceed the BMEP of most conventional engines.

The engine 400 can provide a number of advantages as compared with conventional engines and the prior art split-cycle engine 100 described above. For example, direct injection of fuel into the expansion cylinders 404A, 404B can improve the BMEP and efficiency of the engine 400. In addition, direct injection can reduce the chances of premature combustion or knocking, as the fuel is exposed to high temperature and high pressure conditions for a shorter amount of time than in alternative injection schemes. The knock resistance of the engine 400 is further enhanced by the vacuum condition that exists as the fuel is injected, as the lack of air in the expansion cylinders 404A, 404B during injection inhibits combustion. The engine 400 can thus have a high volumetric compression ratio in the expansion cylinders 404A, 404B without there being a concern of over-compression and detonation.

Another advantage is that the standby expansion and standby exhaust strokes provide a window of up to 360 degrees CA to inject fuel into the expansion cylinders 404A, 404B (as compared with about 30 degrees CA in the prior art split-cycle engine 100). The availability of extra time to inject the fuel can allow the fuel to be injected at lower pressures, while at the same time reducing the chances of a lean condition when the engine 400 is operating at full load. The fuel can also be injected at times when the expansion pistons 420A, 420B are relatively distant from their respective TDC positions, providing more space to spray and mix the fuel. By providing more time and space to inject the fuel, low-cost conventional fuel injectors can be used with the engine 400. The lower injection pressures can also allow the engine 400 to be used with low-pressure fuel sources, such as uncompressed natural gas. Natural gas is typically supplied from a gas utility through a service line pressurized to less than 60 psi. After passing through a gas meter, this supply is usually regulated to a pressure of less than about 0.25 psi. It is difficult if not impossible to operate prior art split-cycle engines using such a low-pressure supply without providing a pump or compressor to boost the fuel supply pressure. In the engine 400, the added time for injecting fuel coupled with the vacuum in the expansion cylinders 404A, 404B can allow the engine 400, and in particular the fuel injectors 418A, 418B, to be fed directly by a low pressure supply of natural gas (e.g., a supply that is less than about 60 psi, about 20 psi, about 5 psi, about 1 psi, about 0.5 psi, and/or about 0.25 psi). This can be advantageous particularly for stationary applications such as generators.

A further advantage of the engine 400 is that the standby expansion and standby exhaust strokes provide a window during which the expansion cylinders 404A, 404B can cool. In prior art split-cycle engines operating in normal firing mode, every stroke of the expansion piston involves either a combustion event or an exhaust event, both of which maintain the temperature of the expansion cylinder at a high level. By incorporating intermediate standby expansion and standby exhaust strokes, the expansion cylinders 404A, 404B can be allowed to cool between each combustion event.

As noted above and shown in the drawings, any of the engines 200, 300, 400, 500, 600, 800 disclosed herein can include one or more air tanks to allow the engine to operate in one or more air hybrid operating modes. The unique operating parameters of the engines 200, 300, 400, 500, 600, 800 disclosed herein can allow for several variations on the air hybrid modes available in the prior-art split-cycle engine 100 that may not be possible with said engine.

For example, when the engine 200 is operating in an NF mode as depicted in FIGS. 2A-2L, the intake valve 208 can be opened during the standby intake stroke to allow air to be drawn into the compression cylinder 202. During the subsequent standby compression stroke, the intake valve 208 can be closed and the crossover compression valve 214 and an air tank valve 252 can be opened to allow the compression piston 210 to compress the air disposed in the compression cylinder 202 into the air tank 242 for subsequent use in an AE or AEF mode. The same variation can be applied to the engine 300.

By way of further example, when the engine 200 is operating in an AC mode, the exhaust valve 224 can be opened during the standby expansion stroke to allow air to be drawn into the expansion cylinder 204. During the subsequent standby exhaust stroke, the exhaust valve 224 can be closed and the crossover expansion valve 216 and an air tank valve 252 can be opened to allow the expansion piston 220 to compress the air disposed in the expansion cylinder 204 into the air tank 242 for subsequent use in an AE or AEF mode. At the same time, or during other portions of the engine cycle, the crossover compression valve 214 can be opened to allow the compression piston 210 to compress air into the air tank 242. The same variation can be applied to the engine 300 and the engine 400. A further variation can be applied to the engine 400 in which both the first expansion piston 420A and the second expansion piston 420B are used to compress air into the air tank(s) 442A, 442B during their respective standby exhaust strokes.

It will be appreciated that a number of other air hybrid mode variations are possible with the engines 200, 300, 400, 500, 600, 800 disclosed herein.

Engine Configurations

FIGS. 5A-5E illustrate a number of exemplary configurations of split-cycle engines having three-cylinder functional or operative units (e.g., engines of the type described above with respect to FIGS. 4A-4L).

Figure 5A:
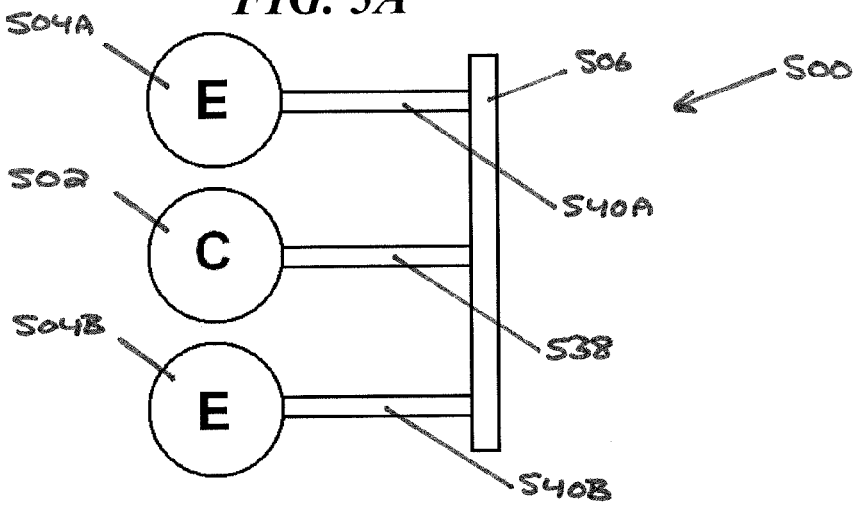
FIG. 5A is a schematic illustration of a three-cylinder, split-cycle engine in which the cylinders are arranged in an inline configuration.

A shown in FIG. 5A, an engine 500 can include a single operative unit that includes a compression cylinder 502, a first expansion cylinder 504A, and a second expansion cylinder 504B. The cylinders 502, 504A, 504B can be arranged in an inline configuration and can be coupled to the crankshaft 506 via respective connecting rods 538, 540A, 540B. The compression cylinder 502 can be arranged between the first and second expansion cylinders 504A, 504B as shown, or can be disposed at either end of the inline operative unit.

As shown in FIG. 5B-5E, an engine 500 can also be arranged in a boxer or V configuration. Specifically, the compression cylinder, the first expansion cylinder, and the second expansion cylinder can be arranged in a boxer or V configuration. Further details on V-shaped split-cycle engines can be found in U.S. Publication No. 2012/0080017, filed on Sep. 29, 2011, entitled "SPLIT-CYCLE AIR HYBRID V-ENGINE," the entire contents of which are hereby incorporated by reference herein.

Figure 5B:
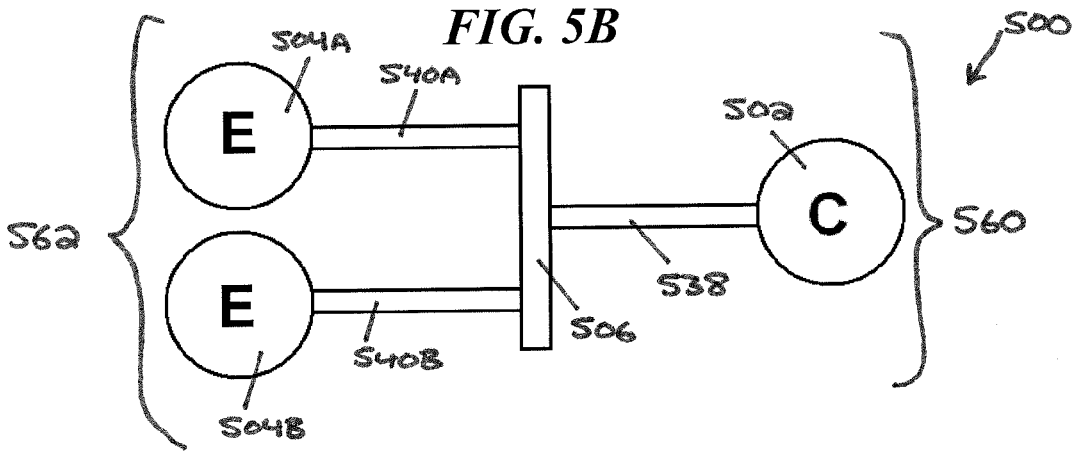
FIG. 5B is a schematic illustration of a three-cylinder, split-cycle engine in which the cylinders are arranged in a boxer or V configuration.

In FIG. 5B, the compression cylinder 502 is arranged in a first cylinder bank 560 of the engine 500 and the first and second expansion cylinders 504A, 504B are arranged in a second cylinder bank 562 of the engine.

Figure 5C:
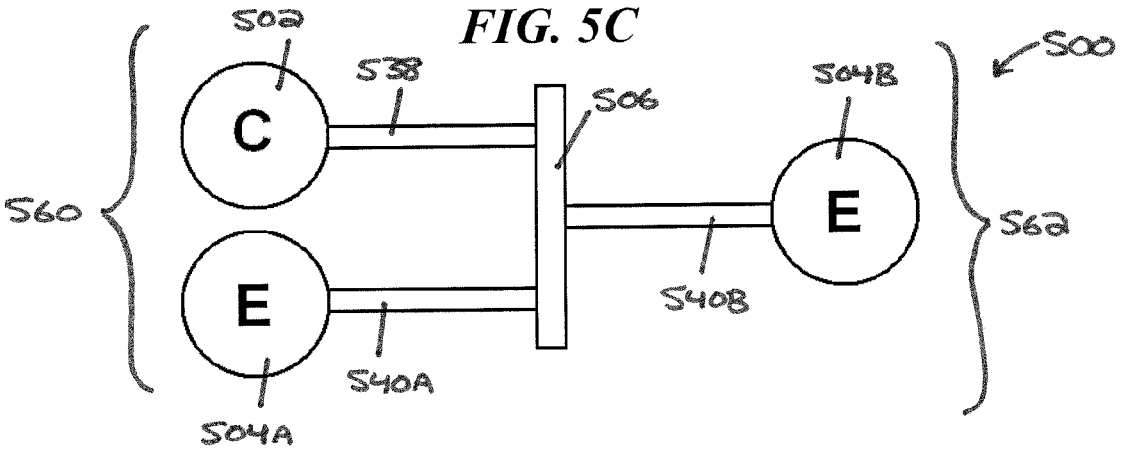
FIG. 5C is a schematic illustration of another three-cylinder, split-cycle engine in which the cylinders are arranged in a boxer or V configuration.

In FIG. 5C, the compression cylinder 502 and the first expansion cylinder 504A are arranged in a first cylinder bank 560 of the engine 500 and the second expansion cylinder 504B is arranged in a second cylinder bank 562 of the engine. It will be appreciated that, in other embodiments, the compression cylinder and the second expansion cylinder can be arranged in a first cylinder bank of the engine and the first expansion cylinder can be arranged in a second cylinder bank of the engine.

Figure 5D:
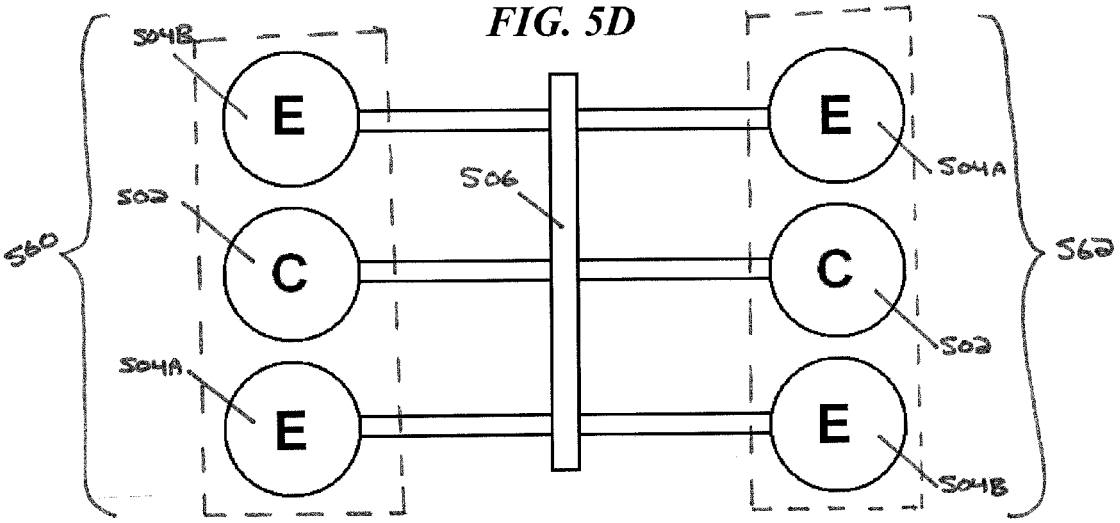
FIG. 5D is a schematic illustration of a split-cycle engine having first and second three-cylinder operative units.

In FIG. 5D, the engine 500 comprises first and second operative units (delineated by dashed lines), each operative unit including its own respective compression cylinder 502, first expansion cylinder 504A, and second expansion cylinder 504B. The first operative unit is arranged in a first cylinder bank 560 of the engine 500 and the second operative unit is arranged in a second cylinder bank 562 of the engine.

Figure 5E:
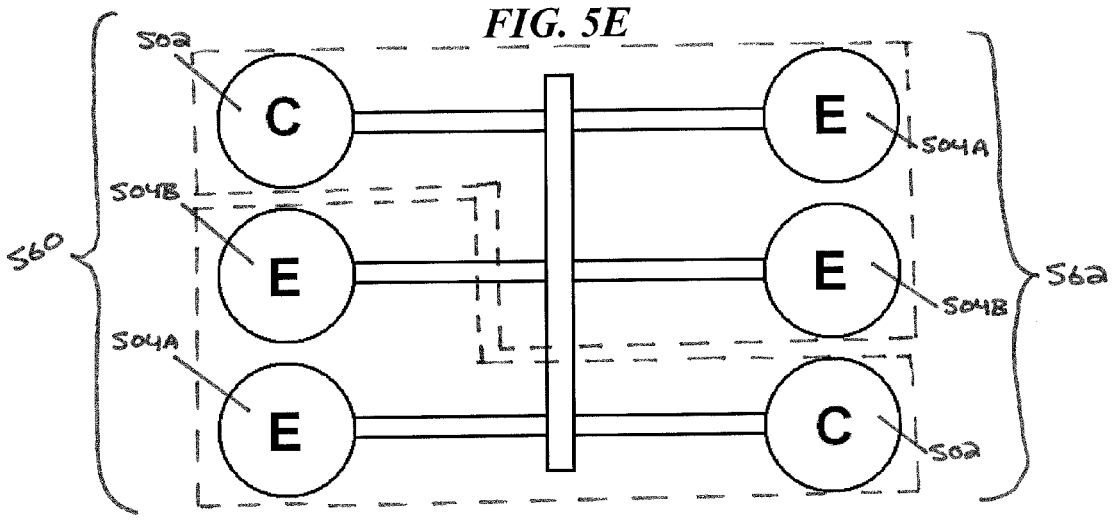
FIG. 5E is a schematic illustration of another split-cycle engine having first and second three-cylinder operative units.

In FIG. 5E, the engine 500 comprises first and second operative units (delineated by dashed lines), each operative unit including its own respective compression cylinder 502, first expansion cylinder 504A, and second expansion cylinder 504B. The compression cylinder of the first operative unit is arranged in a first cylinder bank 560 of the engine 500 with the first and second expansion cylinders of the second operative unit. The compression cylinder of the second operative unit is arranged in a second cylinder bank 562 of the engine with the first and second expansion cylinders of the first operative unit.

It will be appreciated that various other cylinder arrangements and permutations are possible in accordance with the teachings herein.

Two-Stroke Expansion Cylinder with Trapped Residuals

FIGS. 6A-6F illustrate another exemplary embodiment of a split-cycle engine 600. Except as indicated below, the structure of the engine 600 is substantially the same as that of the engine 100 described above, and therefore a detailed explanation of said structure is omitted here for the sake of brevity.

The engine 600 is operable in a normal firing mode in which one rotation of the engine 600 is required to complete one cycle. The compression cylinder 602 can be described as operating in a two-stroke mode that includes an intake stroke and a compression stroke. The expansion cylinder 604 can be described as operating in a two-stroke mode that includes an expansion stroke and an exhaust/fuel injection stroke. In this normal firing mode, a firing stroke is performed in the expansion cylinder 604 on every rotation of the crankshaft. Fuel can be injected directly into the expansion cylinder 604 during a portion of the exhaust stroke over a period of time greater than what is possible with traditional split-cycle engines. In the engine 600, the exhaust valve 624 is closed during part of the exhaust stroke to allow fuel to be injected directly into the expansion cylinder 604 during that part of the exhaust stroke.

The engine 600 includes at least one direct injection fuel injector 618 configured to inject fuel directly into the expansion cylinder 604. In other words, the outlet of the fuel injector 618 is disposed within the expansion cylinder 604 such that injected fuel flows into the expansion cylinder 604 without first travelling through the crossover passage 612. In addition, the engine 600 includes a valve train, valve actuation system, and/or engine controller that is/are configured to actuate the engine valves, inject fuel, and fire the spark plug 622 according to an operating cycle that differs from that of the engine 100 described above.

An exemplary embodiment of this operating cycle is as follows. (1) Spark ignition occurs, igniting an air-fuel mixture and driving the expansion piston 620 down in the expansion stroke. (2) The exhaust valve opens near BDC of the expansion piston 620 and exhaust gases are flushed from the expansion cylinder 604 during a first portion of the exhaust stroke. (3) The exhaust valve is closed early (e.g., near the middle of the exhaust stroke or about 60 degrees CA before the expansion piston 620 reaches TDC), trapping a quantity of residual combustion gases in the expansion cylinder 604. (4) Direct injection of fuel into the expansion cylinder can begin as soon as the exhaust valve 624 closes (e.g., to create a rich condition within the expansion cylinder to reduce or prevent premature detonation). (5) The crossover expansion valve 616 opens, adding air to the fuel in the expansion cylinder. (6) The cycle returns to step (1) above, before or after closing the crossover expansion valve 616.

An exemplary embodiment of this operating cycle is described in detail below with respect to FIGS. 6A-6F, which depict sequential snapshots of engine operation over one rotation of the crankshaft.

In the illustrated embodiment, the expansion piston 620 leads the compression piston 610 (e.g., by approximately 10-30 degrees CA) throughout the engine cycle, such that each stroke of the expansion piston 620 begins slightly before the counterpart stroke of the compression piston 610. For convenience of description, strokes of the compression piston 610 are sometimes referred to herein as occurring simultaneously with counterpart strokes of the expansion piston 620. It will be appreciated, however, that the expansion piston strokes begin and end slightly before the compression piston strokes begin and end. By the same token, two consecutive strokes of the compression piston 610 and the two counterpart strokes of the expansion piston 620 are sometimes referred to herein as occurring during a single rotation of the crankshaft. It will be appreciated, however, that a portion of one stroke extends into another rotation of the crankshaft, due to the offset timing of the compression and expansion pistons 610, 620. With this in mind, the engine state shown in FIG. 6A can be described as the start of a first rotation of the crankshaft and the end of the first rotation of the crankshaft. In a normal firing mode of operation, the engine 600 continuously executes the first rotation.

Figure 6A:
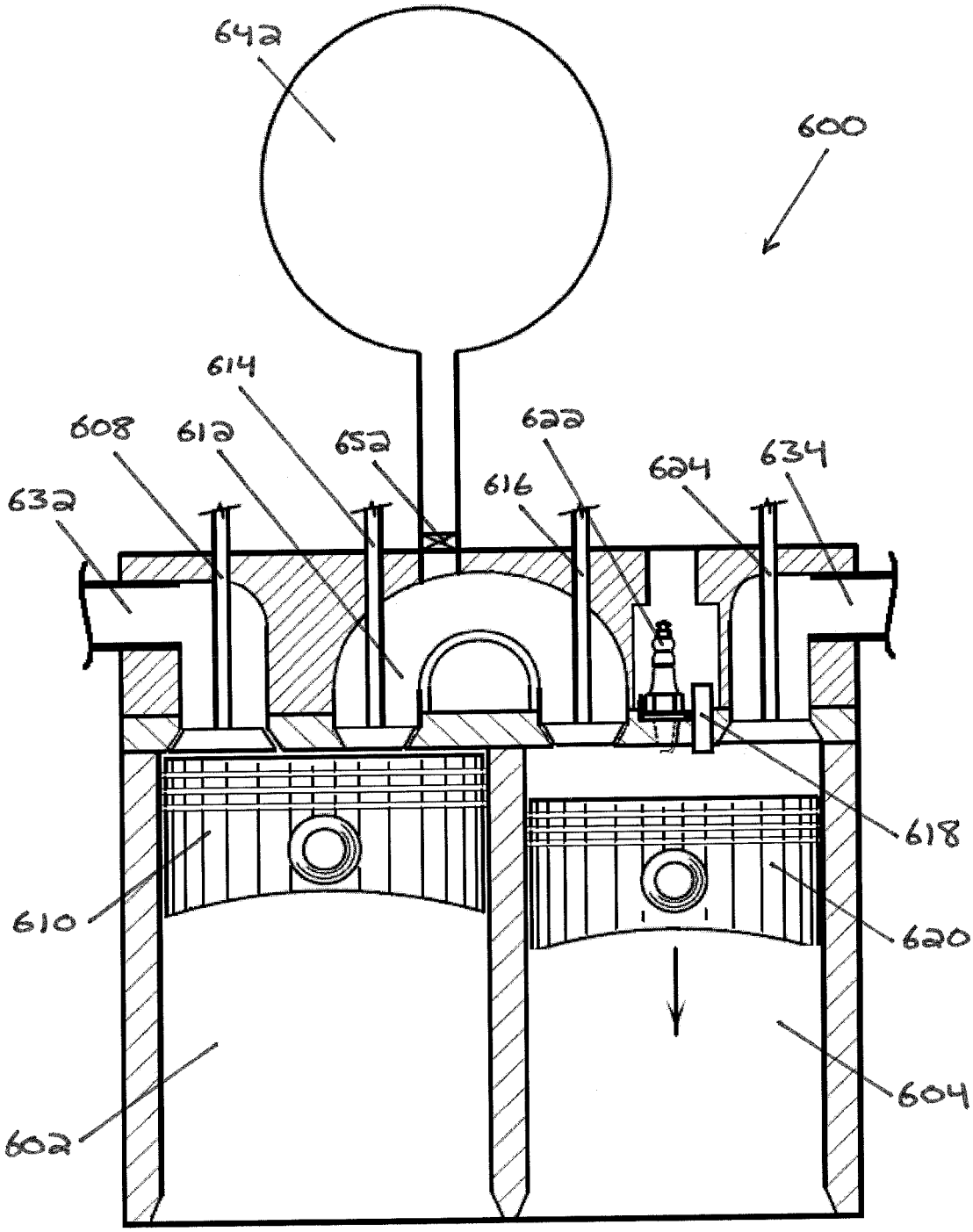
FIGS. 6A-6F are sequential, schematic illustrations of the operation of another exemplary embodiment of a split-cycle engine over one rotation of a crankshaft.

In FIG. 6A, the compression piston 610 is shown at its TDC position, at the end of the compression stroke and the beginning of the intake stroke. The expansion piston 620 is shown descending in the expansion stroke.

Figure 6B:
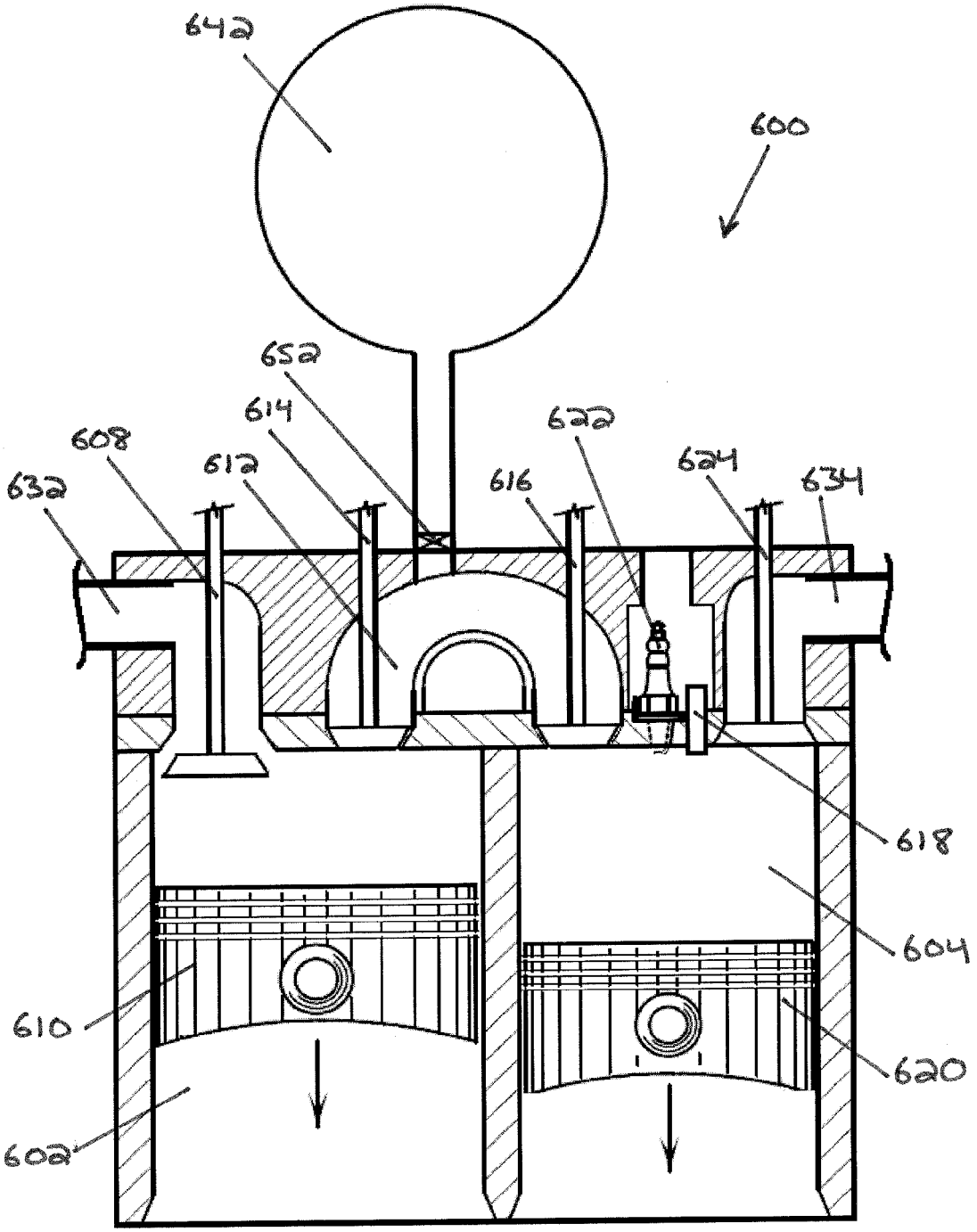

In FIG. 6B, the compression piston 610 descends within the compression cylinder 602 in the intake stroke. The intake valve 608 is open during the intake stroke such that air is drawn through the intake port 632 and into the compression cylinder 602. The crossover compression valve 614 can be closed to prevent any air that may be disposed in the crossover passage 612 from flowing back into the compression cylinder 602. The expansion piston 620 continues to descend within the expansion cylinder 604 in the expansion stroke.

Figure 6C:
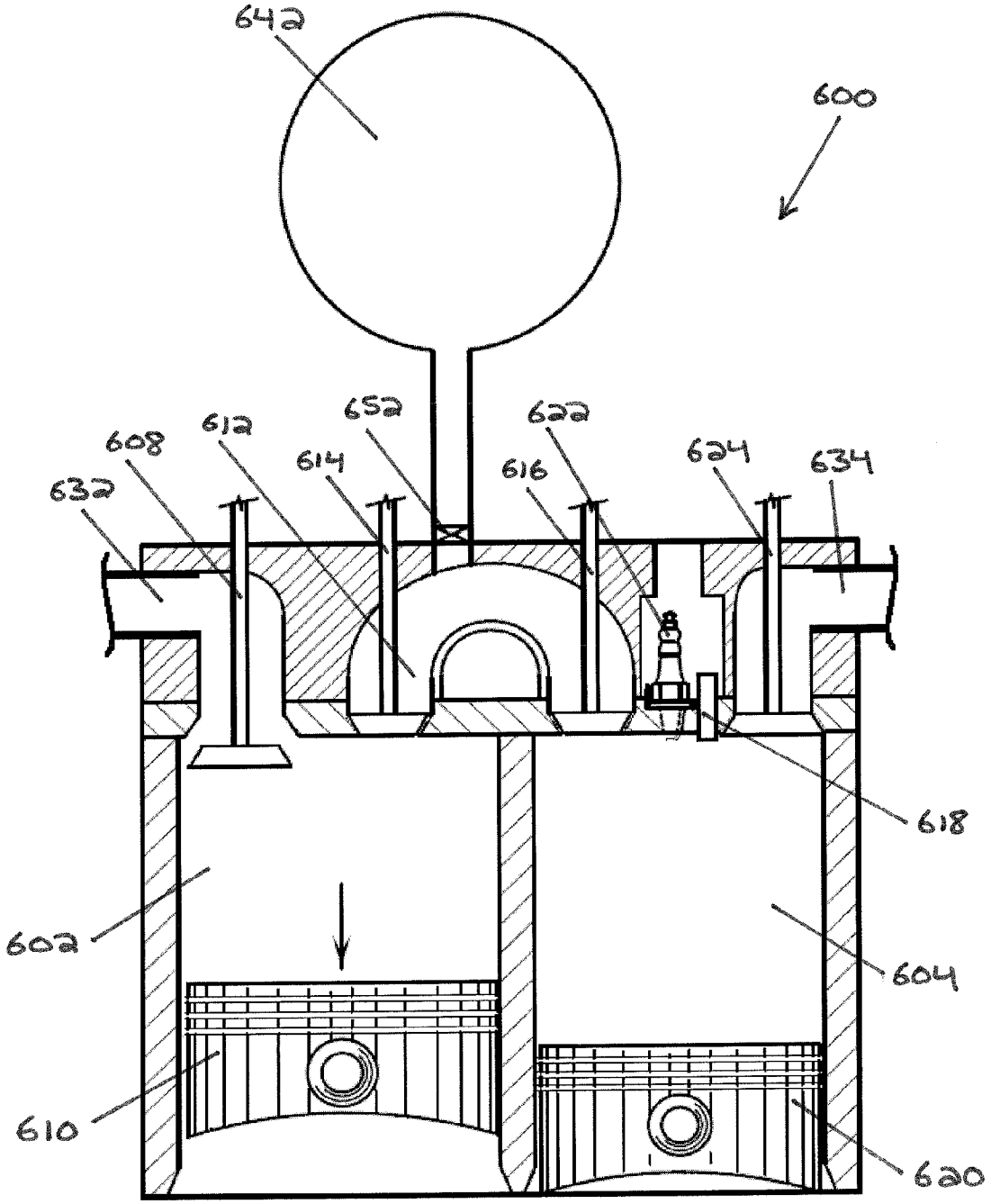

In FIG. 6C, the compression piston 610 continues its intake stroke, drawing in air from the intake port 632 as it descends in the compression cylinder 602. The expansion piston 620 reaches its BDC position, thereby ending the expansion stroke and beginning the exhaust stroke.

Figure 6D:
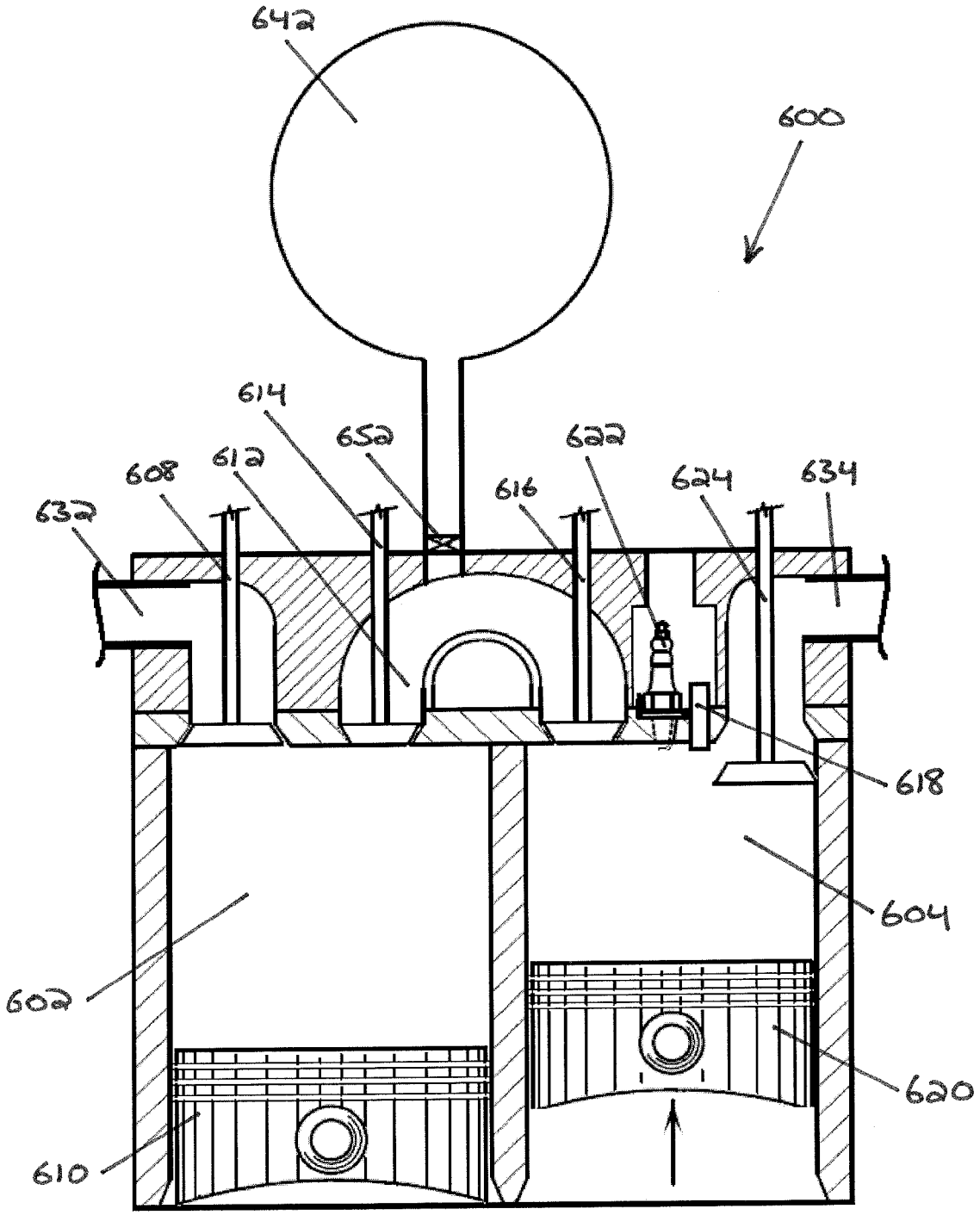

In FIG. 6D, the compression piston 610 reaches its BDC position, thereby ending the intake stroke and beginning the compression stroke. The expansion piston 620 ascends during the exhaust stroke while the crossover expansion valve 616 remains closed. The exhaust valve 624 is open during a first portion of the exhaust stroke, such that the ascending expansion piston 620 forces combustion gases out through the exhaust valve 624 and the exhaust port 634.

Figure 6E:
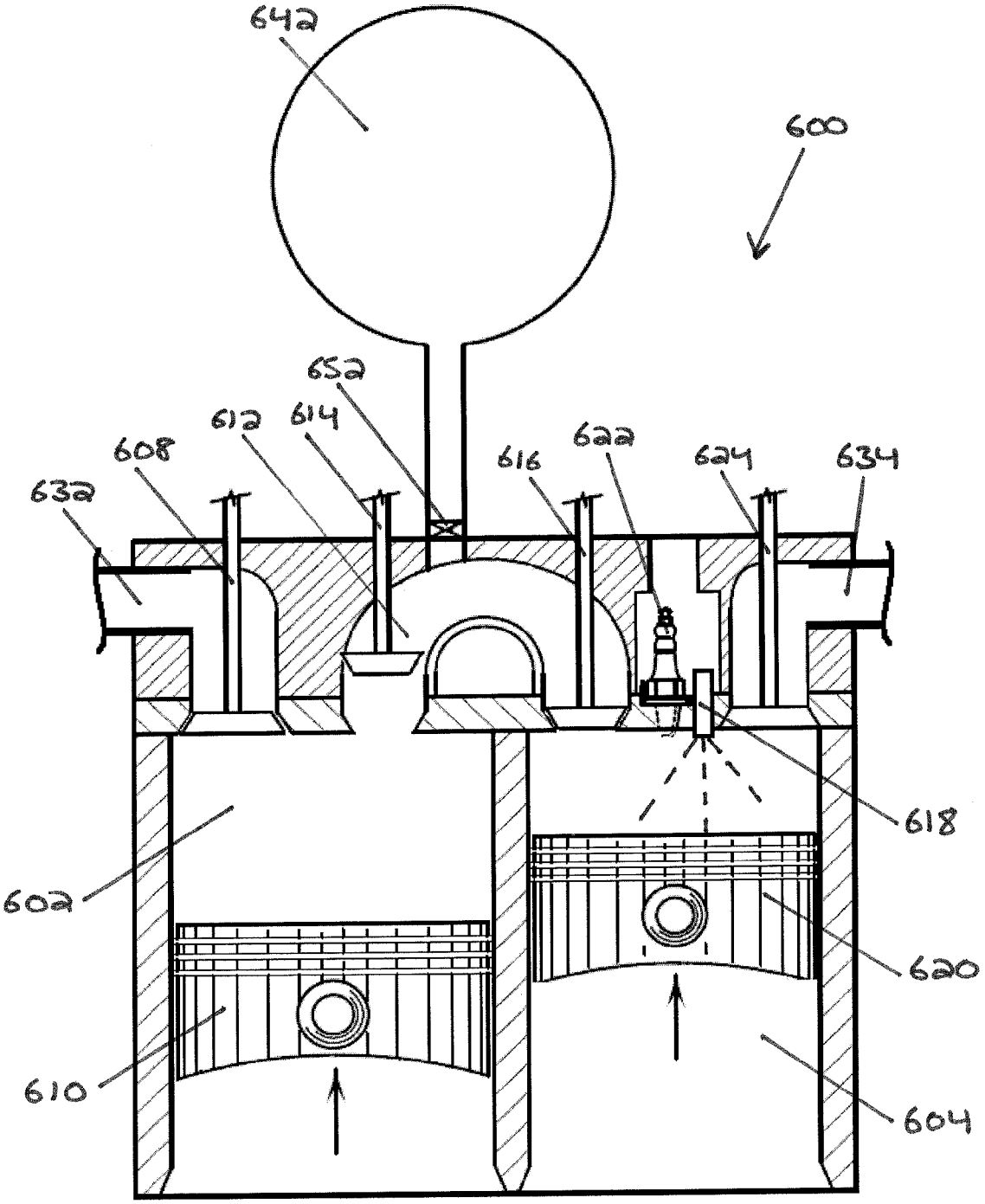

In FIG. 6E, the compression piston 610 continues its compression stroke, compressing air contained in the compression cylinder 602. The crossover compression valve 614 can be opened during the compression stroke to allow air to be compressed into the crossover passage 612. The expansion piston 620 continues its exhaust stroke. The exhaust valve 624 is closed during this second portion of the exhaust stroke. The crossover expansion valve 616 is also closed, effectively sealing the expansion cylinder 604 with some amount of residual combustion gases disposed therein. Fuel can be injected directly into the expansion cylinder 604 during this second portion of the exhaust stroke (e.g., immediately after the exhaust valve 624 is closed, 30-60 degrees CA before the expansion piston 620 reaches TDC, or at some other timing).

Figure 6F:
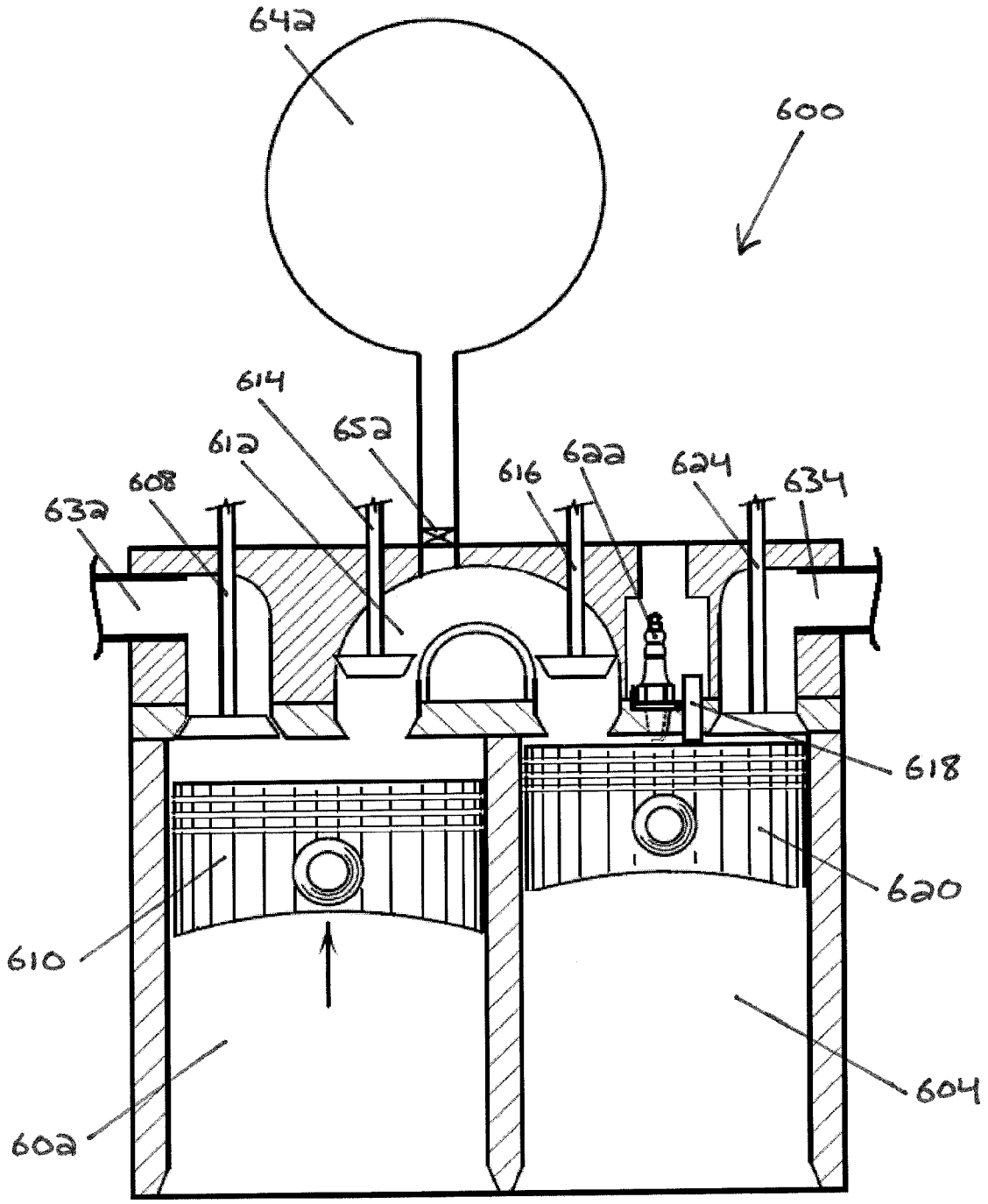

In FIG. 6F, the compression piston 610 continues to ascend, compressing air into the crossover passage 612 through the open crossover compression valve 614. The expansion piston 620 reaches its TDC position, thereby ending the exhaust stroke and beginning the expansion stroke. The crossover expansion valve 616 is opened momentarily as the expansion piston 620 begins to descend in the expansion stroke, resulting in the push-pull gas transfer effect described above. As the expansion piston 620 descends (i.e., after TDC of the expansion piston 620), the spark plug 622 is fired to ignite the air-fuel mixture in the expansion cylinder 604 and drive the expansion piston 620 down in the expansion stroke to power the crankshaft and the load coupled to the engine 600. The crossover expansion valve 616 is closed before or after the spark plug 622 is fired. Operation of the engine 600 then returns to the state shown in FIG. 6A and the cycle repeats.

In the illustrated embodiment, the exhaust valve 624 is closed for at least a portion of the exhaust stroke. Preferably, the exhaust valve 624 is closed for about half of the exhaust stroke. Closing the exhaust valve 624 during this time provides a window during which fuel can be injected into the expansion cylinder 604 without risking blow-through of the fuel out the exhaust port 634.

The compression cylinder 602 of the engine 600 can be downsized relative to the expansion cylinder 604 to produce a Miller effect, as described above. The engine 600 can provide some or all of the advantages described above with respect to the engines 100, 200, and 300.

Four-Stroke Expansion Cylinder with Trapped Residuals

In some embodiments, a split-cycle engine is provided that is operable in a normal firing mode in which two rotations of the engine are required to complete one cycle. The compression cylinder can be described as operating in a four-stroke mode that includes a primary intake stroke, a primary compression stroke, a standby intake stroke, and a standby compression stroke. The expansion cylinder can be described as operating in a four-stroke mode that includes a primary expansion stroke, a primary exhaust stroke, a standby expansion stroke, and a standby exhaust stroke. In this normal firing mode, a firing stroke is performed in the expansion cylinder on every other rotation of the crankshaft. Fuel can be injected directly into the expansion cylinder during a portion of the non-firing revolution over a period of time greater than what is possible with traditional split-cycle engines. The exhaust valve can be in a closed position during a later part of the primary exhaust stroke to trap and compress combustion residuals in the expansion cylinder. The exhaust valve can remain closed during the standby expansion and standby exhaust strokes, during at least a portion of which strokes fuel is injected directly into the residuals trapped in the expansion cylinder.

An exemplary embodiment of an operating cycle that involves four-stroke expansion cylinder operation with trapped residuals is as follows. (1) Typical or near typical Scuderi split-cycle engine spark ignition occurs (e.g., near TDC of the expansion piston, and/or as described above with respect to the typical Scuderi split-cycle engine of FIG. 1), igniting an air-fuel mixture and driving the expansion piston down in the primary expansion stroke. In some embodiments, "near TDC" refers to a range from about 15 degrees CA before TDC to about 15 degrees CA after TDC. (2) The exhaust valve opens near BDC of the expansion piston (e.g., within about 10 degrees CA before BDC) and exhaust gases are flushed from the expansion cylinder during a first portion of the primary exhaust stroke. (3) The exhaust valve is closed early (e.g., about 60 degrees CA before the expansion piston reaches TDC), trapping a quantity of residual combustion gases in the expansion cylinder during a later portion of the primary exhaust stroke. (4) The primary exhaust stroke completes with compression of the trapped residuals. (5) The standby expansion stroke begins with expansion of the trapped residuals. (6) Direct injection of fuel into the expansion cylinder occurs before and/or after the expansion piston reaches BDC. (7) Typical-to-early Scuderi split-cycle engine crossover expansion valve opening (e.g., near or before TDC of the expansion piston, for example, within about 15 degrees CA before TDC) occurs to supply a charge of air from the crossover passage. (8) Typical-to-early Scuderi split-cycle engine crossover expansion valve closing (e.g., near TDC of the expansion piston, for example, within about 15 degrees CA after TDC) occurs. (9) The cycle returns to step (1) above.

In some of the engines described herein, some amount of air or residual combustion gases can be disposed in the expansion cylinder during the direct fuel injection event. This advantageously provides some resistance to the incoming fuel (as compared with a vacuum condition in the expansion cylinder), which helps prevent the fuel from wetting the cylinder walls and over-penetrating upon injection. The presence of air or other gases in the expansion cylinder also promotes better convective cooling because there is some density to the cylinder contents, and reduces the tendency for oil to be pumped or sucked past the piston rings. Where the air is supplied from a source of cool intake air or from a source of high-density crossover passage air, cooling of the expansion cylinder can be further improved.

In any of the engines described herein, the amount of fuel injected directly into the expansion cylinder can vary. For example, in some embodiments, enough fuel can be injected into the cylinder to create a "rich" environment within the expansion cylinder until the crossover expansion valve opens to supply additional air for combustion. A "rich" environment can be one in which the ratio of air to fuel is appreciably below the stoichiometric ratio, or appreciably below what would typically be called for under the current load condition. In some embodiments, a "rich" condition is one in which the ratio of air to fuel is less than about 14:1, less than about 12:1, less than about 10:1, and/or less than about 7:1. By making the environment in the expansion cylinder rich until combustion is to occur, the risk of premature detonation is reduced or eliminated. In other embodiments, a comparatively small amount of fuel can be injected into the cylinder to create a "lean" environment within the expansion cylinder until the crossover expansion valve opens to supply additional air for combustion and the fuel injector supplies additional fuel. A "lean" environment can be one in which the ratio of air to fuel is appreciably above the stoichiometric ratio, or appreciably above what would typically be called for under the current load condition. In some embodiments, a "lean" condition is one in which the ratio of air to fuel is greater than about 14:1, greater than about 18:1, greater than about 20:1, and/or greater than about 24:1. By making the environment in the expansion cylinder lean until combustion is to occur, the risk of premature detonation is reduced or eliminated.

It will be appreciated that an engine can be configured to operate according to more than one of the cycles disclosed herein. For example, an engine can be configured to switch between two or more of said cycles based on various operating parameters, such as engine load, engine speed, engine temperature, and so forth. In some embodiments, switching between cycles on the fly is achieved by changing the valve and/or spark timing of the engine using a variable valve actuation system and/or an electronic ignition control system.

For example, an engine can be configured to switch between the "two-stroke expansion cylinder with trapped residuals" and "four-stroke expansion cylinder with trapped residuals" cycles disclosed above based on engine load. In the two-stroke cycle, the engine produces relatively high torque (e.g., about 30 bar BMEP "Brake Mean Effective Pressure" at full load) and operates at relatively high efficiency (e.g., about 210 BSFC "Brake Specific Fuel Consumption" at full load). In the four-stroke cycle, the engine produces relatively lower torque (e.g., about 15 bar BMEP at full load) and operates at relatively lower efficiency (e.g., about 240 BSFC at full load). Under part-load conditions, however, the efficiency of the four-stroke cycle can exceed that of the two-stroke cycle. In particular, for a given load demand at which both the two-stroke cycle and the four-stroke cycle are capable of producing the required output, it is more efficient to use the four-stroke cycle, since the engine would be operating closer to its maximum output than if the two-stroke cycle were used. In other words, the four-stroke cycle is more efficient at full capacity than the two-stroke cycle at part capacity. Efficiency gains can thus be achieved by operating the engine according to the two-stroke cycle under medium to high load conditions (e.g., when greater than about 15 bar BMEP is needed) and switching to the four-stroke cycle under low to medium load conditions (e.g., when less than or equal to about 15 bar BMEP is needed). Engines in which multiple operating cycles can be used interchangeably can thus produce a net improvement in efficiency as compared with traditional split-cycle engines. The engine can also be sized according to the two-stroke cycle output to achieve the desired maximum output using the smallest possible displacement.

By way of further example, the engine can be configured to switch between the two-stroke cycle and the four-stroke cycle based on engine temperature. While the two-stroke cycle produces higher BMEP than the four-stroke cycle, it also produces additional heat, which may not be suitable for continuous operation in some applications. Accordingly, the engine can switch to the four-stroke cycle when the engine temperature is above a predetermined threshold.

In some embodiments, the engine includes multiple operative units (e.g., a first compressor/expander cylinder pair and a second compressor/expander cylinder pair). The engine is initially configured such that the first operative unit runs a two-stroke cycle while the second operative unit runs a four-stroke cycle. When the temperature in the first operative unit exceeds a predetermined threshold, the first operative unit switches to four-stroke operation and the second operative unit switches to two-stroke operation. The operative units continually alternate according to the temperature in each unit, thereby providing improved torque and efficiency without excess heat issues.

Diesel Engines with Trapped Residuals

Figure 8:
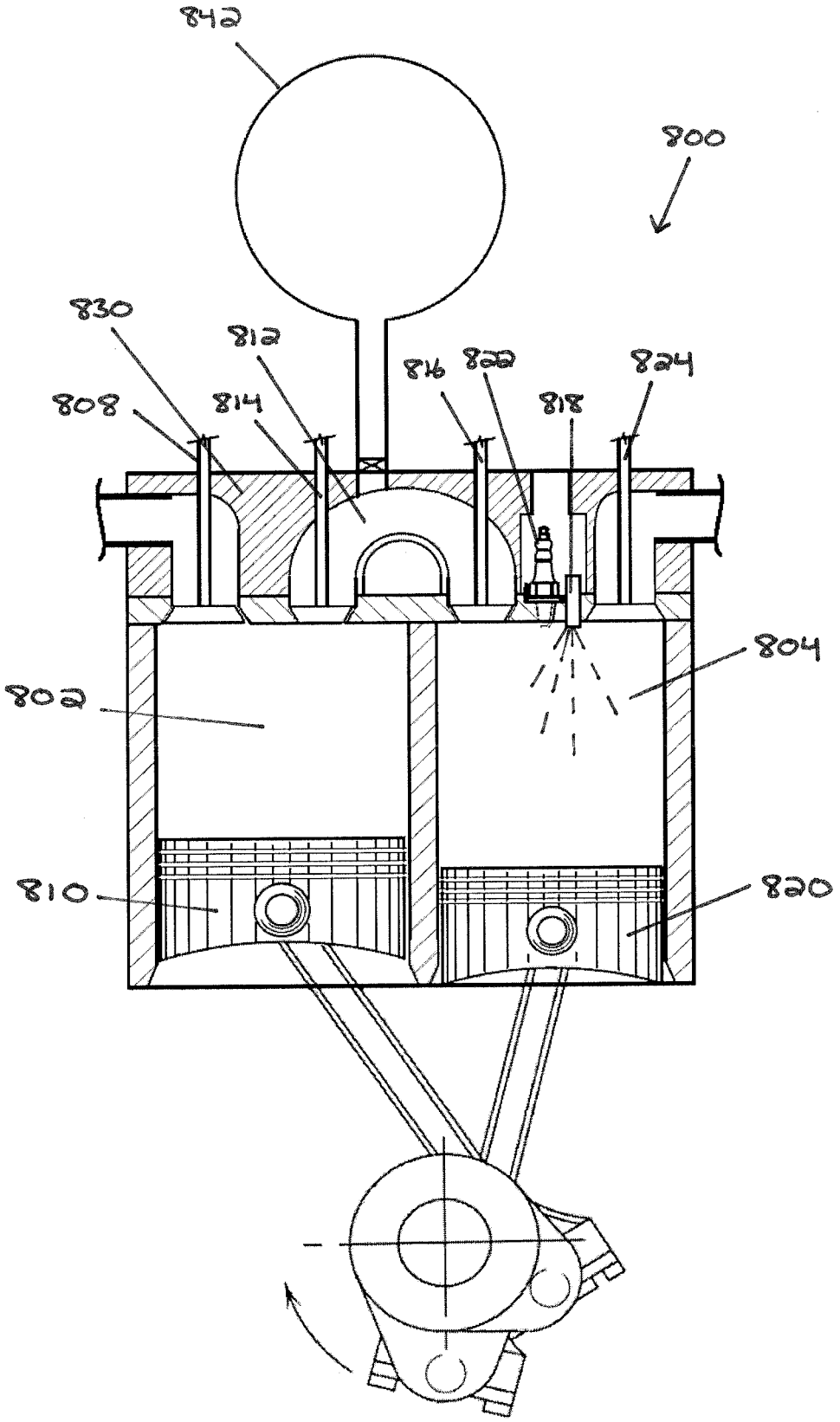
FIG. 8 is a schematic cross-sectional view of another exemplary embodiment of an air hybrid split-cycle engine.

FIG. 8 illustrates another exemplary embodiment of a split-cycle engine 800. Except as indicated below, the structure of the engine 800 is substantially the same as that of the engine 100 described above, and therefore a detailed explanation of said structure is omitted here for the sake of brevity.

In the engine 800, the exhaust valve 824 closes early during the exhaust stroke, trapping residual combustion gases in the power cylinder 804, effectively producing internal exhaust gas recirculation (EGR). The trapped residuals are then compressed during the remaining upward stroke of the power piston 820 with the XovrE valve(s) 816 and the exhaust valve 824 closed until the XovrE valve(s) open and air is supplied to the expander cylinder (e.g., near the end of the upward stroke). Fuel injection (e.g., diesel fuel) takes place directly into the power cylinder 804 via a direct injection fuel injector 818 after (or in some embodiments slightly before) the closing of the XovrE valve(s) 816. The fuel is injected at a rate shaped to control the rate of combustion for optimal emissions and power. It will be appreciated that, in embodiments in which diesel fuel is used, the spark plug 822 can be omitted or can be replaced with an alternative device, such as a glow plug.

By trapping residual gases as described above, the engine 800 can be sized and configured to have a lower geometric compression ratio in the power cylinder 804 for the same peak cylinder pressure, which provides more space for the injection and subsequent mixing of fuel. With the addition of residual gases and subsequent slowing of combustion and thermal inertia of residual gas molecules, the tendency for nitrous oxide (NOx) formation is reduced, thereby reducing NOx exhaust emissions. In addition, the rapid expansion in the power cylinder 804 produces more of an even pressure and temperature during combustion, reducing tendency for NOx formation.

The XovrE port is designed such that flow through the XovrE valve 816 produces turbulent eddies just before injection and combustion, which can improve fuel-air mixing and distribute the combustion for more rapid and thorough complete combustion, improving power and minimizing hydrocarbon, carbon monoxide, and particulate emissions. With the higher pressure from the residuals prior to XovrE valve(s) 816 opening, there is a lower pressure drop and reduced flow pumping loss as the valve(s) open.

Direct injection into the power cylinder 804 also makes the engine 800 highly conducive to air hybrid operation in which compressed air is taken from the crossover passage(s) 812, stored in an air tank 842, and returned to the crossover passages(s) as needed, with several modes of operation, as described in the references incorporated herein. Air hybrid operation provides improvements in the overall drive cycle efficiency and fuel economy of the engine 800. In addition, the engine 800 provides an attractive alternative to current electric hybrid vehicle designs, with the potential for lower cost and weight and less hazardous operation.

As noted above, the retention of residuals allows for the engine 800 to be sized with additional clearance space in the expansion cylinder 804 at top dead center of the expansion piston 820, which provides additional space in the expansion cylinder near top dead center for fuel injection and mixing, while maintaining the same or similar compression pressures as engines with smaller clearance space and no trapped residuals.

The engine 800 can also include a variable valve actuation system (e.g., of the type described in the references incorporated herein) for providing variable closing timing of the exhaust valve 824. This allows the amount of trapped residuals to be regulated to achieve the target pressure and temperature at the start of combustion, which can help ensure that enough compression pressure and temperature to rapidly begin compression ignition and combustion is present (e.g., when using diesel fuel), particularly at low engine loads and/or low turbocharger boost pressures. In other words, the exhaust valve closing timing can be varied based on engine speed, engine load, and/or various other factors to optimize mixing and combustion. In addition, due to the unique XovrE valve 816 flow, the combustion chamber shape can differ from that of a conventional four-stroke engine to optimize mixing and combustion.

An exemplary embodiment of an operating cycle of the engine 800 when diesel fuel is used is as follows. (1) Typical or near-typical Scuderi split-cycle engine compression ignition occurs (e.g., near TDC of the expansion piston 820, and/or as described above with respect to the typical Scuderi split-cycle engine of FIG. 1), igniting an air-fuel mixture and driving the expansion piston 820 down in the expansion stroke. In some embodiments, "near TDC" refers to a range from about 15 degrees CA before TDC to about 15 degrees CA after TDC. (2) The exhaust valve 824 opens near BDC of the expansion piston 820 (e.g., within about 10 degrees CA before BDC) and exhaust gases are flushed from the expansion cylinder 804 during a first portion of the exhaust stroke. (3) The exhaust valve 824 is closed early (e.g., about 60 degrees CA before the expansion piston 820 reaches TDC) trapping a quantity of residual combustion gases in the expansion cylinder 804 during a later portion of the exhaust stroke. (4) Typical-to-early Scuderi split-cycle engine crossover expansion valve 816 opening (e.g., near or before TDC of the expansion piston, for example, within about 30 degrees CA before TDC and, preferably, within about 15 degrees CA before TDC) occurs to supply a charge of air from the crossover passage 812. (5) Typical-to-early Scuderi split-cycle engine crossover expansion valve 816 closing occurs. (6) Direct injection of fuel into the expansion cylinder 804 occurs into the trapped residuals after closing of the crossover expansion valve 816. In some embodiments, fuel injection begins before closing of the crossover expansion valve, in which case the fuel injection can be completed before the crossover expansion valve closes, or the fuel injection can continue for a period of time after the crossover expansion valve closes. (7) The cycle returns to step (1) above and repeats.

In the above operating cycle, a supply of air for supporting combustion is supplied to the expansion cylinder before the fuel is injected. This sequence, which is facilitated by the unique parameters of the engine 800 discussed above, can advantageously reduce the tendency for the fuel to pre-ignite, particularly in the case of diesel fuel.

In one or more of the engines described herein, many of the advantages provided arise from the operation of the expansion portion of the engine. Accordingly, while operation of the compression portion of the engine is described in many embodiments, it will be appreciated that this description is merely provided as an example, and that the engines disclosed herein can operate with compressed air supplied to the crossover passage using any of a variety of structures, devices, or operating cycles.

Figure 9:
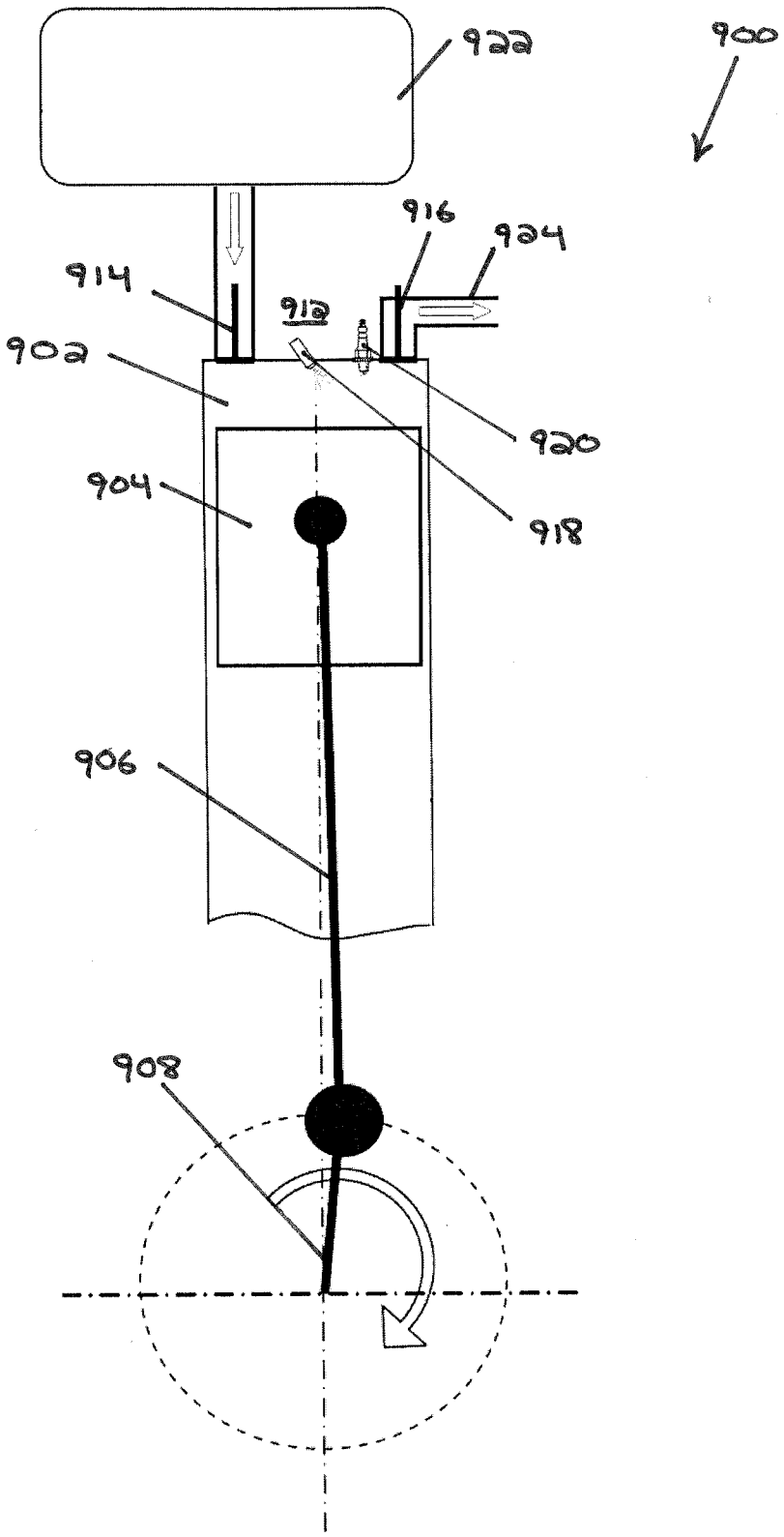
FIG. 9 is a schematic cross-sectional view of an exemplary embodiment of an expander system.

For example, as shown in FIG. 9, an expander system can include a dedicated or standalone expander 900 which can be used to implement the expansion portion of the engines/operating cycles disclosed above, with the air being supplied to the expander from an external source (e.g., an air tank filled with compressed air, or a compressor having its own crankshaft that is distinct from and not operatively coupled to the expander crankshaft).

As shown, the expander 900 includes an expansion cylinder 902 having an expansion piston 904 reciprocally disposed therein. A connecting rod 906 couples the expansion piston 904 to a crankshaft 908. The top of the expansion cylinder 902 is closed by a cylinder head 912 having an intake valve 914 and an exhaust valve 916 disposed therein, along with a fuel injector 918 and a spark plug 920. (In embodiments in which diesel fuel is used, the spark plug 920 can be omitted and compression ignition can be used to initiate combustion.) The intake valve 914 controls fluid communication between a source of compressed air 922 (e.g., a storage tank or a separate compressor) and the expansion cylinder 902, and the exhaust valve 916 controls fluid communication between the expansion cylinder 902 and an exhaust passage 924.

In operation, the expander 900 can execute the expansion portion of any of the operating cycles described above, with the intake valve 914 operating with the timing described above for the crossover expansion valve. Thus, in an exemplary operating cycle, compressed air is supplied from the source 922 to the expansion cylinder 902 through the intake valve 914 as the expansion piston reaches top dead center. The fuel injector 918 is then actuated to add fuel to the compressed air charge in the expansion cylinder 902, and the spark plug 920 is fired just after the expansion piston 904 reaches top dead center to ignite the air-fuel mixture. The resulting combustion drives the expansion piston 904 down in a power stroke, rotating the crankshaft 908 about a crankshaft axis. After the expansion piston 904 reaches bottom dead center and begins ascending within the cylinder 902, the exhaust valve 916 is opened to allow combustion products to be evacuated from the cylinder 902 by the rising expansion piston 904 in an exhaust stroke. The exhaust valve 916 is closed shortly before the piston 904 reaches top dead center, and before the intake valve 904 is opened in the next cycle. This cycle of a power (or "expansion") stroke and an exhaust stroke then repeats.

In other exemplary operating cycles, the exhaust valve 916 can be closed early to trap a quantity of residuals in the expansion cylinder 902 into which fuel and air can be added in subsequent strokes. In still further exemplary operating cycles, the expander 900 can perform the expansion portions of any of the operating cycles described above.

The air expander 900 of FIG. 9 is also capable of operating in any of the air hybrid modes described above, including, for example, AEF mode operation. It will be appreciated that the structure and function of the air expander described above is merely exemplary and that a number of variations are possible and within the scope of the present invention. For example, any of the variations described above with respect to split-cycle engines can be applied to the air expander 900.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

The invention claimed is:

1. A split-cycle engine, comprising:

a crankshaft rotatable about a crankshaft axis;

a compression piston slidably received within a compression cylinder and operatively connected to the crankshaft such that the compression piston reciprocates through a primary intake stroke and a primary compression stroke during a first rotation of the crankshaft and through a standby intake stroke and a standby compression stroke during a second rotation of the crankshaft immediately following the first rotation of the crankshaft;

an expansion piston slidably received within an expansion cylinder and operatively connected to the crankshaft such that the expansion piston reciprocates through a standby expansion stroke and a standby exhaust stroke during the first rotation of the crankshaft and through a primary expansion stroke and a primary exhaust stroke during the second rotation of the crankshaft;

a crossover passage interconnecting the compression and expansion cylinders; and a fuel injector configured to inject fuel into the expansion cylinder during at least a portion of at least one of the standby expansion stroke and the standby exhaust stroke.

2. The engine of claim 1, wherein the engine is configured to continuously alternate between the first rotation of the crankshaft and the second rotation of the crankshaft.

3. The engine of claim 1, further comprising an intake valve configured to control fluid communication between an intake port and the compression cylinder and an exhaust valve configured to control fluid communication between the expansion cylinder and an exhaust port.

4. The engine of claim 1, further comprising a crossover compression (XovrC) valve configured to control fluid communication between the compression cylinder and the crossover passage and a crossover expansion (XovrE) valve configured to control fluid communication between the crossover passage and the expansion cylinder.

5. The engine of claim 3, wherein the intake valve is configured to remain closed during the standby intake stroke and the standby compression stroke to idle the compression cylinder during the second rotation of the crankshaft.

6. The engine of claim 3, wherein the intake valve is configured to remain open during the standby intake stroke and the standby compression stroke to idle the compression cylinder during the second rotation of the crankshaft.

7. The engine of claim 3, wherein the exhaust valve is configured to remain closed during the standby expansion stroke and the standby exhaust stroke to idle the expansion cylinder during the first rotation of the crankshaft.

8. The engine of claim 3, wherein the exhaust valve is configured to be open during at least a portion of the standby expansion stroke and closed during at least a portion of the standby exhaust stroke such that air is drawn into the expansion cylinder during the portion of the standby expansion stroke and compressed during the portion of the standby exhaust stroke.

9. The engine of claim 8, wherein the air is compressed during the standby exhaust stroke to a pressure that is at least about 2 atm to reduce the pressure differential between the crossover passage and the expansion cylinder at the start of the next primary expansion stroke.

10. The engine of claim 1, further comprising an air tank operatively coupled to the crossover passage such that the engine is operable in at least one firing mode and at least one non-firing mode.

11. The engine of claim 10, wherein the compression piston is configured to compress air into the air tank during the standby compression stroke.

12. The engine of claim 10, wherein the fuel injector is configured to inject fuel into the expansion cylinder only when the engine is operating in the at least one firing mode, and wherein the expansion piston is configured to compress air into the air tank during the standby exhaust stroke when the engine is operating in the at least one non-firing mode.

13. The engine of claim 3, wherein:

the exhaust valve is configured to remain open during the standby expansion stroke and during a first portion of the standby exhaust stroke, and is configured to remain closed during a second portion of the standby exhaust stroke; and wherein the fuel injector is configured to inject fuel into the expansion cylinder only during the second portion of the standby exhaust stroke.

14. The engine of claim 13, wherein the second portion of the standby exhaust stroke is about 50% of the standby exhaust stroke.

15. The engine of claim 1, wherein the fuel comprises natural gas and wherein the fuel injector is configured to be fed by a natural gas supply having a pressure that is less than at least one of about 60psi, about 20psi, about 5psi, about 1psi, about 0.5psi, and about 0.25psi.

16. A split-cycle engine, comprising:

a crankshaft rotatable about a crankshaft axis;

a compression piston slidably received within a compression cylinder and operatively connected to the crankshaft such that the compression piston reciprocates through a first intake stroke and a first compression stroke during a first rotation of the crankshaft and through a second intake stroke and a second compression stroke during a second rotation of the crankshaft immediately following the first rotation of the crankshaft;

a first expansion piston slidably received within a first expansion cylinder and operatively connected to the crankshaft such that the first expansion piston reciprocates through a standby expansion stroke and a standby exhaust stroke during the first rotation of the crankshaft and through a primary expansion stroke and a primary exhaust stroke during the second rotation of the crankshaft;

a second expansion piston slidably received within a second expansion cylinder and operatively connected to the crankshaft such that the second expansion piston reciprocates through a primary expansion stroke and a primary exhaust stroke during the first rotation of the crankshaft and through a standby expansion stroke and a standby exhaust stroke during the second rotation of the crankshaft;

a first crossover passage interconnecting the compression cylinder and the first expansion cylinder;

a second crossover passage interconnecting the compression cylinder and the second expansion cylinder;

a first fuel injector configured to inject fuel into the first expansion cylinder during at least a portion of at least one of the standby expansion stroke and the standby exhaust stroke of the first expansion piston; and a second fuel injector configured to inject fuel into the second expansion cylinder during at least a portion of at least one of the standby expansion stroke and the standby exhaust stroke of the second expansion piston.

17. The engine of claim 16, wherein the engine is configured to continuously alternate between the first rotation of the crankshaft and the second rotation of the crankshaft.

18. The engine of claim 16, further comprising an intake valve configured to control fluid communication between an intake port and the compression cylinder, a first exhaust valve configured to control fluid communication between the first expansion cylinder and a first exhaust port, and a second exhaust valve configured to control fluid communication between the second expansion cylinder and a second exhaust port.

19. The engine of claim 16, further comprising:

a first crossover compression (XovrC) valve configured to control fluid communication between the compression cylinder and the first crossover passage;

a second crossover compression (XovrC) valve configured to control fluid communication between the compression cylinder and the second crossover passage;

a first crossover expansion (XovrE) valve configured to control fluid communication between the first crossover passage and the first expansion cylinder; and a second crossover expansion (XovrE) valve configured to control fluid communication between the second crossover passage and the second expansion cylinder.

20. The engine of claim 18, wherein the first exhaust valve is configured to remain closed during the standby expansion stroke and the standby exhaust stroke of the first expansion cylinder to idle the first expansion cylinder during the first rotation of the crankshaft.

* * * * *